US011486238B2

(12) United States Patent
Wetzel

(10) Patent No.: US 11,486,238 B2
(45) Date of Patent: Nov. 1, 2022

(54) ELECTRIC SUBMERSIBLE PUMP (ESP) DEPLOYMENT METHOD AND TOOLS TO ACCOMPLISH METHOD FOR OIL WELLS

(71) Applicant: James R Wetzel, Richmond, TX (US)

(72) Inventor: James R Wetzel, Richmond, TX (US)

( * ) Notice: Subject to any disclaimer, the term of this patent is extended or adjusted under 35 U.S.C. 154(b) by 0 days.

(21) Appl. No.: 17/505,958

(22) Filed: Oct. 20, 2021

(65) Prior Publication Data

US 2022/0186593 A1 Jun. 16, 2022

Related U.S. Application Data

(60) Provisional application No. 63/125,480, filed on Dec. 15, 2020.

(51) Int. Cl.
*E21B 43/12* (2006.01)
*E21B 23/00* (2006.01)

(52) U.S. Cl.
CPC ..... *E21B 43/128* (2013.01); *E21B 23/00* (2013.01)

(58) Field of Classification Search
CPC ..... E21B 43/128; E21B 23/00; E21B 17/028
See application file for complete search history.

(56) References Cited

U.S. PATENT DOCUMENTS 4,823,875 A * 4/1989 Hill ..... E21B 43/263 166/280.1
6,192,983 B1 2/2001 Neuroth et al.
6,209,652 B1 * 4/2001 Portman ..... E21B 33/0422 166/85.4
7,431,092 B2 * 10/2008 Haheim ..... E21B 33/076 166/85.1
9,080,412 B2 7/2015 Wetzel et al.
9,638,021 B2 * 5/2017 Varkey ..... E21B 19/084
9,976,392 B2 5/2018 Lastra et al.
10,145,212 B2 12/2018 Lastra et al.
10,392,875 B2 8/2019 Basler et al.
10,465,472 B2 11/2019 Shampine
10,487,611 B2 11/2019 Shampine
10,590,279 B2 3/2020 Yu et al.
10,605,036 B2 3/2020 Shampine
11,021,939 B2 6/2021 Crowley et al.
2009/0260804 A1 10/2009 Mydur et al.
2011/0272148 A1 11/2011 Lovell et al.
2012/0024521 A1 * 2/2012 Villa ..... E21B 33/068 166/75.11
2012/0125622 A1 5/2012 Melancon et al.
(Continued)

*Primary Examiner* — Michael R Wills, III
(74) *Attorney, Agent, or Firm* — Ritchison Law Offices, PC; John D Ritchison

(57) ABSTRACT

A deployment method and set of alternative tools for deploying, exchanging, and repairing an Electric Submersible Pump (ESP) and pipe strings utilizing a lubricator and standard pressure control equipment (valves, Blow Out Preventers); this method permits a rig less deployment of an ESP with well control maintained using a short length lubricator and standard pressure containment tools. This method defines a specific set of tools to be incorporated in the method to achieve the assembly of the ESP at surface and deployment in a single run to set the ESP at the pumping depth. This method facilitates the orientation and alignment of the terminals of the ESP motor and gauge and creates a pressure barrier through the ESP string during makeup and break out of the ESP.

24 Claims, 55 Drawing Sheets

(56) References Cited

U.S. PATENT DOCUMENTS

| | | | | |
|---|---|---|---|---|
| 2012/0292051 | A1* | 11/2012 | Wetzel | E21B 33/072 166/385 |
| 2014/0102721 | A1* | 4/2014 | Bespalov | E21B 43/128 166/385 |
| 2014/0166270 | A1 | 6/2014 | Varkey et al. | |
| 2018/0355682 | A1* | 12/2018 | Pessin | E21B 19/22 |
| 2019/0203571 | A1* | 7/2019 | Hartley | E21B 43/126 |

* cited by examiner

ENCLOSED ESP EXCHANGE

7. Open pressure equalization valve 330
8. Open master valve 320
9. Lower string 390 to rest on shoulder 450

ENCLOSED ESP EXCHANGE

7. Open pressure equalization valve 330
8. Open master valve 320
9. Lower string 390 to rest on shoulder 450
10. Release running tool string
11. Close valves 320 and 330
12. Bleed pressure with bleed valve 315
13. Break out lubricator 310

ENCLOSED ESP EXCHANGE

14. Lower running tool 400 to latch on ESP motor 30

ENCLOSED ESP EXCHANGE

14. Lower running tool 400 to latch on ESP motor 30
15. Lift string 390 into lubricator 310

ENCLOSED ESP EXCHANGE

14. Lower running tool 400 to latch on ESP motor 30
15. Lift string 390 into lubricator 310
16. Make up lubricator 310
17. Open pressure equalization valve 330

ENCLOSED ESP EXCHANGE

14. Lower running tool 400 to latch on ESP motor 30
15. Lift string 390 into lubricator 310
16. Make up lubricator 310
17. Open pressure equalization valve 330
18. Open master valve 320
19. Lower string 390 into well and mate to Power Plug 30

ENCLOSED ESP EXCHANGE

20. Lift tool string 390 for final makeup

21. Close BOP ram 350

ENCLOSED ESP EXCHANGE

20. Lift tool string 390 for final makeup
21. Close BOP ram 350
22. Close pressure equalization valve 330
23. Bleed pressure with bleed valve 315
24. Open access panel 500 on lubricator 310
25. Make up collar 550

ENCLOSED ESP EXCHANGE

20. Lift tool string 390 for final makeup
21. Close BOP ram 350
22. Close pressure equalization valve 330
23. Bleed pressure with bleed valve 315
24. Open access panel 500 on lubricator 310
25. Make up collar 550
26. Close access panel 500

ENCLOSED ESP EXCHANGE

27. Close bleed valve 315
28. Open pressure equalization valve 330
29. Open BOP ram 350
30. Lower tool string 390 to rest on shoulder 450

ENCLOSED ESP EXCHANGE

27. Close bleed valve 315
28. Open pressure equalization valve 330
29. Open BOP ram 350
30. Lower tool string 390 to rest on shoulder 450
31. Release running tool 400
32. Close valves 320 and 330
33. Bleed pressure with bleed valve 315

ENCLOSED ESP EXCHANGE

34. Break out lubricator 310

ENCLOSED ESP EXCHANGE

34. Break out lubricator 310

35. Lower running tool 400 to latch on protector 600

ENCLOSED ESP EXCHANGE

34. Break out lubricator 310
35. Lower running tool 400 to latch on protector 600
36. Lift tool string 390 into lubricator 310

ENCLOSED ESP EXCHANGE

34. Break out lubricator 310
35. Lower running tool 400 to latch on protector 600
36. Lift tool string 390 into lubricator 310
37. Make up lubricator 310
38. Open pressure equalization valve 330
39. Open master valve 320

ENCLOSED ESP EXCHANGE

34. Break out lubricator 310
35. Lower running tool 400 to latch on protector 600
36. Lift tool string 390 into lubricator 310
37. Make up lubricator 310
38. Open pressure equalization valve 330
39. Open master valve 320
40. Lower tool string 390 and mate to motor 30

ENCLOSED ESP EXCHANGE

41. Lift tool string 390 for final makeup
42. Close BOP ram 350
43. Close pressure equalization valve 330
44. Bleed pressure with bleed valve 315

ENCLOSED ESP EXCHANGE

41. Lift tool string 390 for final makeup
42. Close BOP ram 350
43. Close pressure equalization valve 330
44. Bleed pressure with bleed valve 315
45. Open access panel 500 on lubricator 310
46. Make up collar 550

ENCLOSED ESP EXCHANGE

41. Lift tool string 390 for final makeup
42. Close BOP ram 350
43. Close pressure equalization valve 330
44. Bleed pressure with bleed valve 315
45. Open access panel 500 on lubricator 310
46. Make up collar 550
47. Close access panel 500

ENCLOSED ESP EXCHANGE

48. Close bleed valve 315
49. Open pressure equalization valve 330
50. Open BOP ram 350
51. Lower tool string 390 to rest on shoulder 450

ENCLOSED ESP EXCHANGE

48. Close bleed valve 315
49. Open pressure equalization valve 330
50. Open BOP ram 350
51. Lower tool string 390 to rest on shoulder 450
52. Release running tool 400

Lubricator install parts 740
765
760
787
742
745
748
788
Snap ring
700
789
722
710
720
730

Lubricator install tools 800

Clasp, Rotate, and Align before Set

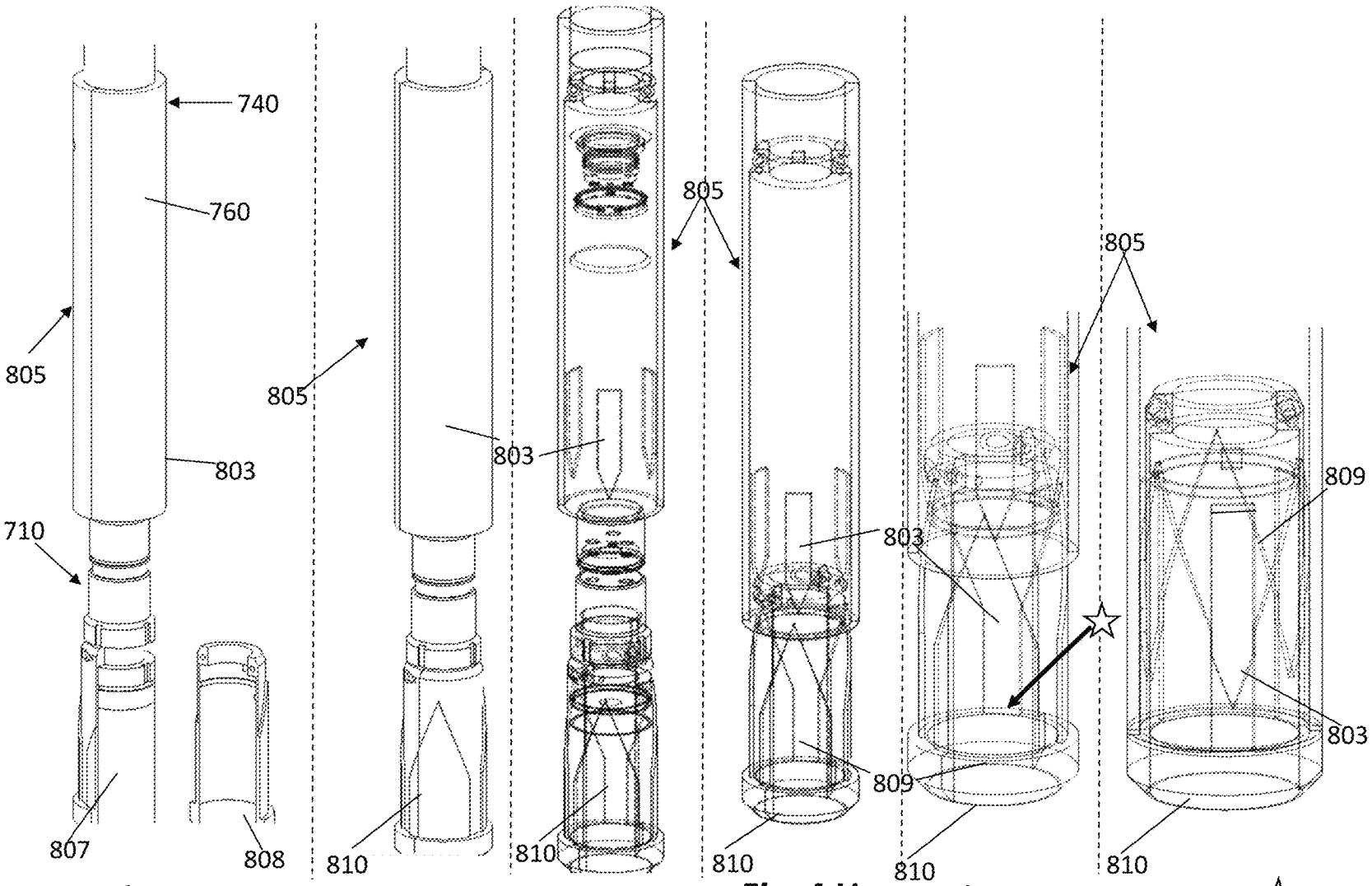
Drop and Set Snap Ring

Lift to Access Hatch, Remove Clamps, and Tighten

RELEASE TOOL

Running Tool

429

420

426
428
425

412

415
413
435
425

411
414

410
409 seal
Groove
not shown 430
410

435
416
415
440

430
425
400
408A
407
406
405

408
405A

Mating Tools

De-Mating Toolss

Lock slide with 3 ratchet quarters

Lock slide partial cutaway with ratchet quarters removed

Ratchet bolt with ratchet quarters

Ratchet quarters move into pockets of lock slide

Lock slide raised

ELECTRIC SUBMERSIBLE PUMP (ESP) DEPLOYMENT METHOD AND TOOLS TO ACCOMPLISH METHOD FOR OIL WELLS

CROSS-REFERENCE TO RELATED APPLICATIONS

This application claims the benefit of United States Provisional Patent Application with Ser. No. 63/125,480 filed Dec. 15, 2020, by James R. Wetzel. The application is entitled "Electrical Submersible Pump (ESP) Deployment Method and Tools to Accomplish Method for Oil Wells".

FIELD OF INVENTION

This invention relates to a method and system for making an electrical connection in an underground borehole that provides for the transmission of electric power from a power supply to the motor of an electric submersible pump (ESP). More particularly, this invention relates to the deployment of oil well submersible pumps and wet connectors for downhole use. This involves operations for installation or retrieval to assemble or disassemble pumps and connectors. The operation on these pumps and connectors can be made and unmade in the fluid environment of a wellbore, particularly but not exclusively a hydrocarbon well. The field of the invention relates generally to installations in downhole environments, and more particularly to a receptacle connector effectively engaged with a mating plug connector. This invention relates to the deployment of an ESP with well control maintained using a short length lubricator and standard pressure containment tools. This invention relates to the tools and methods to assemble the ESP at surface and run-in hole while maintaining full control of the well.

This invention relates to wet connection systems for connecting a conductor or conductors to equipment deployed in a borehole, for example, an oil or gas well. Wet connection systems provide a connection that can be made and unmade in-situ in a liquid environment so that the deployed equipment can be disconnected and recovered without removing the conductor from the borehole, and then re-connected to the conductor in situ when the equipment is re-deployed. This invention relates to Electric Submersible Pump (ESP) Deployment Method and Tools to Accomplish Method for Oil Wells and in particular methods and tools to accomplish deployment and connections without the use of large rigs and equipment traditionally used in the industry.

FEDERALLY SPONSORED RESEARCH

None.

SEQUENCE LISTING OR PROGRAM

None.

BACKGROUND—FIELD OF INVENTION and PRIOR ART

As far as known, there are no Electric Submersible Pump (ESP) Deployment Method and Tools to Accomplish Method for Oil Wells like depicted herein. It is believed that this process and method with the tools presented are unique in their design and technologies. The production of fluid from an oil or gas well is often performed using an Electric Submersible Pump (ESP). The pump is typically installed in a borehole by mating to the bottom of a production tubing string and lowered into the borehole. The power cable is banded to the outside of the production tubing. When there is a failure of the ESP a workover rig is required to pull the tubing and pump from the well for replacement. The high cost associated with these workovers has generated interest in finding an alternative method to deploy the ESP. Several different methods have been developed to date and the most promising method utilizes a system that leaves the electrical connection in the well and can install the ESP on wireline, coiled tubing, or sucker rods.

BACKGROUND

This background as to Electric Submersible Pumps and their deployment and field connections to electrical power should be useful. An oil or gas well may use many types of apparatus that require an electric connection, such as tools and measuring devices that are lowered down the well, and equipment that is installed or present in a casing or production tube. Electrical power for these tools is usually supplied through a conductive line from the surface extending from the tool to the surface. Usually, an oil or gas well will be lined with tubing that is cemented into the borehole to form a permanent well casing, the inner surface of the tubing defining the wellbore. (In this specification, a "tube" or "tubing" means an elongate, hollow element which is usually but not necessarily of circular cross-section, and the term "tubular" is to be construed accordingly.)

The fluid produced from the well is ducted to the surface via production tubing which is usually deployed down the wellbore in jointed sections and (since its deployment is time consuming and expensive) is preferably left in situ for the productive life of the well. Where an ESP is used to pump the well fluid to the surface, it may be permanently mounted at the lower end of the production tubing but is more preferably deployed by lowering it down inside the production tubing on a wireline or on continuous coiled tubing (CT), so that it can be recovered without disturbing the production tubing.

In some cases, an electric submersible pump (ESP) is installed in wells to increase the production of hydrocarbon fluid from a well. In general, an ESP is an "artificial lift" mechanism that is typically positioned relatively deep within the well where it is used to pump the hydrocarbon fluid to the surface. However, installation of an ESP on an existing well can be very expensive for several reasons. First, installation of an ESP on an existing well requires that the completion be pulled and replaced with a completion that is designed for and includes the ESP. Second, such workover operations require the use of expensive vessels (e.g., ships or rigs) to re-complete the well, given the equipment that must be removed from the well during these workover operations. Even in the case where the well initially included an ESP, or where one was later added to the well, such ESPs do malfunction and need to be replaced. Thus, even in this latter situation, expensive vessels must be employed in replacing previously installed ESPs.

The high cost associated with these workovers has generated interest in finding an alternative method to deploy the ESP. Several different methods have been developed to date and the most promising method utilizes a system that leaves the electrical connection in the well and can install the ESP on wireline, coiled tubing, or sucker rods. One of the challenges with the rig less deployment systems is the ability to maintain control of the well during the workover operation. Without the typical well control tools used in a standard workover the operator must employ alternate methods to maintain control of the well. Some of the demonstrated methods include downhole valve systems and or long length lubricators for maintaining control. The reliability of the downhole valves and the ability to handle long lubricators on the surface create operational, safety and financial risks to the operator.

PROBLEM SOLVED

The purpose of this invention is to lower the initial cost for the operator and provide a simpler system that is more reliable. In addition, the invention will offer a method and associated tools to accomplish field deployment while maintaining pressure control without the need of a large oil rig. The improvement and problems solved as to Electric Submersible Pump (ESP) Deployment Method and Tools to Accomplish Method for Oil Wells include: a manner to exchange the ESP and strings utilizing a lubricator with associated tools to maintain pressure control through and around the ESP during make up, break down and running; a safe system with shut off valves; a system that employs and fully utilizes standard blow out prevention; and an installation that is compatible with the Wetzel rig less system and the improved wet mate connection system and one that can have a more than three (3) connectors to power multiple down hole components and systems.

PRIOR ART

It is believed that this product is unique in its design and technologies. A novelty search revealed several related technologies:

A. U.S. Pat. No. 9,080,412 named Gradational insertion of an artificial lift system into a live wellbore and issued to Wetzel, et al. in 2015.

B. U.S. Pat. No. 6,192,983 entitled Coiled tubing strings and installation methods and issued to Neuroth, et al. in 2001.

C. U.S. Pat. No. 9,976,392 called Hydraulically assisted deployed ESP system issued to Lastra, et al. in 2018.

D. U.S. Pat. No. 10,145,212 named Hydraulically assisted deployed ESP system and issued to Lastra, et al. in 2018.

E. U.S. Pat. No. 10,392,875 entitled Gripper assembly for continuous rod and methods of use thereof and issued to Basler in 2019.

F. U.S. Pat. No. 10,465,472 called Deployment valves operable under pressure and issued to Shampine in 2019.

G. U.S. Pat. No. 10,487,611 entitled Deployment method for coiled tubing and issued to Shampine in 2019.

H. U.S. Pat. No. 10,590,279 named a Sharable deployment bar with multiple passages and cables again issued to Shampine in 2020.

I. U.S. Pat. No. 10,605,036 called Deployment blow out preventer with interlock and once more issued to Shampine in 2020.

J. US Patent Application No. 2009/0260804 entitled Mobile Well Services Assembly and submitted by Mydur et al.

K. US Patent Application No. 2011/0272148 called a METHODS, SYSTEMS AND APPARATUS FOR COILED TUBING TESTING and applied for by Lovell et al.

L. US Patent Application No. 2012/0125622 named WELLSITE EQUIPMENT REPLACEMENT SYSTEM AND METHOD FOR USING SAME submitted by Melancon et al.

M. US Patent Application No. 2014/0166270 entitled SYSTEM AND METHOD FOR POSITIONING EQUIPMENT FOR WELL LOGGING and was applied for by Varkey et al.

N. U.S. Pat. No. 11,021,939 named a System and method related to pumping fluid in a borehole which was issued to Crowley, et al. in June, 2021. It shows and demonstrates a technique facilitates use of a submersible pumping system deployed downhole in a borehole. This docking assembly comprises a docking station which has at least one electrical wet connector and is coupled to a receiving tubular. An electrical power cable is coupled to the docking station to enable electrical power to be provided to the at least one electrical wet connector. The docking assembly is deployed downhole to a desired location in the borehole to enable coupling with the submersible pumping system. The submersible pumping system is simply moved downhole into the receiving tubular and into electrical engagement with the electrical wet connectors.

As can be observed in the above descriptions, none of the prior art has anticipated or caused one skilled in the art of wetmate connection systems and methods for ESPs or the like to see this invention by Wetzel as obvious to a person skilled in the ordinary art of the industry. The Electric Submersible Pump (ESP) Deployment Method and Tools to Accomplish Method for Oil Wells solves many problems and is a unique method with associated deployment tools to address the needs for the oil well industry by providing a method and tools used with a simple deployment and connection system which needs no special rigs or equipment to maintain the electric submersible pumps.

SUMMARY OF THE INVENTION

This invention is an Electric Submersible Pump (ESP) Deployment Method and Tools to Accomplish Method for Oil Wells. In accordance with some embodiments of the invention there is provided a method to deploy and exchange an electric submersible pump (ESP) and interconnect electrical conductors in an underground borehole by means of a static male connector and a moveable female connector. The method consists of utilizing a short length lubricator in conjunction with several tools: a running tool with integral sealing plug, alignment guides, and a simple release mechanism. This permits the Wetzel rig less system and improved wet mate connectors to be deployed with full well control through a short length lubricator and standard pressure containment tools. The ESP is assembled component by component on the surface and run-in hole with one run to depth of the wireline, coiled tubing, or sucker rod deployment method. The installation system employs tools to align the terminals of the specific ESP components and create a temporary joint between components that is subsequently enhanced with a permanent connection. The retrieval system employs tools to create a temporary removable joint that facilitates the joint separation within the pressure containment system.

The method is compatible with the Wetzel rig less deployment system that has a docking station with male wet mate able connectors and power cable and a motor connector with female wet mate able connectors that will be mated to an electric submersible pump (ESP). The deployment method can be utilized with a modified head and base group and a standard head and base group as described below. The Electric Submersible Pump (ESP) Deployment Method and Tools to exchange the ESP and strings utilizing a lubricator and standard pressure control equipment (valves, Blow Out Preventers) comprising:

First, place a standard pressure containment system and a wireline system in place at a well for the workover and do the following steps:

Step 1: Close valves 320, 330 and Bleed pressure with bleed valve 315;

Step 2: Break out lubricator 310;

Step 3: Lower running tool 400 to latch on ESP component or another unit;

Step 4: Lift tool string 390 into lubricator 310;

Step 5: Make up lubricator 310;

Step 6: Open pressure equalization valve 330 and Open master valve 320;

Step 7: Lower tool string 390 and mate to motor 30;

Step 8: Lift tool string 390 for final makeup

Step 9: Close BOP ram 350, Close pressure equalization valve 330, and Bleed pressure with bleed valve 315;

Step 10: Open access panel 500 on lubricator 310, Make up collar 550, and Close access panel 500;

Step 11: Close bleed valve 315, Open pressure equalization valve 330, and Open BOP ram 350;

Step 12: Lower the tool string (390) to rest on a shoulder (450) and release the running tool (400);

Step 13: Repeat Steps 1 through 12 to complete assembly of the remaining components of the ESP string;

Step 14: After complete assembly of ESP string, lower the ESP string to the pump setting depth and mate the ESP motor connector to the docking station in the borehole.

Step 15: Release running tool string from ESP and pull to surface.

Step 16: Remove the wireline equipment from the well, remove the standard pressure containment system, and re-start the operation.

Step 17: Removal of the ESP from the well is the reverse of the installation.

wherein the manner to exchange the ESP and strings utilizing a lubricator and standard pressure control equipment enabled using improved tools including a running tool with integral sealing plug, alignment guides, and a simple snap ring release mechanism. Alternative makeup and decouple tools are shown.

OBJECTS AND ADVANTAGES

There are several objects and advantages of the Electric Submersible Pump (ESP) Deployment Method and Tools to Accomplish Method for Oil Wells. There are currently no known ESP deployment systems and/or devices that are effective at providing the objects of this invention. The various advantages and benefits:

| Item | Advantages |
|---|---|
| 1 | Allows for a lower initial cost for the operator |
| 2 | Provides a simpler system that is more reliable |
| 3 | Demonstrates a method and associated tools to accomplish field deployment without the need of a large oil rig |
| 4 | Is a manner to exchange the ESP and strings utilizing a short length lubricator and associated tools to make up and break out the ESP component assemblies at surface while maintaining pressure control. |
| 5 | Provides a method for creating a pressure seal through the ESP make up and break down. |
| 6 | Provides a method to orient and mate the terminals of electrically conductive ESP components |
| 7 | Is a safe system with shut-off valves |

-continued

| Item | Advantages |
|---|---|
| 8 | Provides a system that employs and fully utilizes standard blow out prevention |
| 9 | Is an installation that is compatible with the Wetzel rig less system and the improved wet mate connection system |
| 10 | Employs a method that can have more than three (3) connectors to power multiple down hole components and systems |
| 11 | Employs a simple snap ring release mechanism or a ratchet bolt and clamp compatible with standard bolt coupling of the head and base |

Finally, other advantages and additional features of the present Electric Submersible Pump (ESP) Deployment Method and Tools to Accomplish Method for Oil Wells will be more apparent from the accompanying drawings and from the full description of the device. For one skilled in the art of oil well pumping and retrieval devices and systems, it is readily understood that the features shown in the examples with this deployment method are readily adapted to other types of deployment methods and tools for oil and gas well retrieval systems and devices.

DESCRIPTION OF THE DRAWINGS—FIGURES

The accompanying drawings, which are incorporated in and constitute a part of this specification, illustrate an embodiment of the Electric Submersible Pump (ESP) Deployment Method and Tools to Accomplish Method for Oil Wells that is preferred. The drawings together with the summary description given above and a detailed description given below explain the principles of the deployment method and related tools. It is understood, however, that the method and tools herein described is not limited to only the precise arrangements and instrumentalities shown.

FIG. 4 is a sketch of the installation guides and clasping components and FIGS. 4A through 4J show additional features and components and demonstrate how the guides are used for deployment.

FIGS. 7A through D are close-up sketches showing the components for the release cam mechanism.

FIGS. 8A through 8F show the operation of the release cam mechanism.

Figure 9:
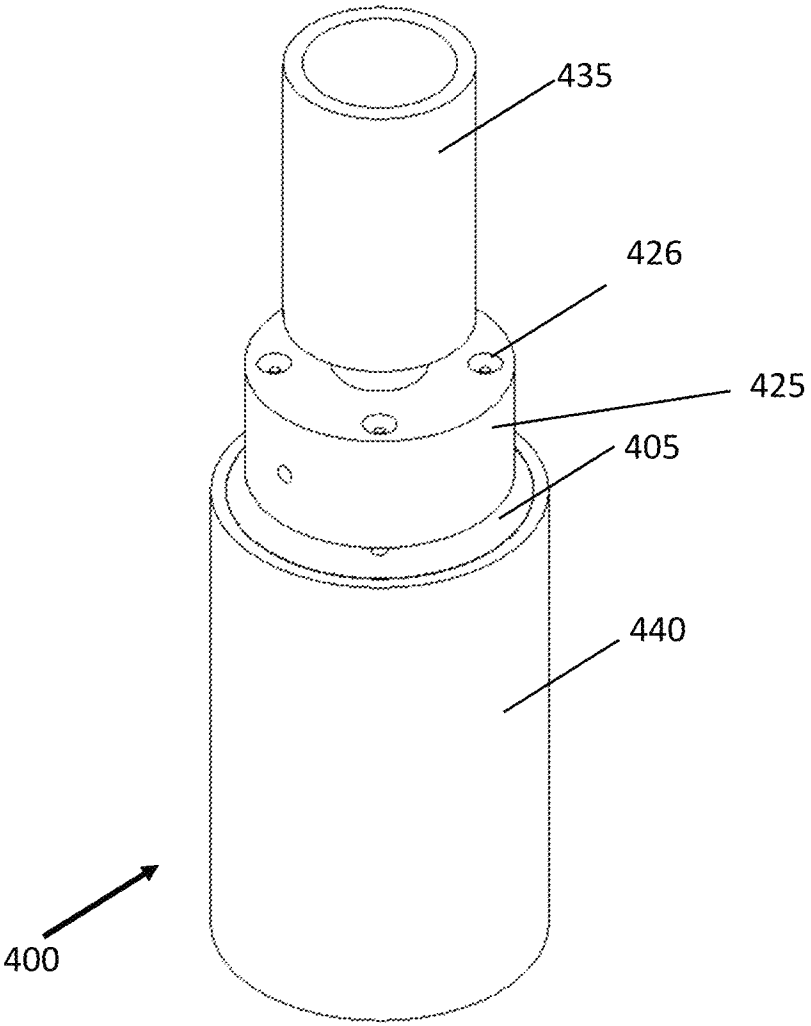
Figures 9A, 9B, 9C, 9D, 9E, 9F, 9G, 9H, 9I, 9J:
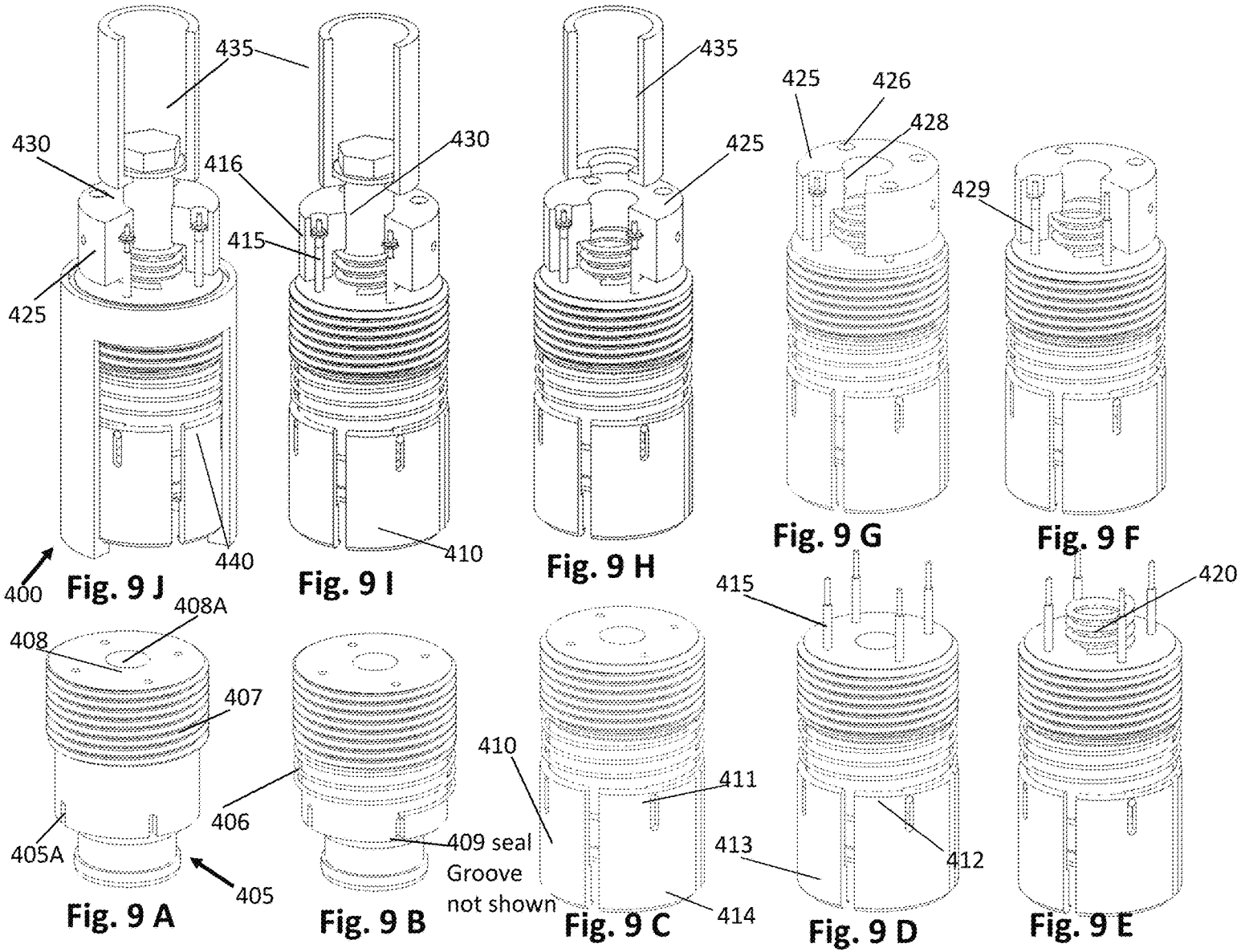

FIG. 9 is a sketch of a running tool with integral sealing plug and FIGS. 9A through 9J are additional sketches of the components in the running tool assembly.

FIGS. 10A through 10K are the running tool in a pick-up operation and then FIGS. 10L through 10P show the operation of releasing the running tool from the head assembly.

Figure 11:
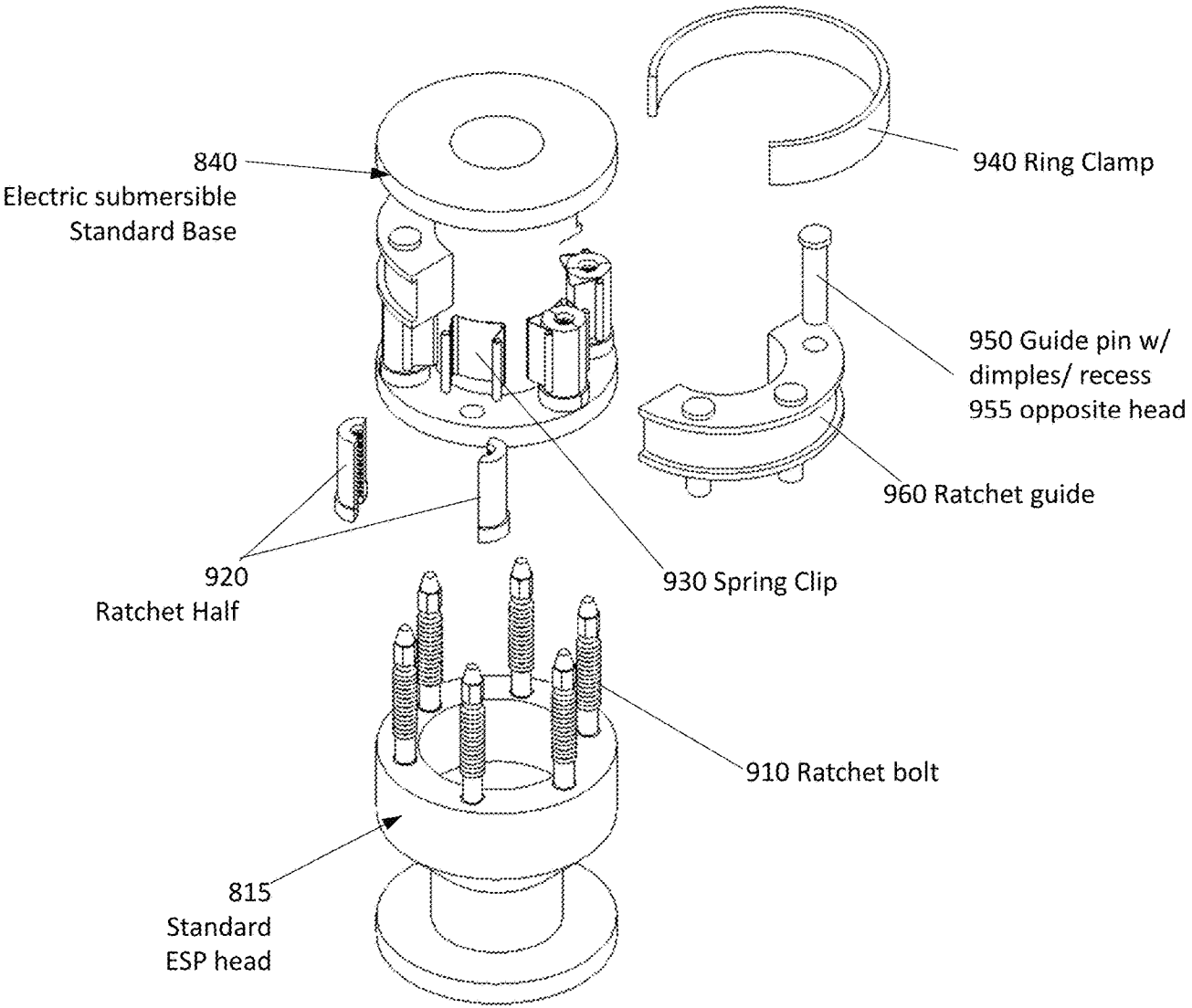

FIG. 11 is a sketch of the tools used for the temporary mating of the ESP components.

FIGS. 12A through 12M are the makeup of the upper and lower ESP components with the mating tools and then the mating operation of the upper and lower ESP components inside the pressure containment system.

Figures 13A, 13B, 13C:
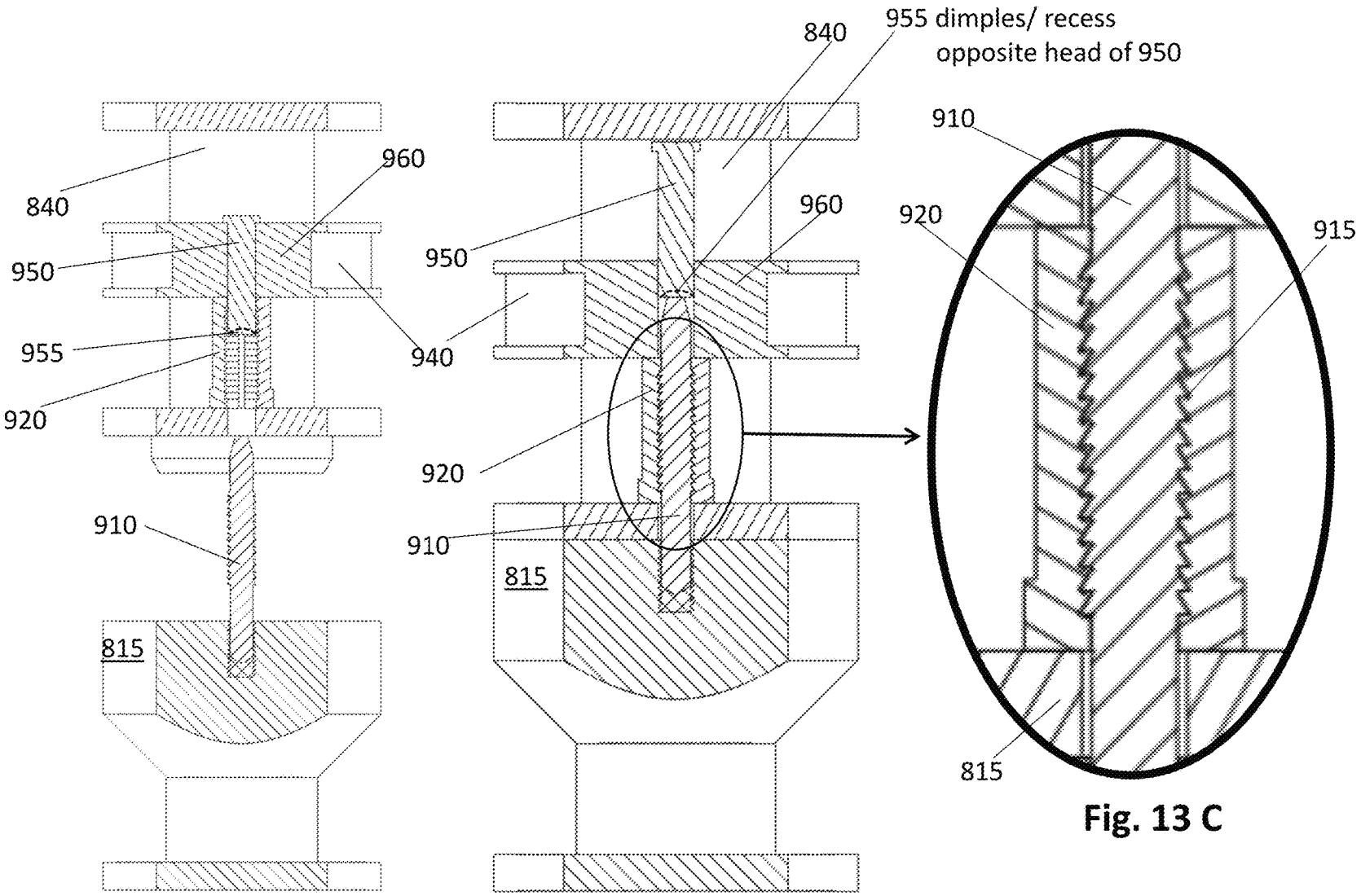

FIGS. 13A through 13C are cross section views of one ratchet bolt mounted to the head of the lower ESP component, the guide pin being pushed out of the ratchet guide and the ratchet halves closing around the ratchet bolt, and the undercut profile of the ratchet bolt creating forces and the inter play of the tools.

Figure 14:
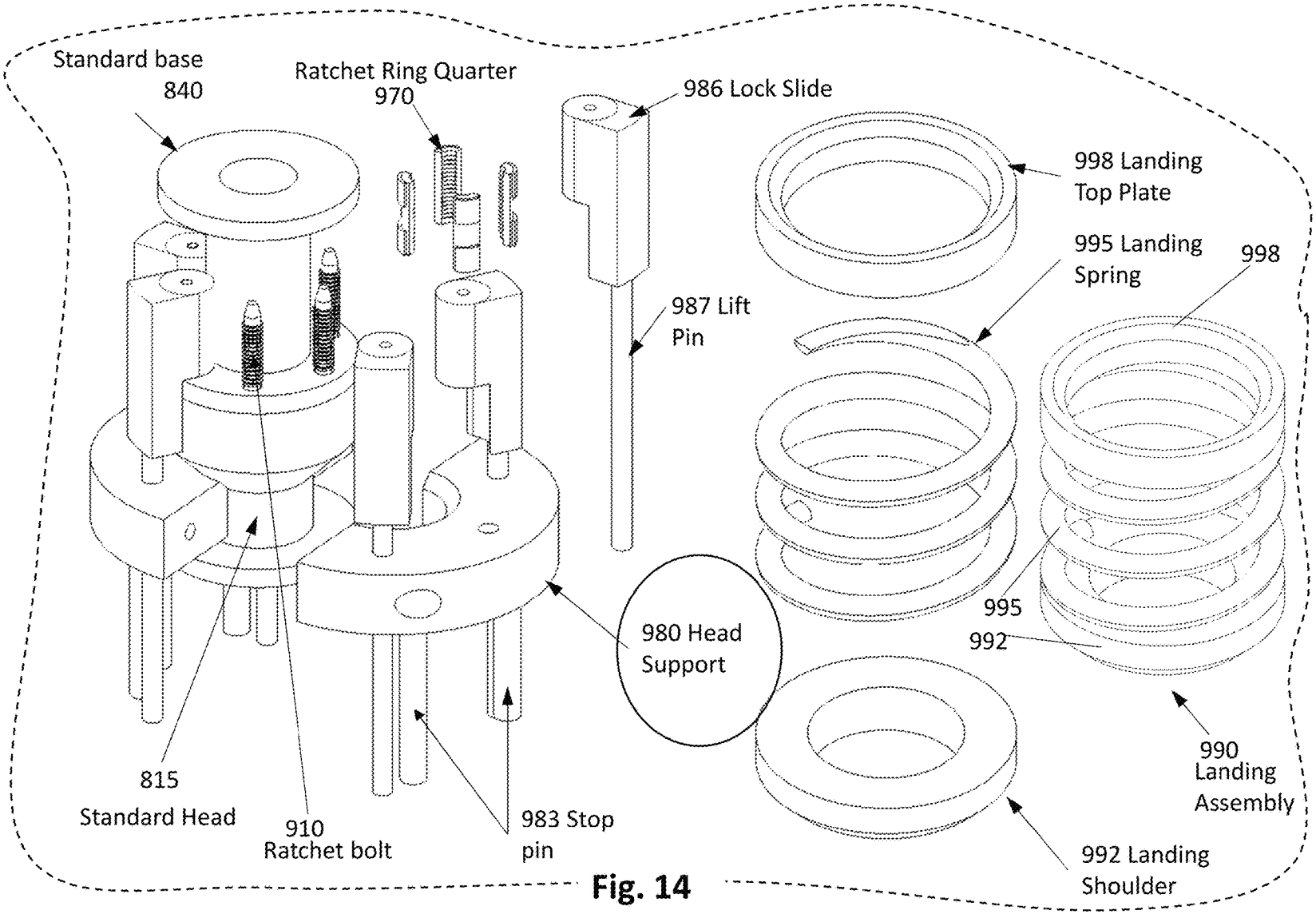

FIG. 14 is a sketch of the tools used for the de-mating of the ESP components.

Figures 15A, 15B, 15C, 15D, 15E, 15F, 15G, 15H:
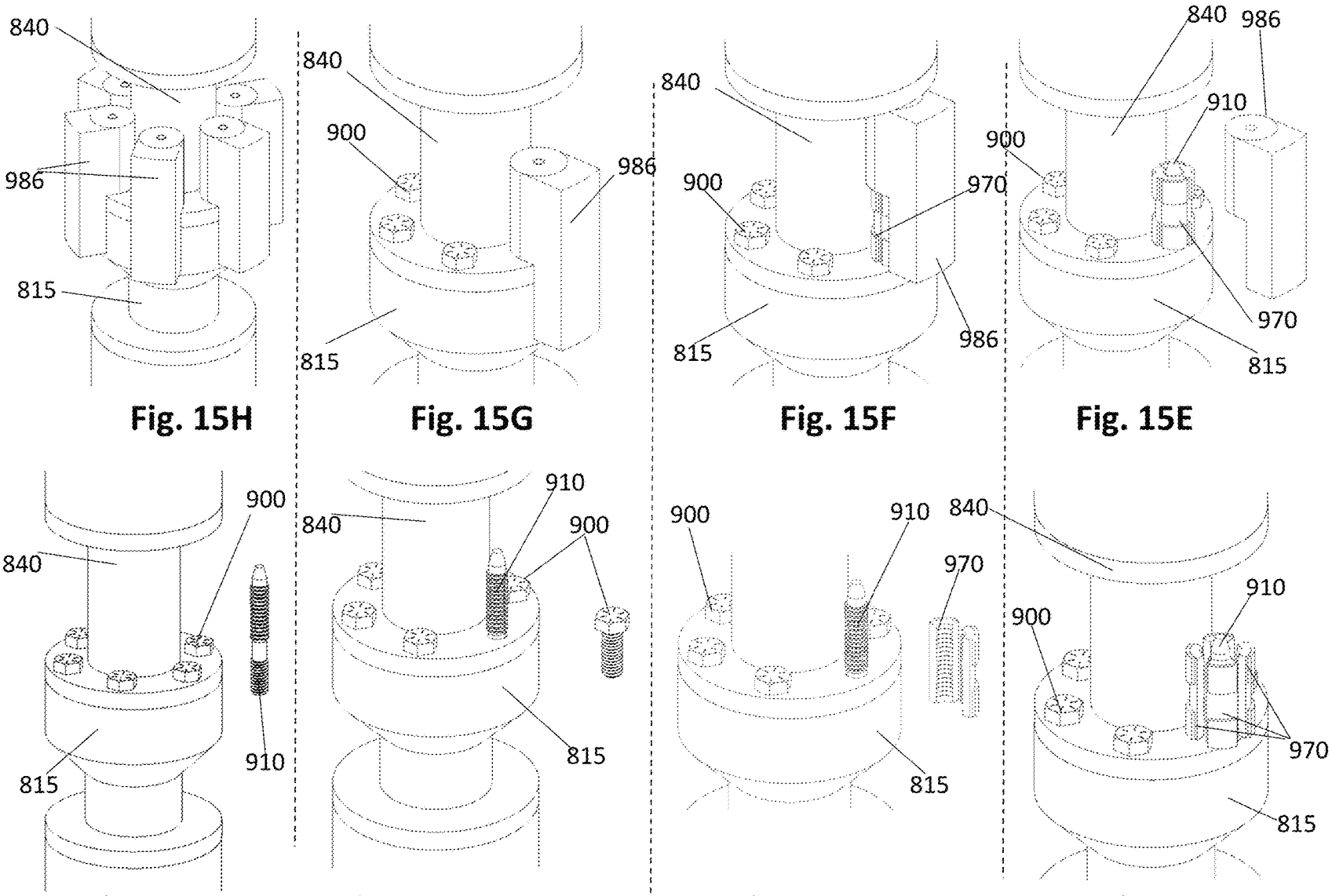
Figure 15I:
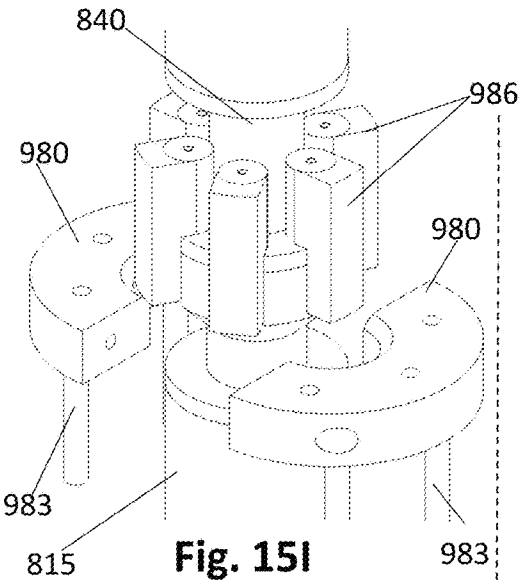
Figure 15J:
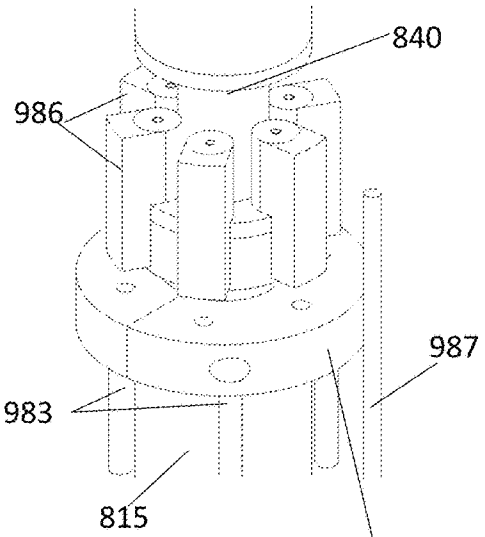
Figure 15K:
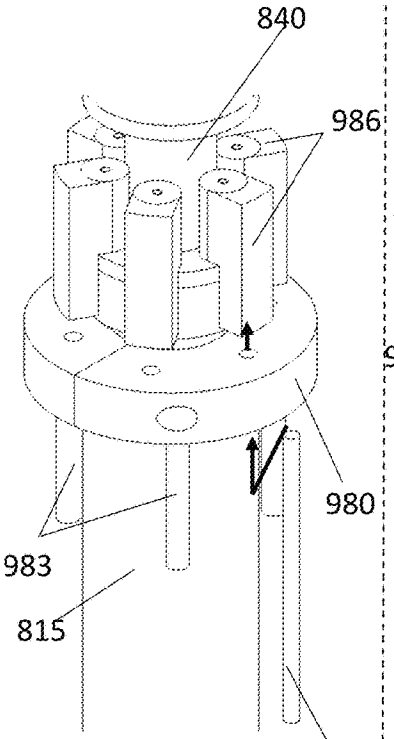
Figure 15L:
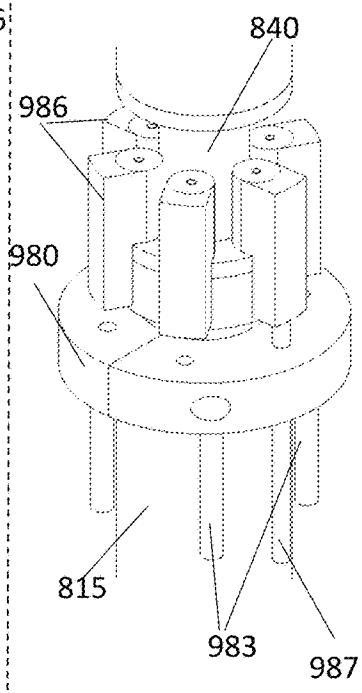
Figure 15M:
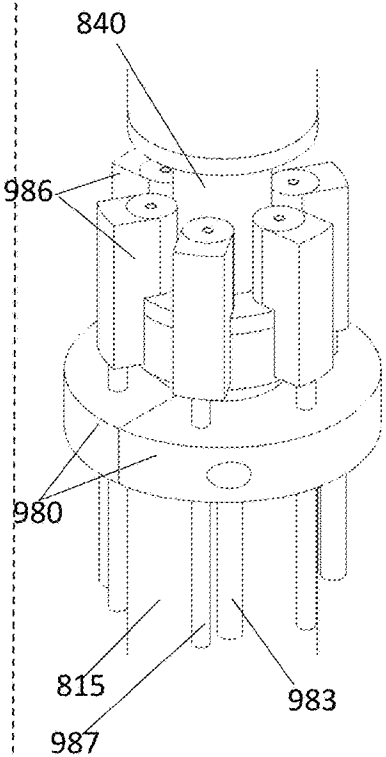
Figures 15N, 15O, 15P, 15Q, 15R, 15S, 15T:
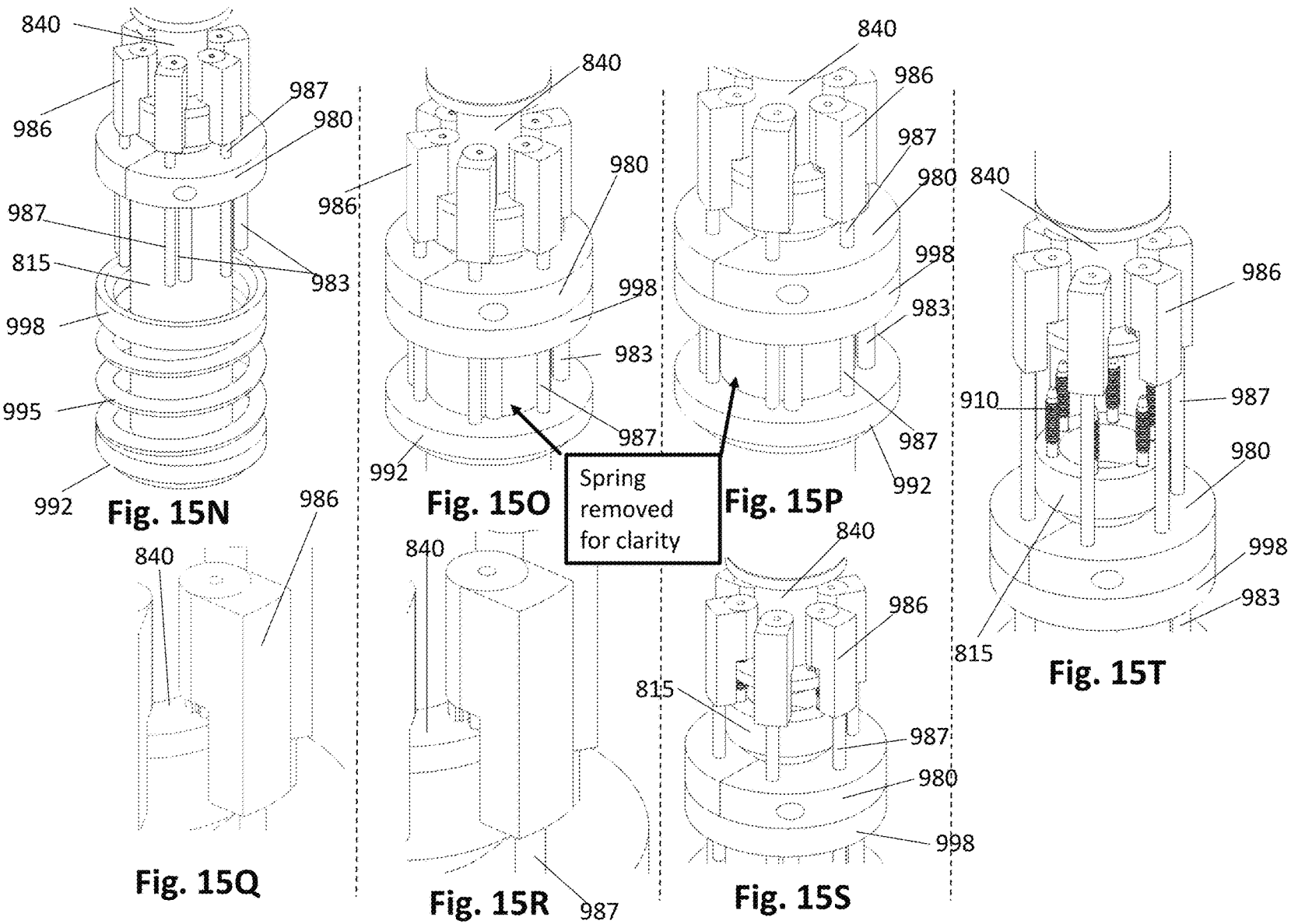

FIGS. 15A through 15T are sketches of the de-mating tools attached to the mated ESP assembly and then the de-mating operation performed inside the pressure containment system to de-couple the ESP components, particularly the head from the base. The spring is removed for clarity.

FIGS. 16A through 16H are sketches of cross sections of the mated ESP assembly and one of the lock slides with the ratchet bolts and ratchet quarter, movement as the lock slide is pushed upward from its original position, and then as the ratchet bolt, lock slide, and ratchet quarters decouple and free and separate the ESP components particularly the head and the base. Exploded views of the bosses and pockets are provided for clarity.

DESCRIPTION OF THE DRAWINGS—REFERENCE NUMERALS

The following list refers to the drawings:

TABLE B

| Reference numbers | |
|---|---|
| Ref no. | Description |
| 30 | electric submersible pump (ESP) 30 or E cube power plug, and second, third ESP in string |
| 33 | Electric Submersible Pump (ESP) Deployment Method 33 and Tools to Accomplish Method for Oil Wells |
| 301 | grease injection head 301 |
| 310 | lubricator 310 |
| 315 | bleed valve 315 used to bleed pressure |
| 320 | master valve 320 |
| 330 | pressure equalization valve 330 |
| 350 | Blow out preventer (BOP) 350 is a mechanical device connected to the wellhead to control and prevent blowouts; one or more valves installed at the wellhead to prevent the escape of pressure either in the annular space between the casing and the drill pipe or in open hole |
| 360 | well head 360, the equipment installed at the surface of the wellbore. A wellhead includes such equipment as the casinghead and tubing head |
| 390 | string 390 of components pumps, motors, gagues, valves etc. |
| 400 | running tool 400 with integral sealing plug 405 |
| 405 | sealing plug 405 with release pin slots 405A |
| 406 | dog spring 406 |
| 407 | external thread 407 on plug 405 |
| 408 | internal aperture 408 with threads 408A on plug 405 |
| 409 | seal groove 409 and seal 409A (not shown) |
| 410 | dog 410 |
| 411 | a set of slots 411 in dog 410 for release pin 405A travel |
| 412 | pin 412 to slidingly secure and align plug 405 |

TABLE B-continued

| Reference numbers | |
|---|---|
| Ref no. | Description |
| 413 | a set of spaces 413 between dogs 410 to allow contraction |
| 414 | chamfer 414 on bottom circumference of dog 410 |
| 415 | release pin(s) 415 |
| 416 | nut 416 on release pin 415 |
| 420 | lift spring 420 under slide 425 |
| 425 | slide 425 |
| 426 | apertures 426 in slide 425 for release pins 415 |
| 427 | apertures 427 in slide 425 for shear pins 445 |
| 428 | aperture 428 for lift screw 430 |
| 429 | aperture and shoulder 429 for lift spring 420 |
| 430 | lift screw 430 |
| 435 | adapter 435 |
| 440 | housing 440 for components of running tool 400 |
| 444 | chamfer 444 on inner circumference of housing 440 to grip and release dog 410 at chamfer 414 |
| 445 | shear pin 445 |
| 450 | shoulder 450 of casing |
| 500 | access panel 500 |
| 550 | assembly collar 550 |
| 600 | secondary motor/protector 600 |
| 700 | Modified Electric Submersible head 700 |
| 701 | lead in chamfer 701 on head 700 |
| 710 | Electric Submersible Head Assembly 710 |
| 720 | Locking nut 720 on the Electric Submersible Head Assembly 710 |
| 722 | threads 722 (external) on locking nut 720 |
| 725 | tool slots 725 on locking nut 720 |
| 730 | Electric Submersible Head flange 730 |
| 740 | Modified Electric Submersible Base 740 |
| 741 | alignment notch 741 |
| 742 | Electric Submersible Base flange 742 |
| 745 | O ring grooves 745 |
| 748 | base terminals 748 |
| 749 | head terminals 749 |
| 750 | Alignment notch 750 |
| 760 | collar 760 |
| 765 | aperture 765 in collar 760 for base 740 |
| 770 | Electric Submersible Base (ESP) base assembly 770 |
| 780 | snap ring release mechanism 780 |
| 781 | Mounting clamp 781 for snap ring mechanism 780 |
| 782 | release cam mechanism 782 |
| 782A | pin 782A |
| 782B | torsion spring 782B |
| 782D | release cam driven 782D |
| 782F | release cam follower 782F |
| 785 | release window 785 |
| 787 | thread area 787 (internal) on collar 780 |
| 788 | snap ring 788 |
| 789 | groove 789 for snap ring 788 |
| 790 | lower shaft 790 |
| 791 | alignment profile 791 lower shaft 790 |
| 792 | lead-in chamfer 792 (not shown) lower shaft 790 |
| 794 | alignment profile 794 coupling 795 |
| 795 | coupling 795 |
| 796 | alignment profile 796 upper shaft 799 |
| 797 | lead-in chamfer 797 upper shaft 799 |
| 799 | upper shaft 799 |
| 800 | lubricator 310 guides and clasping tools 800 for install |
| 801 | alignment guide body left 801 |
| 802 | alignment guide body right 802 |
| 803 | aligning tab 803 for alignment guide 805 |
| 804 | alignment key 804 |
| 805 | alignment guide 805 |
| 806 | mounting flange 806 |
| 807 | alignment tool body left 807 |
| 808 | alignment tool body right 808 |
| 809 | alignment tab 809 for alignment tool 810 |
| 810 | alignment tool 810 |
| 815 | Standard Electric Submersible head 815 |
| 840 | Standard Electric Submersible Base 840 |
| 900 | assembly bolt 900 securing standard head 700 to standard base 740 |
| 910 | ratchet bolt 910 six (six) replacing standard assembly bolts 900 on standard head 700 |

TABLE B-continued

| Reference numbers | |
|---|---|
| Ref no. | Description |
| 915 | ratchet profile 915 of ratchet bolt 910 for fit into thread profile of ratchet halves 920 or ratchet ring quarters 970 |
| 920 | ratchet half 920 six(6) pairs |
| 930 | spring clip 930 |
| 940 | ring clamp 940 |
| 950 | guide pin 950 |
| 955 | dimple/recess 955 on insert end of guide pin 950 to help center tapered end of ratchet bolt 910 |
| 960 | ratchet guide 960 |
| 970 | ratchet ring quarter 970 |
| 975 | boss 975 on back side of ratchet quarter 970 |
| 980 | head support 980 |
| 983 | stop pin 983 of head support 980 |
| 986 | lock slide 986 |
| 987 | lift pin 987 |
| 988 | internal pocket 988 of lock slide 986 |
| 990 | landing assembly 990 |
| 992 | landing shoulder 992 |
| 995 | landing spring 995 |
| 998 | landing top plate 998 |

DETAILED DESCRIPTION OF PREFERRED EMBODIMENT

The present development is an Electric Submersible Pump (ESP) Deployment Method and Tools to Accomplish Method for Oil Wells. This invention relates to a method and system for making an electrical connection in an underground borehole that provides for the transmission of electric power from a power supply to the motor of an electric submersible pump (ESP). This invention relates deployment of oil well submersible pumps and wet connectors for downhole use. This involves operations for installation or retrieval to assemble or disassemble pumps and connectors. The operation on these pumps and connectors can be made and unmade in the fluid environment of a wellbore, particularly but not exclusively a hydrocarbon well. The field of the invention relates generally to installations in downhole environments, and more particularly to a receptacle connector effectively engaged with a mating plug connector. This invention relates to wet connection systems for connecting a conductor or conductors to equipment deployed in a borehole, for example, an oil or gas well. Wet connection systems provide a connection that can be made and unmade in-situ in a liquid environment so that the deployed equipment can be disconnected and recovered without removing the conductor from the borehole, and then re-connected to the conductor in situ when the equipment is re-deployed. This invention relates to Electric Submersible Pump (ESP) Deployment Method and Tools to Accomplish Method for Oil Wells and in particular methods and tools to accomplish deployment and connections without the use of large rigs and equipment traditionally used in the industry.

The advantages for the Electric Submersible Pump (ESP) Deployment Method and Tools to Accomplish Method for Oil Wells are listed above in the introduction. Succinctly the benefits are that the system has/is:

A. Allows for a lower initial cost for the operator;
B. provide a simpler system that is more reliable;
C. Demonstrates a method and associated tools to accomplish field deployment without the need of a large oil rig;
D. Is a manner to exchange the ESP and strings utilizing a short length lubricator and associated tools to make up and break out the ESP component assemblies at surface;
E. Provides a method for creating a pressure seal through the ESP make up and break down;
F. Provides a method to orient and mate the terminals of electrically conductive ESP components;
G. Is a safe system with shut-off valves;
H. Provides a system that employs and fully utilizes standard blow out prevention;
I. Is an installation that is compatible with the Wetzel rig less system and the improved wet mate connection system;
J. Employs a method that can have more than three (3) connectors to power multiple down hole components and systems; and
K. Employs a simple snap ring release mechanism or a ratchet bolt and clamp compatible with standard bolt coupling of the head and base.

The preferred embodiment of an Electric Submersible Pump (ESP) Deployment Method and Tools to exchange the ESP and strings in a lubricator and low-profile docking station for Oil Wells comprising:

First, place the standard pressure containment system and a wireline system in place at a well for the workover and do the following steps:

Step 1: Close valves 320, 330 and Bleed pressure with bleed valve 315;
Step 2: Break out lubricator 310;
Step 3: Lower running tool 400 to latch on ESP component or another unit;
Step 4: Lift tool string 390 into lubricator 310;
Step 5: Make up lubricator 310;
Step 6: Open pressure equalization valve 330 and Open master valve 320;
Step 7: Lower tool string 390 and mate to motor 30;
Step 8: Lift tool string 390 for final makeup
Step 9: Close BOP ram 350, Close pressure equalization valve 330, and Bleed pressure with bleed valve 315;
Step 10: Open access panel 500 on lubricator 310, Make up collar 550, and Close access panel 500;
Step 11: Close bleed valve 315, Open pressure equalization valve 330, and Open BOP ram 350;
Step 12: Lower the tool string (390) to rest on a shoulder (450) and release the running tool (400);
Step 13: Repeat Steps 1 through 12 to complete assembly of the remaining components of the ESP string;
Step 14: After complete assembly of ESP string, lower the ESP string to the pump setting depth and mate the ESP motor connector to the docking station in the borehole.
Step 15: Release running tool string from ESP and pull to surface.
Step 14: Remove the wireline equipment from the well and re-start the operation
Step 17: Removal of the ESP from the well is the reverse of the installation.

wherein the manner to exchange the ESP and strings utilizing a lubricator and standard pressure control equipment (valves, Blow Out Preventers) are enabled using improved tools including a running tool with integral sealing plug, alignment guides, and a simple snap ring release mechanism. The deployment method can be utilized with a modified head and base group and a standard head and base group as described below. Alternative makeup and decouple tools are also shown.

Figure 1:
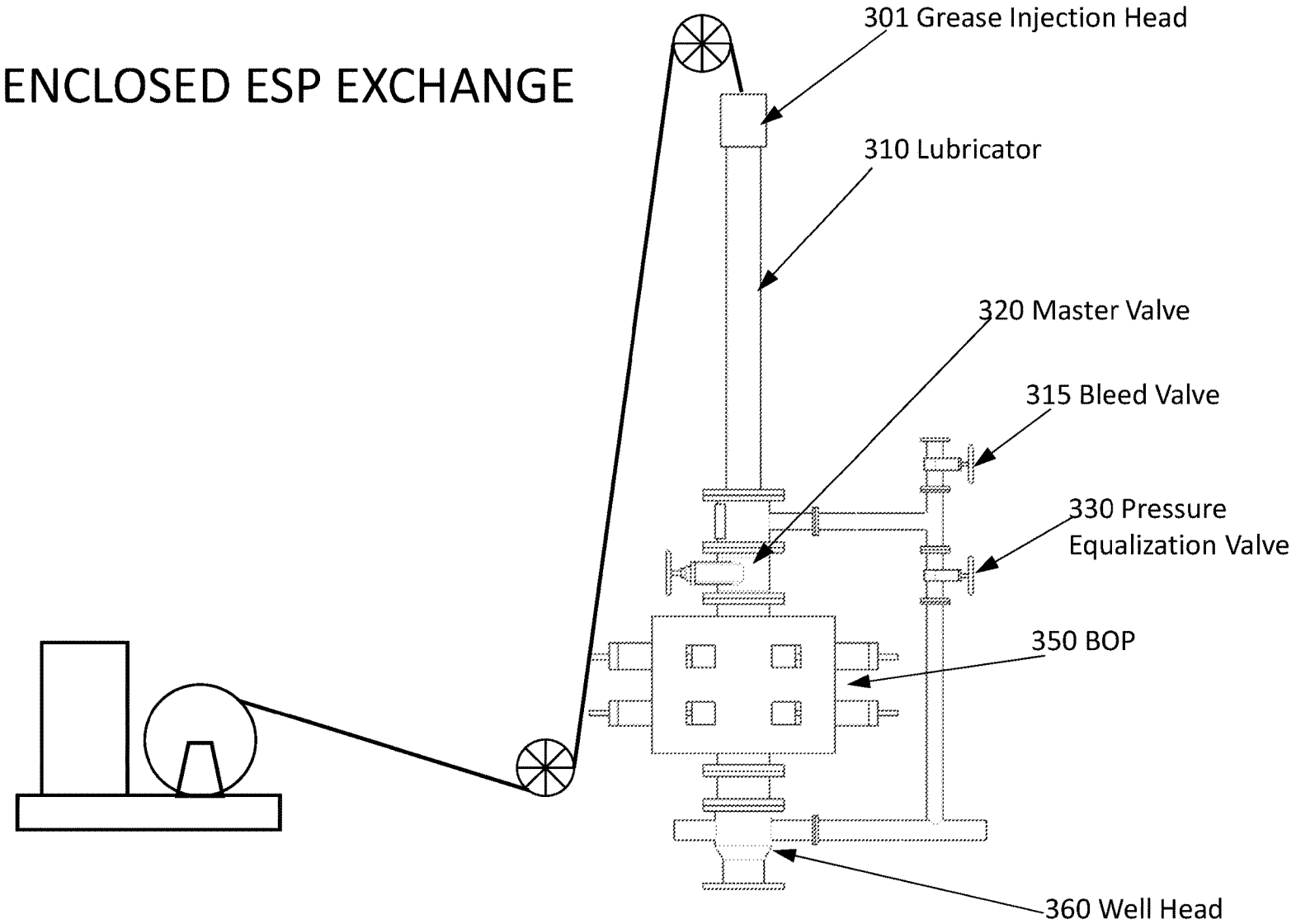
FIG. 1 is a sketch of an enclosed ESP/motor exchange method and tools associated for deploying a production tubing string into an oil well.

There is shown in FIGS. 1-16 a complete description and operative embodiment of the Electric Submersible Pump (ESP) Deployment Method and Tools to Accomplish Method for Oil Wells. FIGS. 1 and 2 show the process steps with standard and modified groups of components with a standard or modified group. FIGS. 3 through 10 are for a modified head and base group and FIGS. 11 through 16 are the tools using a standard base and head. In the drawings and illustrations, one notes well that the FIGS. 1-16 demonstrate the general configuration and use of this deployment method with its associated tools. The various example uses are in the operation and use section, below.

The accompanying drawings, which are incorporated in and constitute a part of this specification, illustrate an embodiment of the Electric Submersible Pump (ESP) Deployment Method and Tools to Accomplish Method for Oil Wells that is preferred. The drawings together with the summary description given above and a detailed description given below explain the principles of the method 33. It is understood, however, that the stated and described method 33 is not limited to only the precise arrangements and instrumentalities shown. Other examples of an ESP methods, systems, and uses are still understood by one skilled in the art of oil and gas well devices and systems to be within the scope and spirit shown here.

This method and related tools comprises a Deployment Method and Tools to exchange the ESP and strings utilizing a lubricator and standard pressure control equipment (valves, Blow Out Preventers) for Oil Wells wherein the manner to exchange the ESP and strings utilizing a lubricator and standard pressure control equipment (valves, Blow Out Preventers) are enabled using improved tools including a running tool with integral sealing plug, alignment guides, and a simple snap ring release mechanism. For the Lubricator install parts, Tools Required are a modified head and base of ESP components. This method also requires a simple pressure control device like an annular BOP or a ram BOP that can seal on motor, protector, and pump (most likely a dual stack). In addition are the alignment guide for motor connection. This method of an Enclosed ESP Exchange (E CUBE) will eliminate downhole well isolation, utilize short length lubricator, and employ/utilize a single wireline run for installation and retrieval. These tools permit the advantages and objectives listed above.

FIG. 1 is a sketch of an enclosed ESP/motor exchange method and tools associated for deploying a production tubing string into an oil well. Shown here are the following components and features: a grease injection head 301; a lubricator 310; a bleed valve 315; a master valve 320; a pressure equalization valve 330; a blow out preventer (BOP) 350 is a mechanical device connected to the wellhead to control and prevent blowouts; one or more valves installed at the wellhead to prevent the escape of pressure either in the annular space between the casing and the drill pipe or in open hole; and a well head 360, the equipment installed at the surface of the wellbore. A wellhead includes such equipment as the casing head and tubing head; a string 390 of pumps, etc.

Figure 2A:
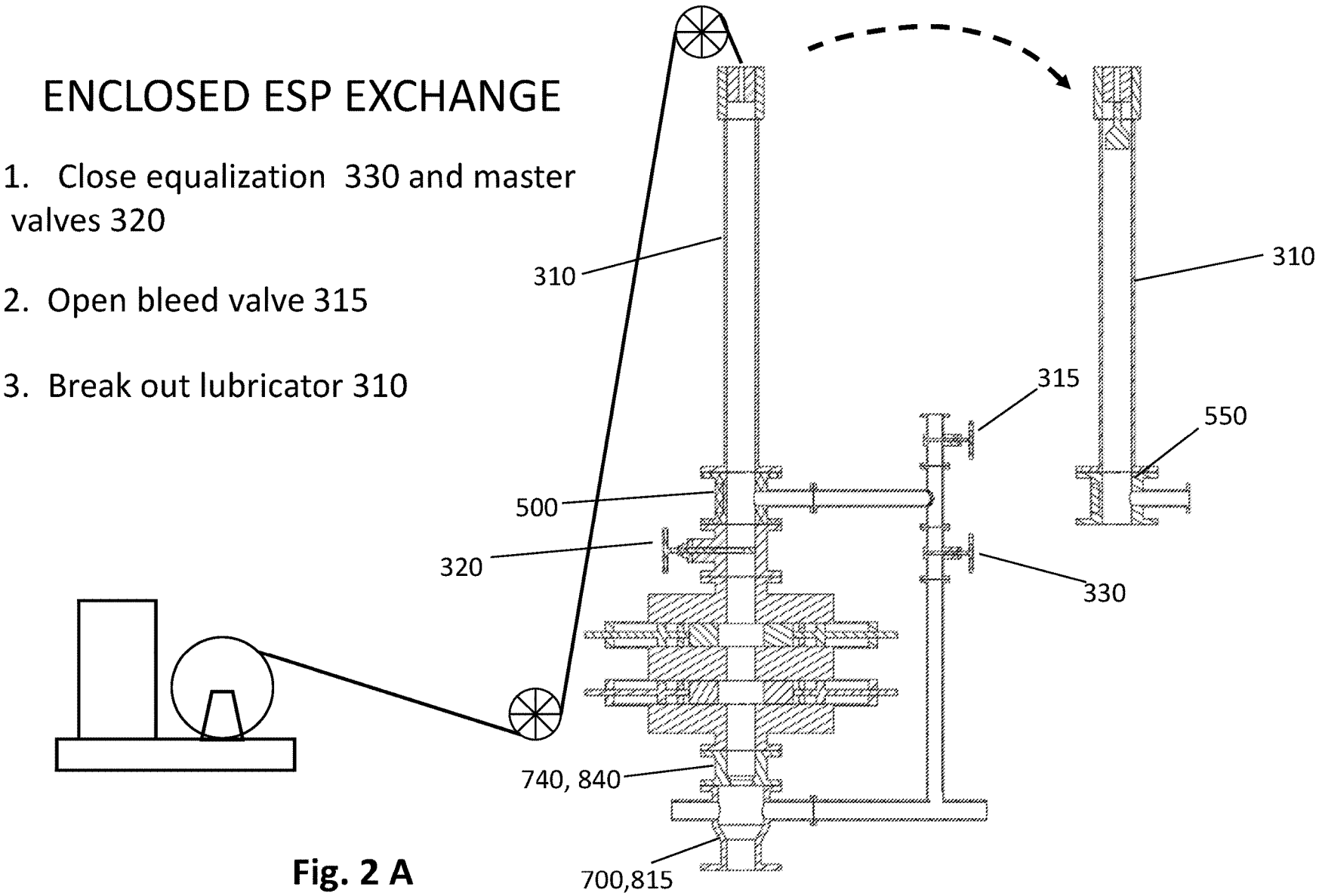
FIGS. 2A through 2Z are sketches describing the method and the operation of how to use an oil lubricator and showing the special deployment tools to accomplish an ESP/motor exchange.
Figure 2B:
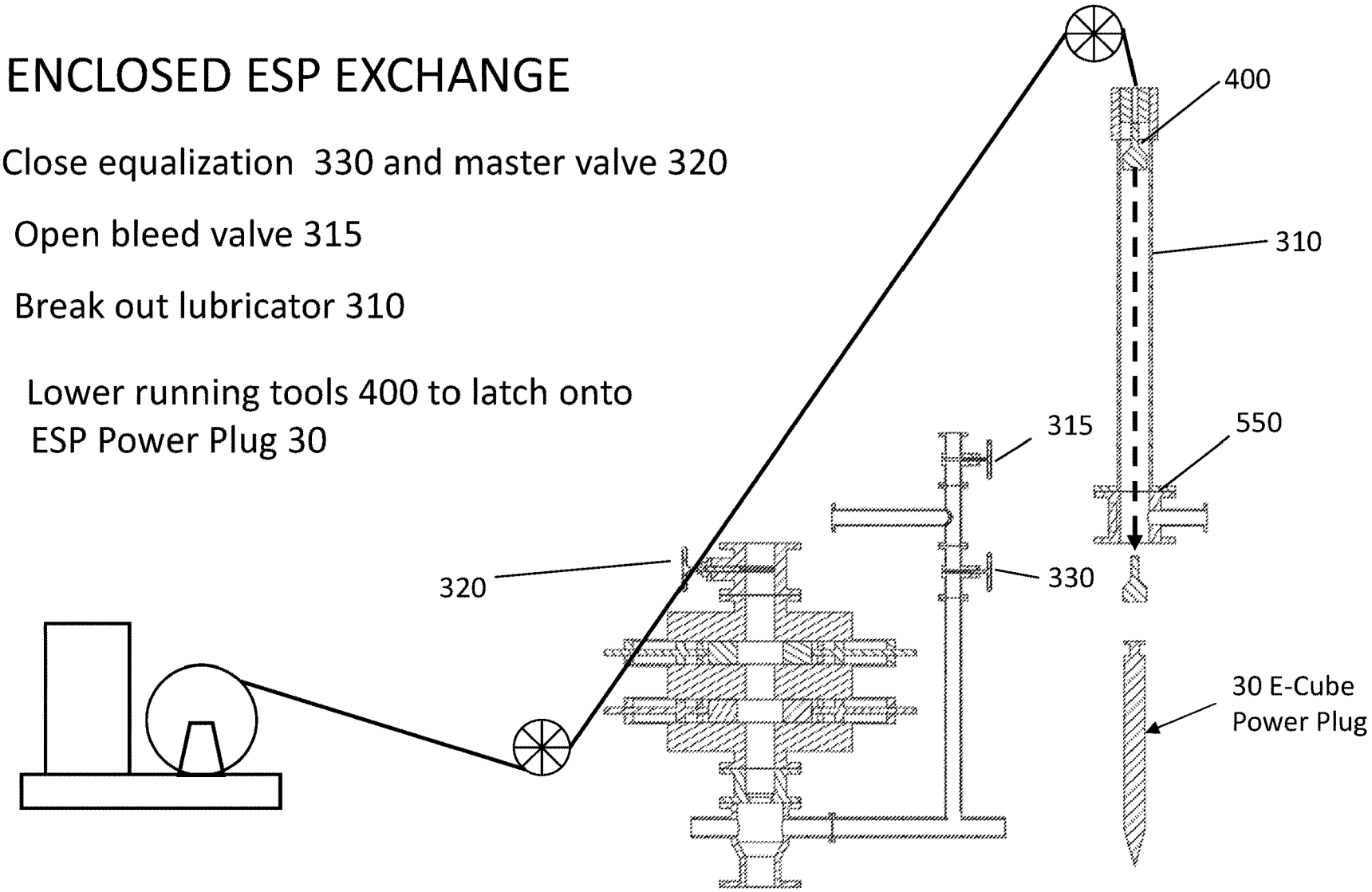
Figure 2C:
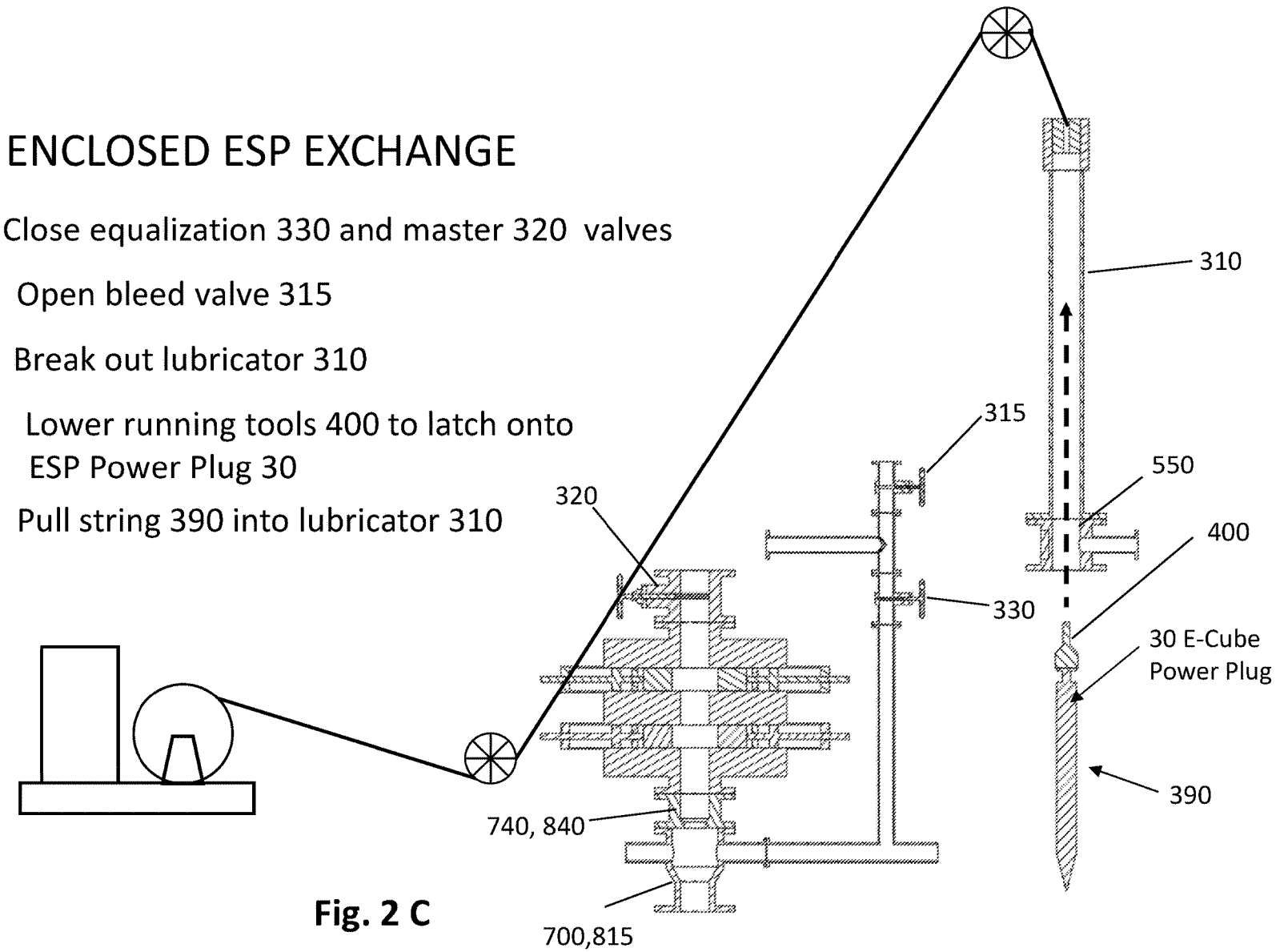
Figure 2D:
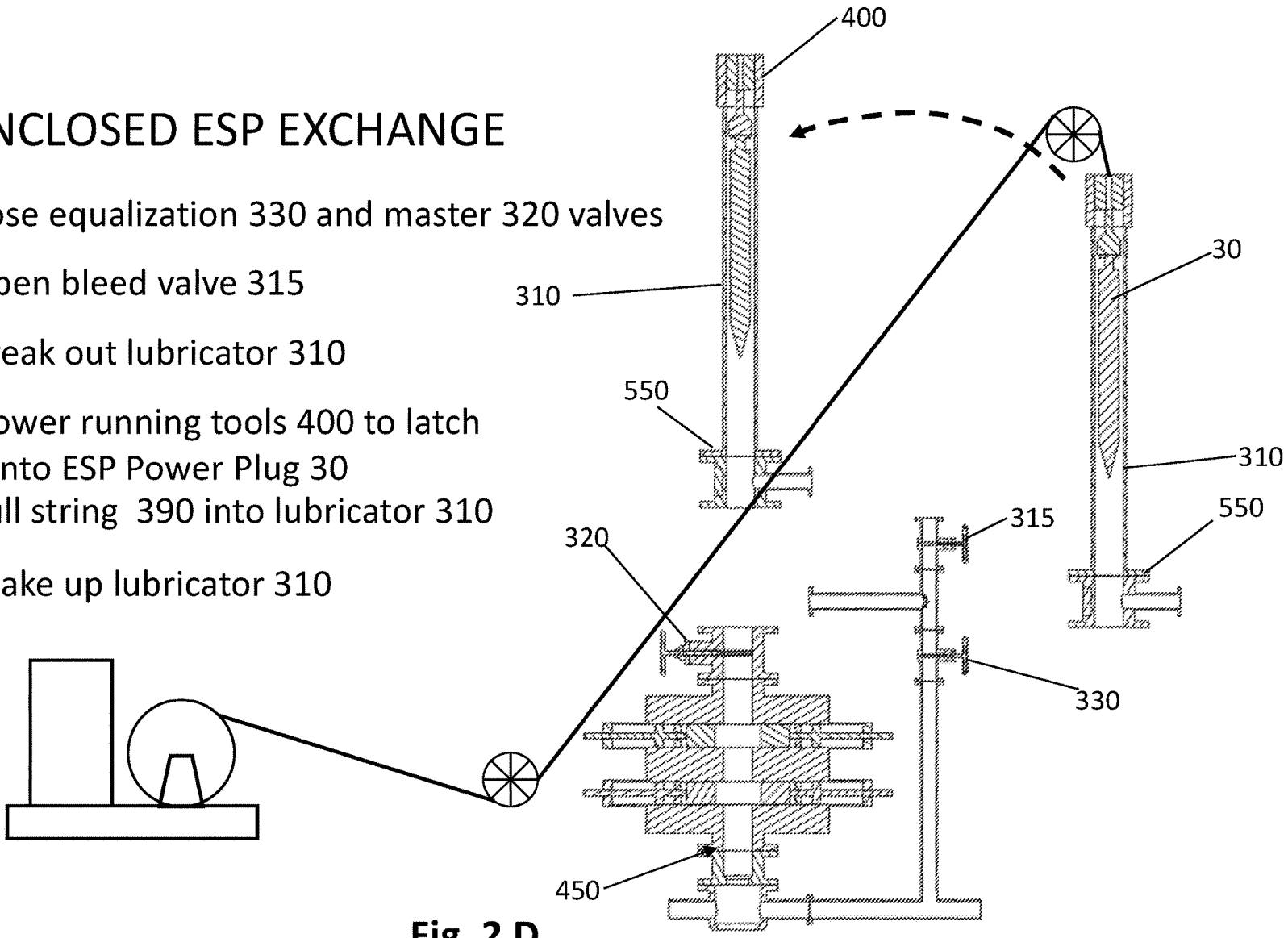
Figure 2E:
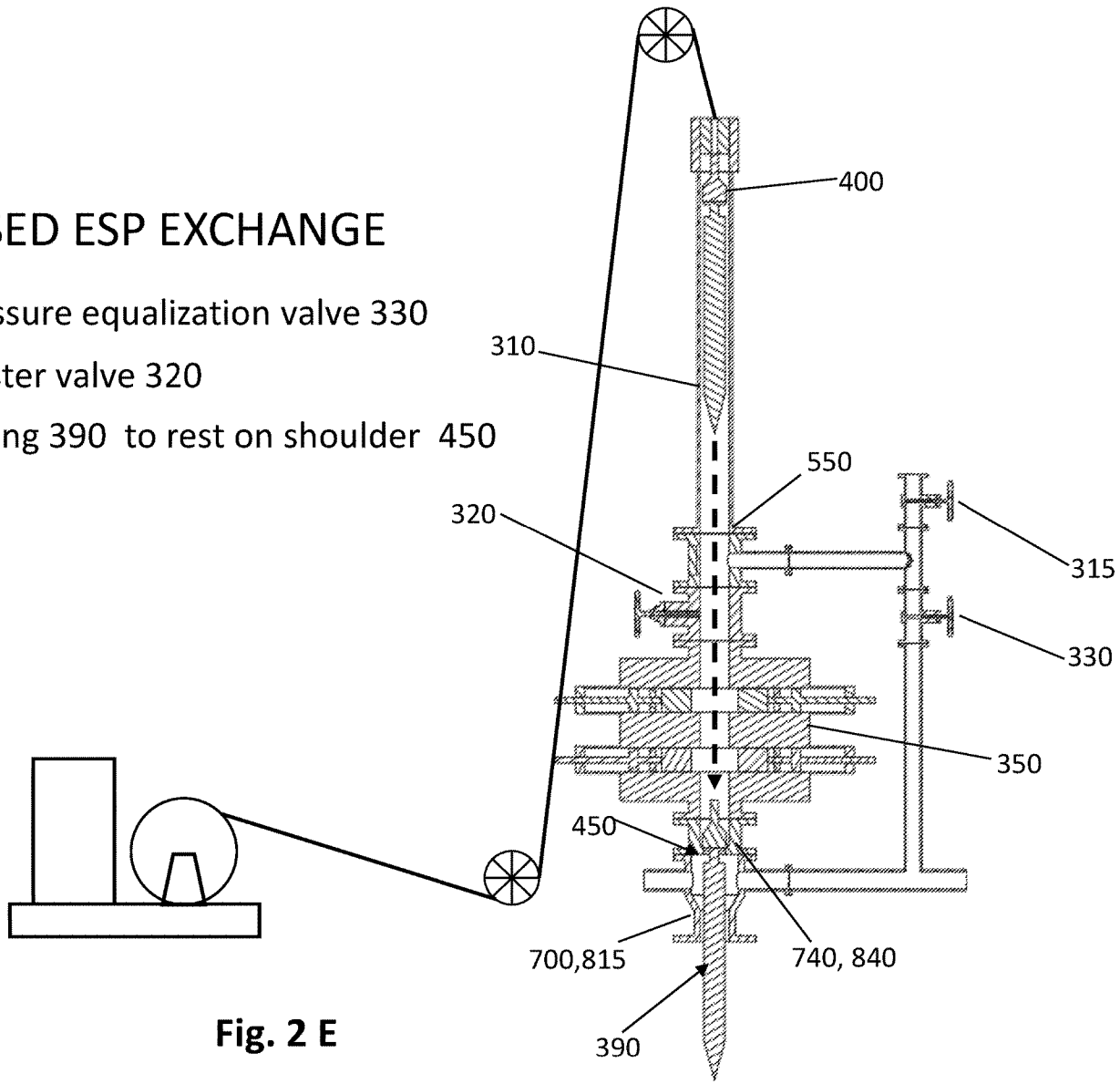
Figure 2F:
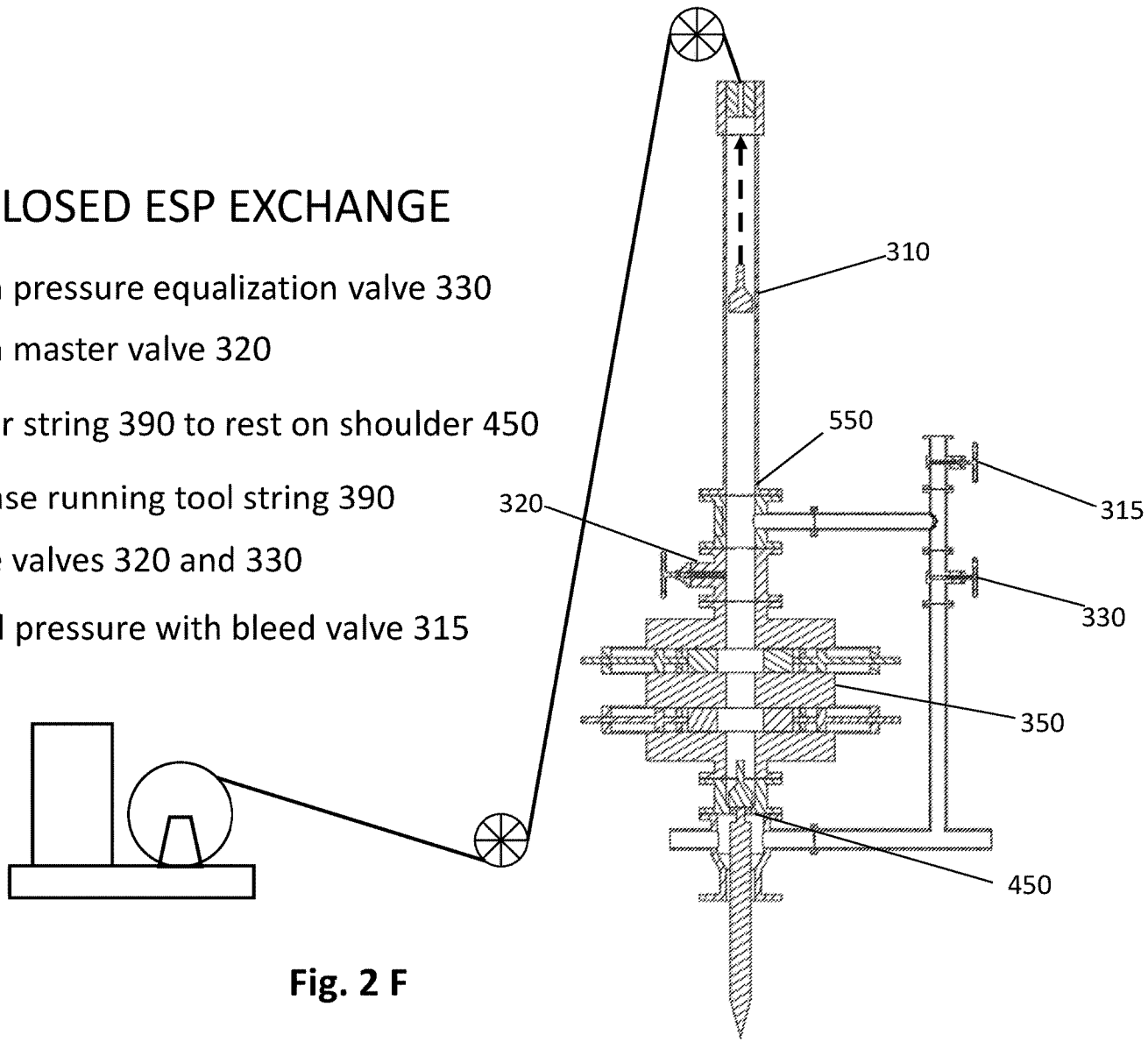
Figure 2G:
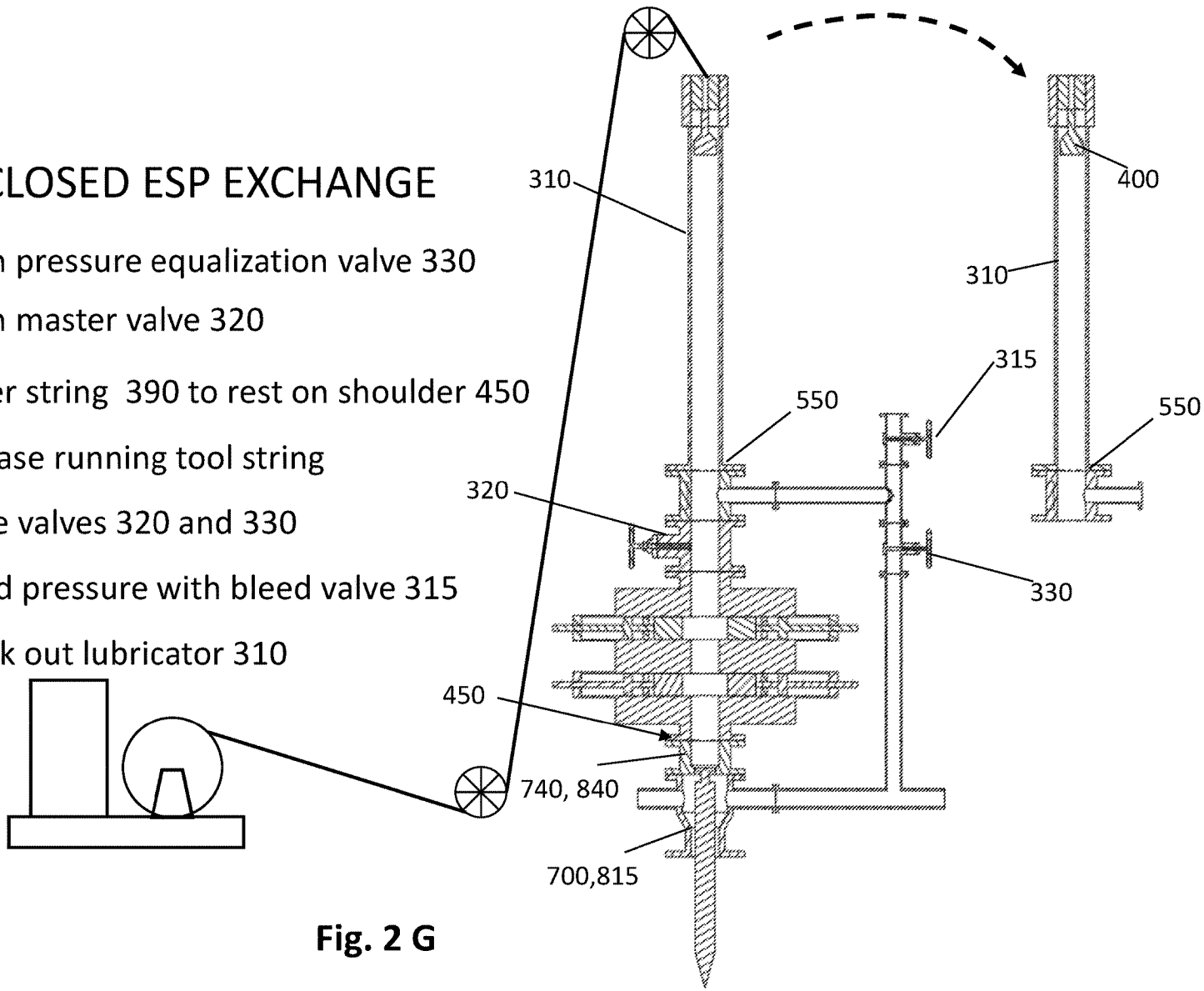
Figure 2H:
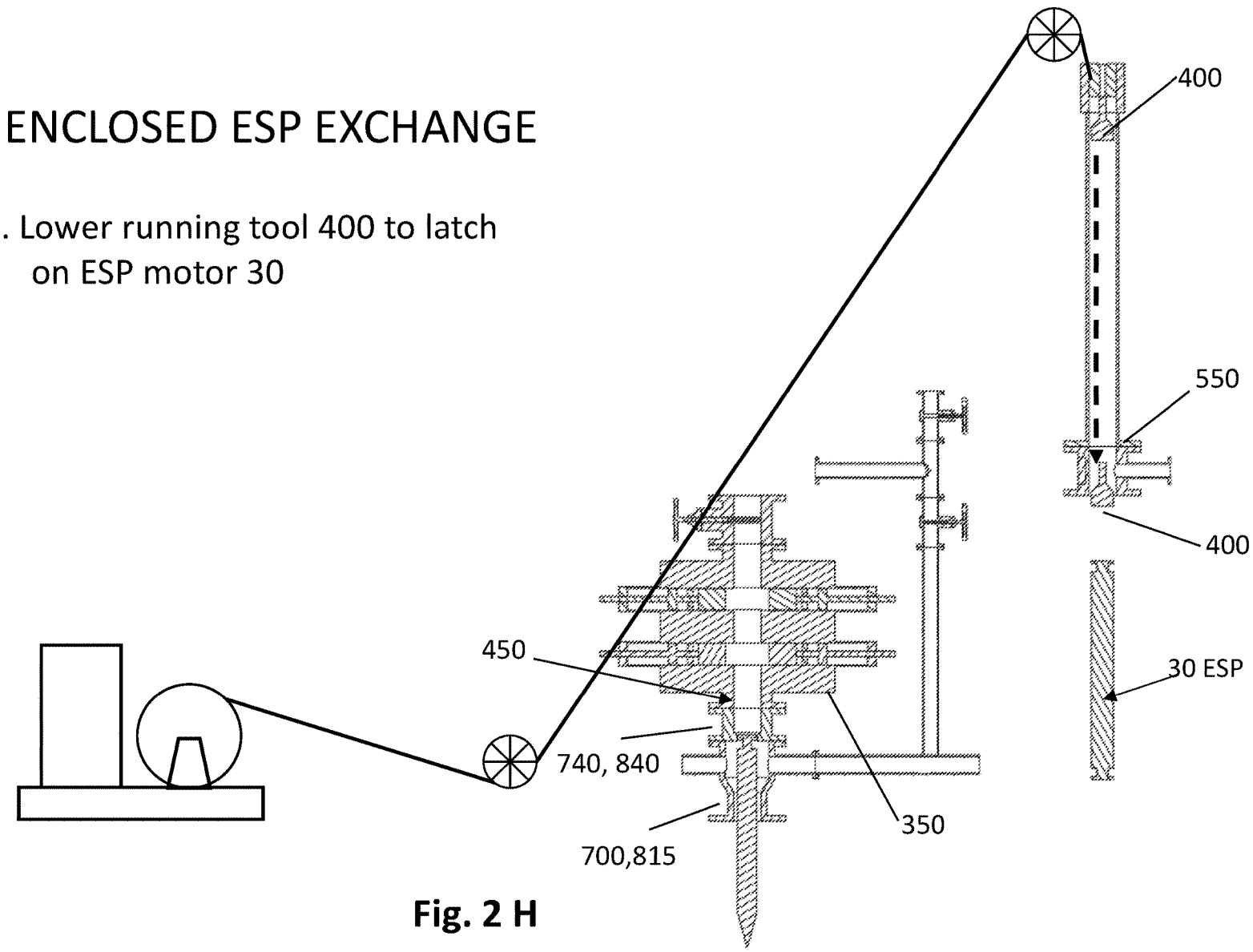
Figure 2I:
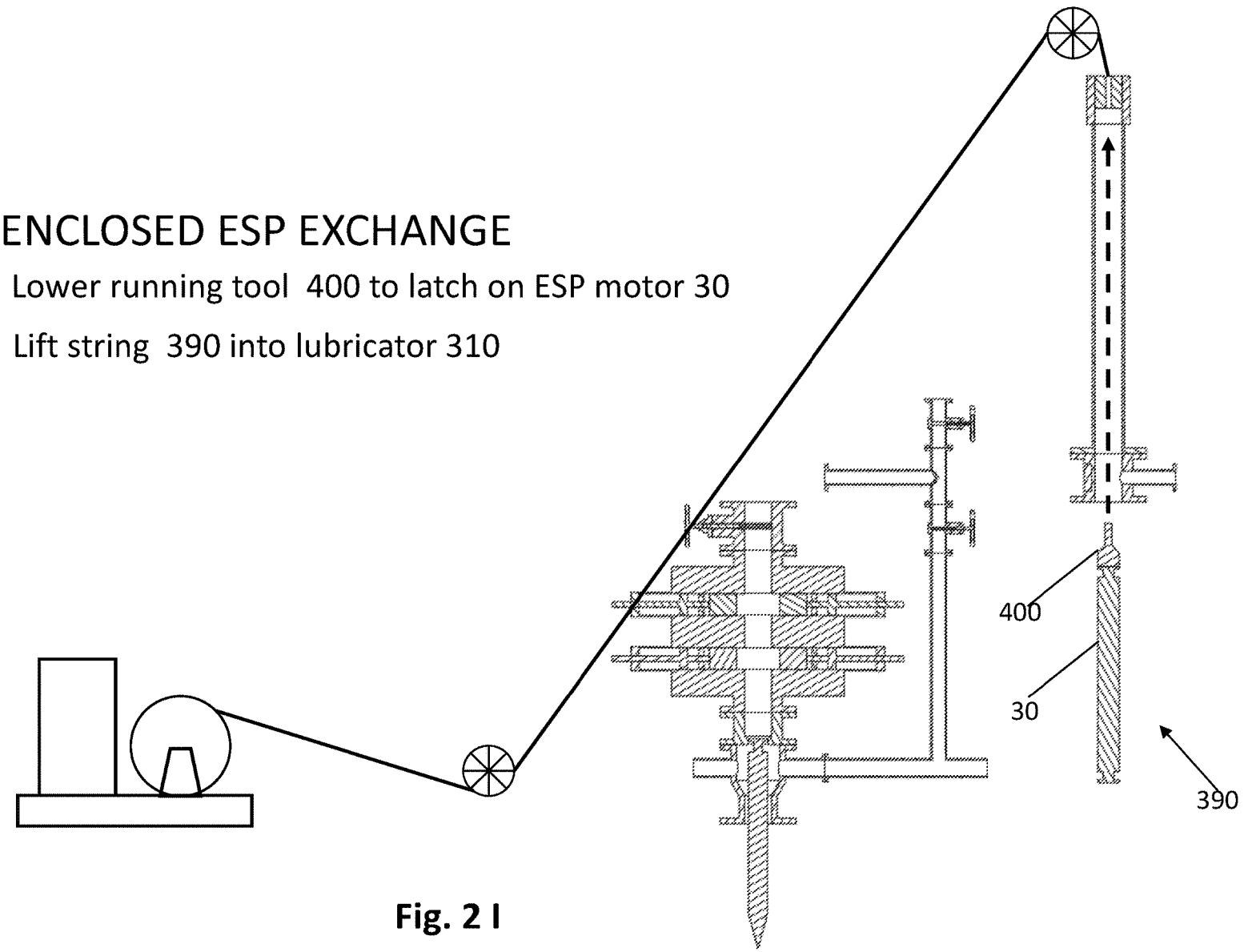
Figure 2J:
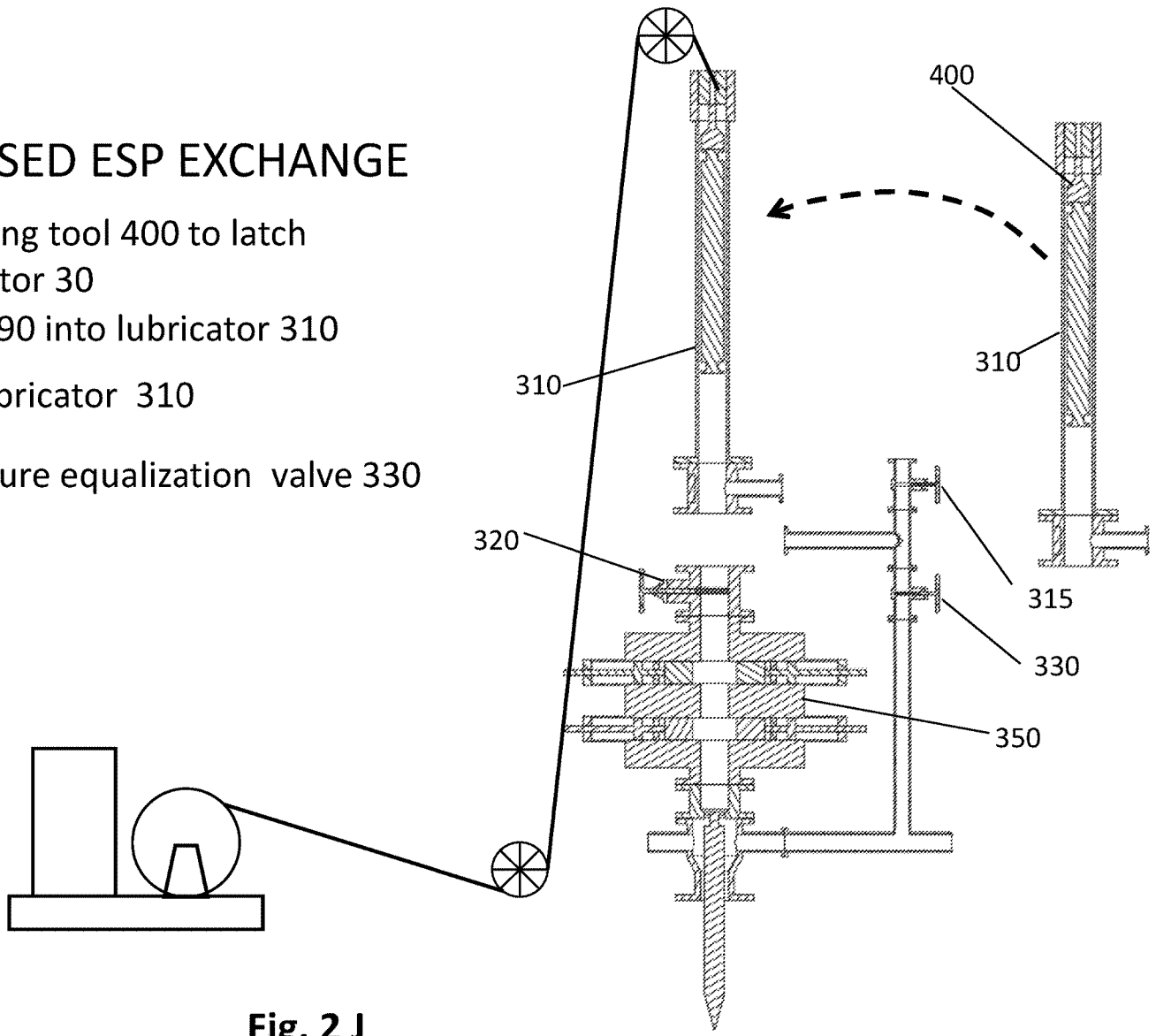
Figure 2K:
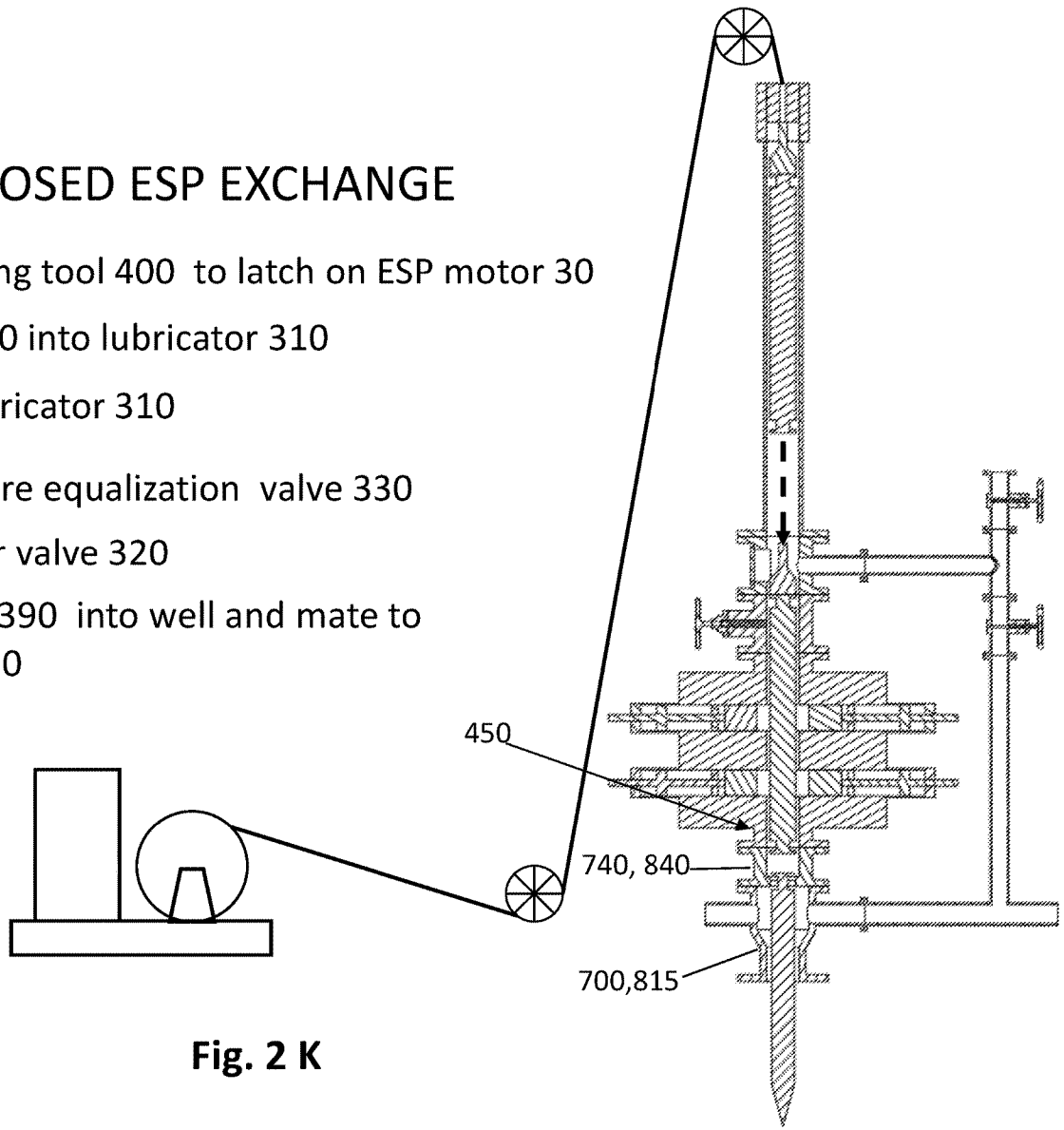
Figure 2L:
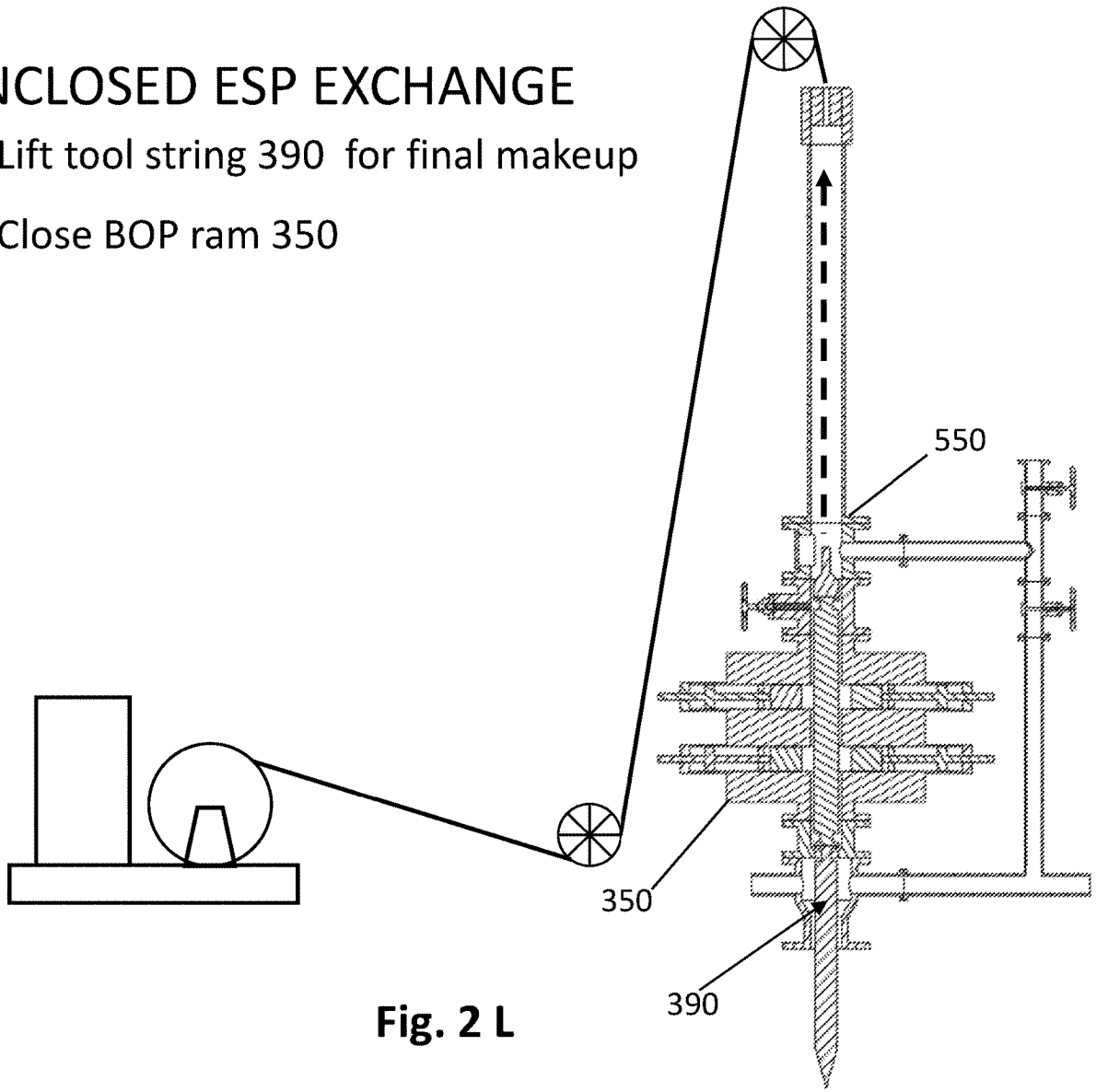
Figure 2M:
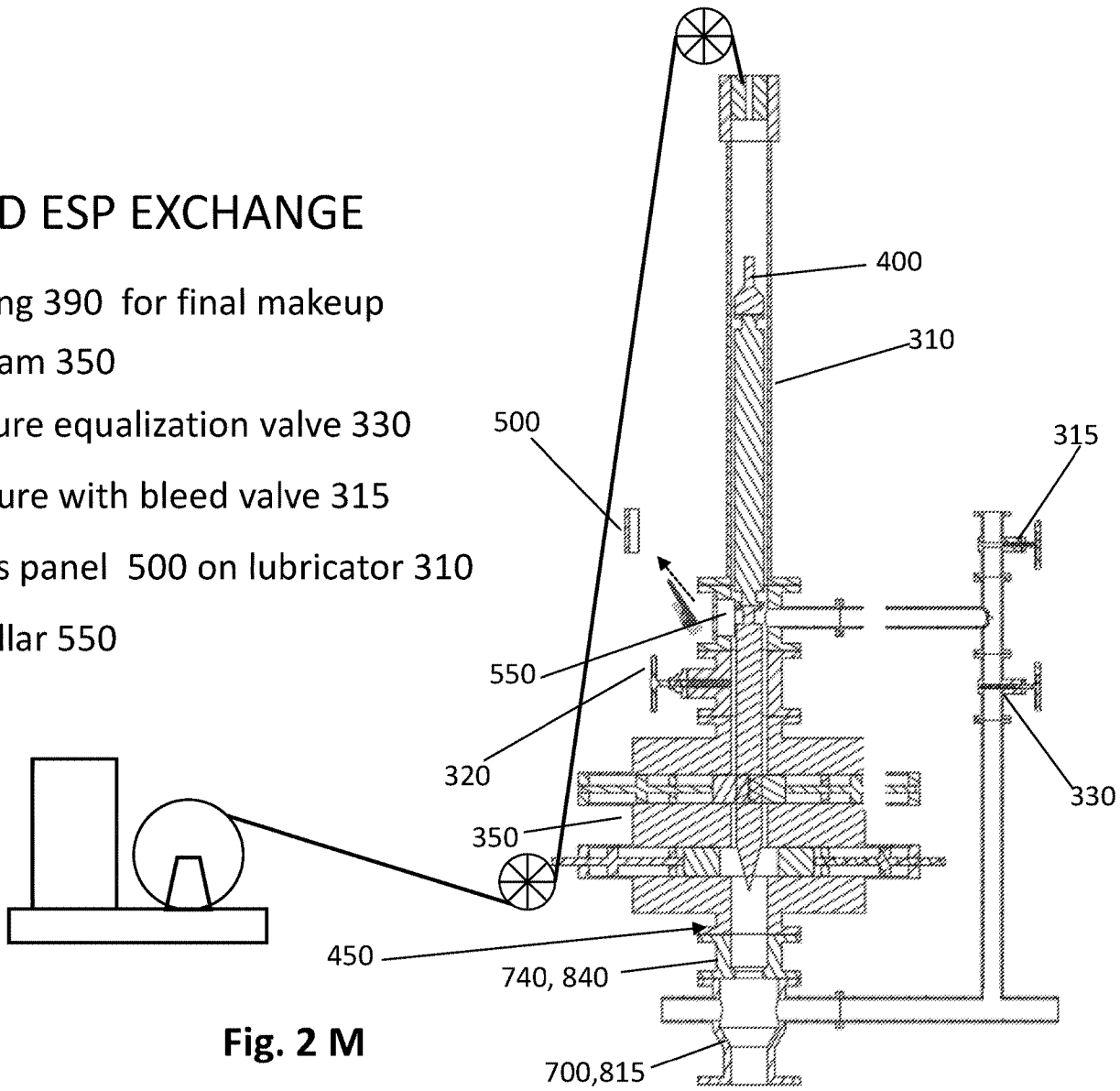
Figure 2N:
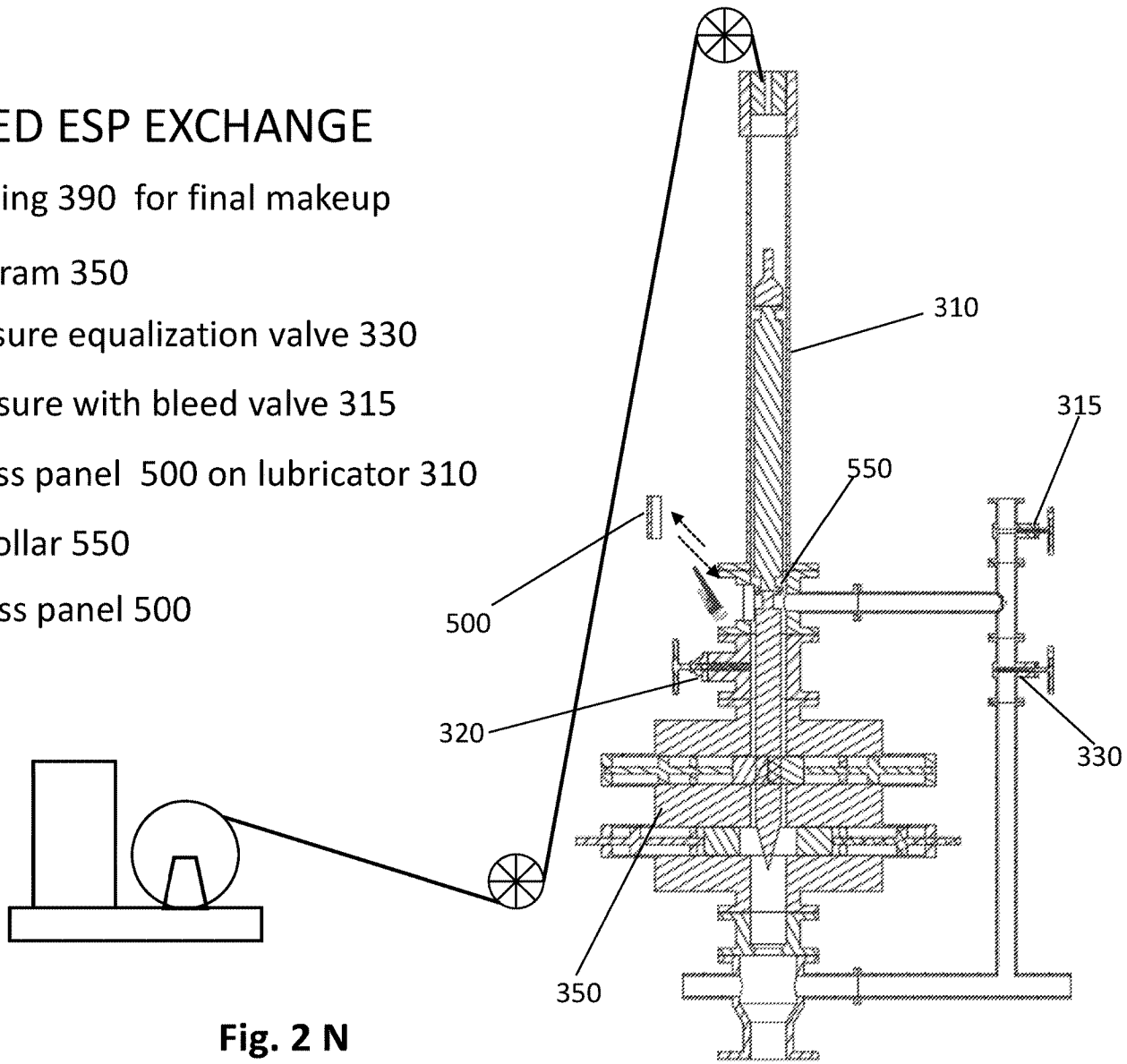
Figure 2O:
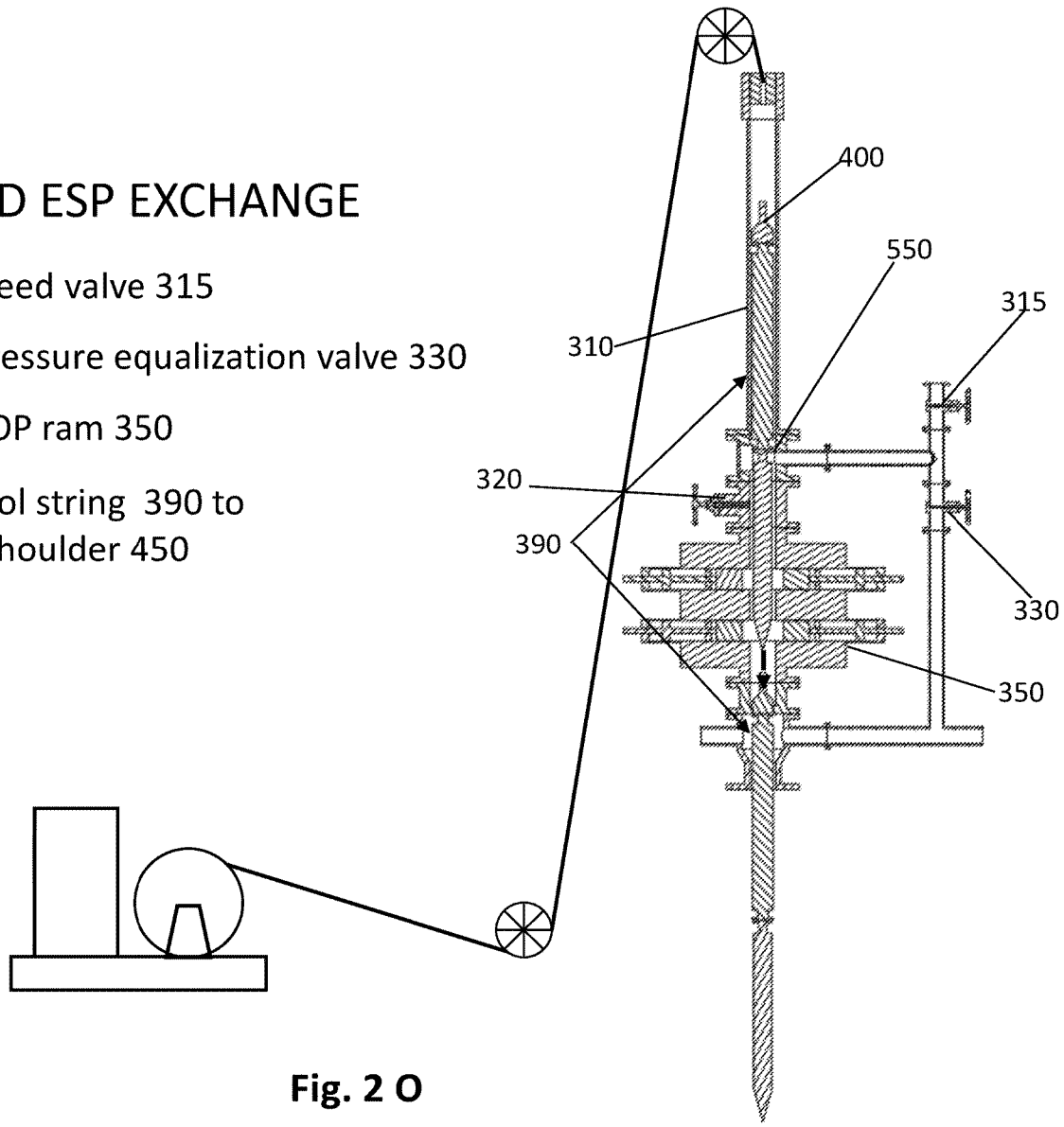
Figure 2P:
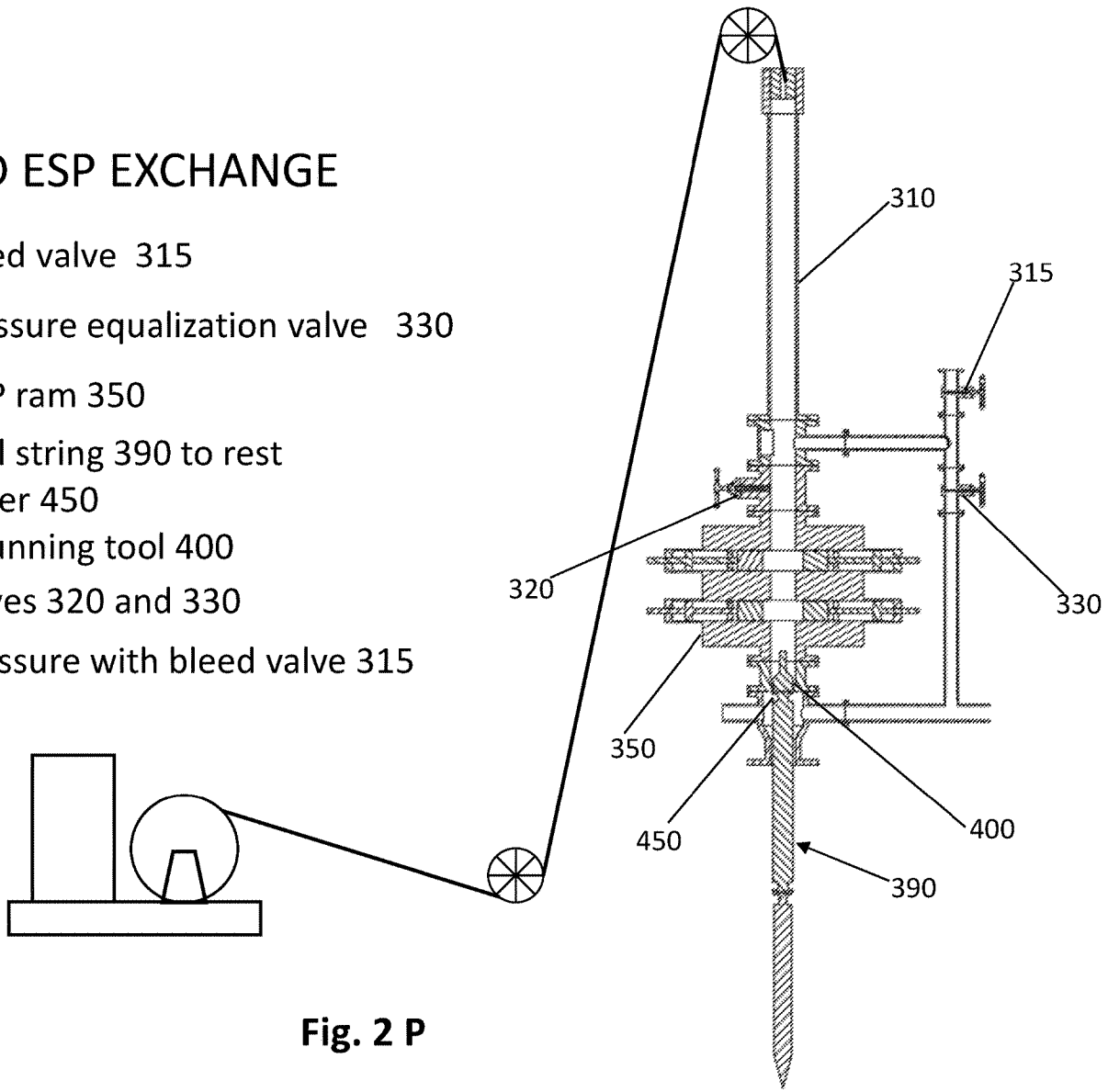
Figure 2Q:
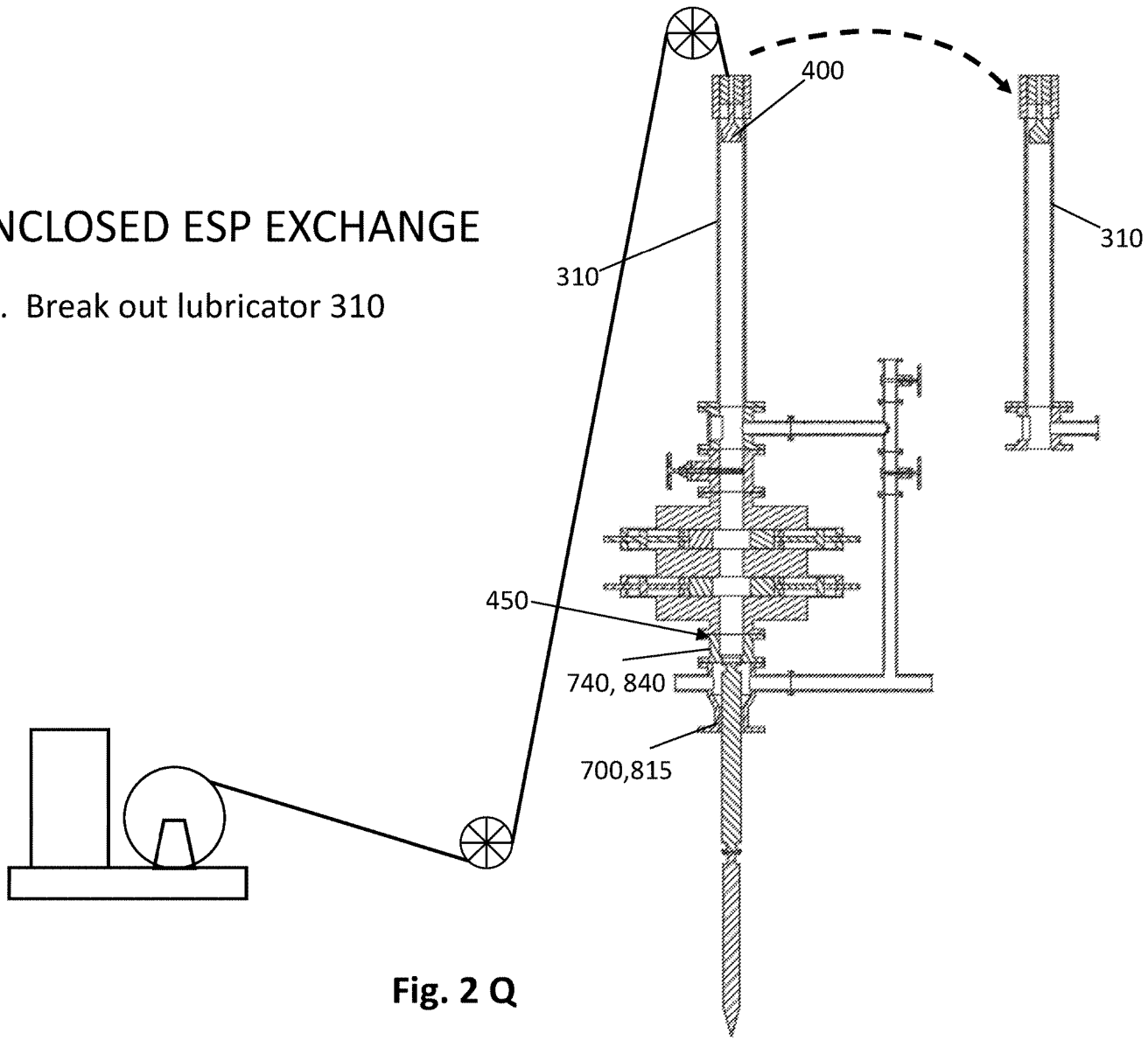
Figure 2R:
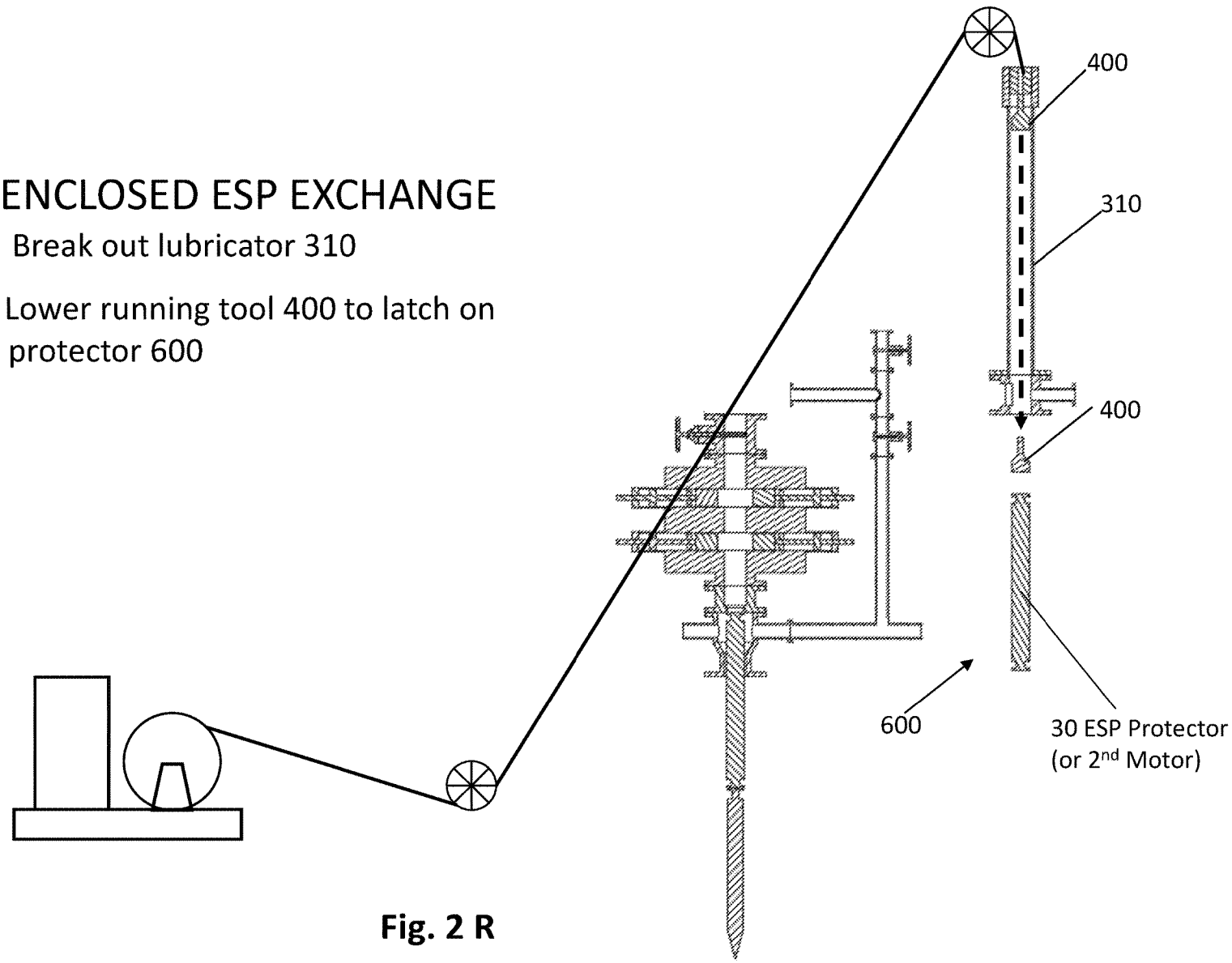
Figure 2S:
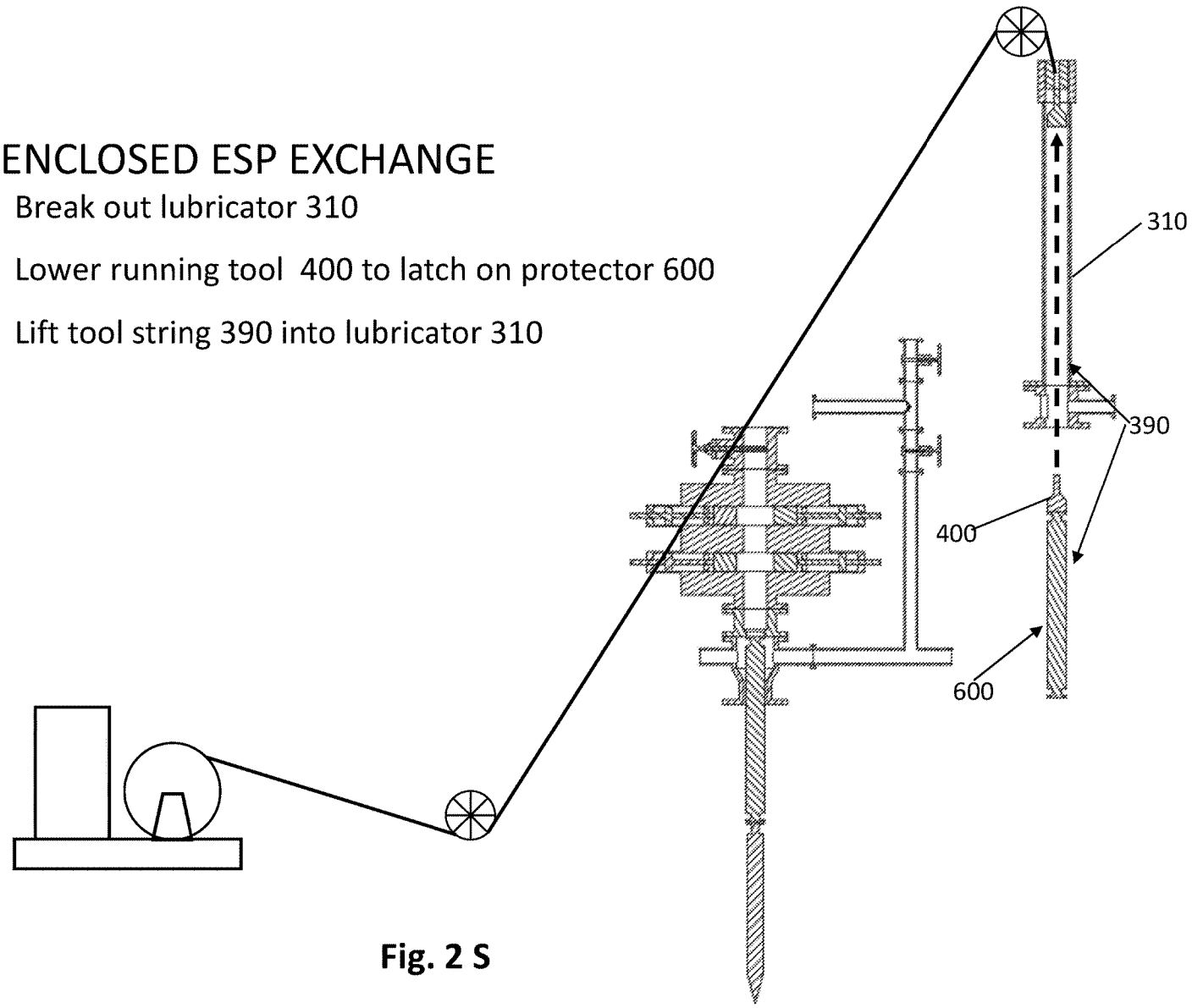
Figure 2T:
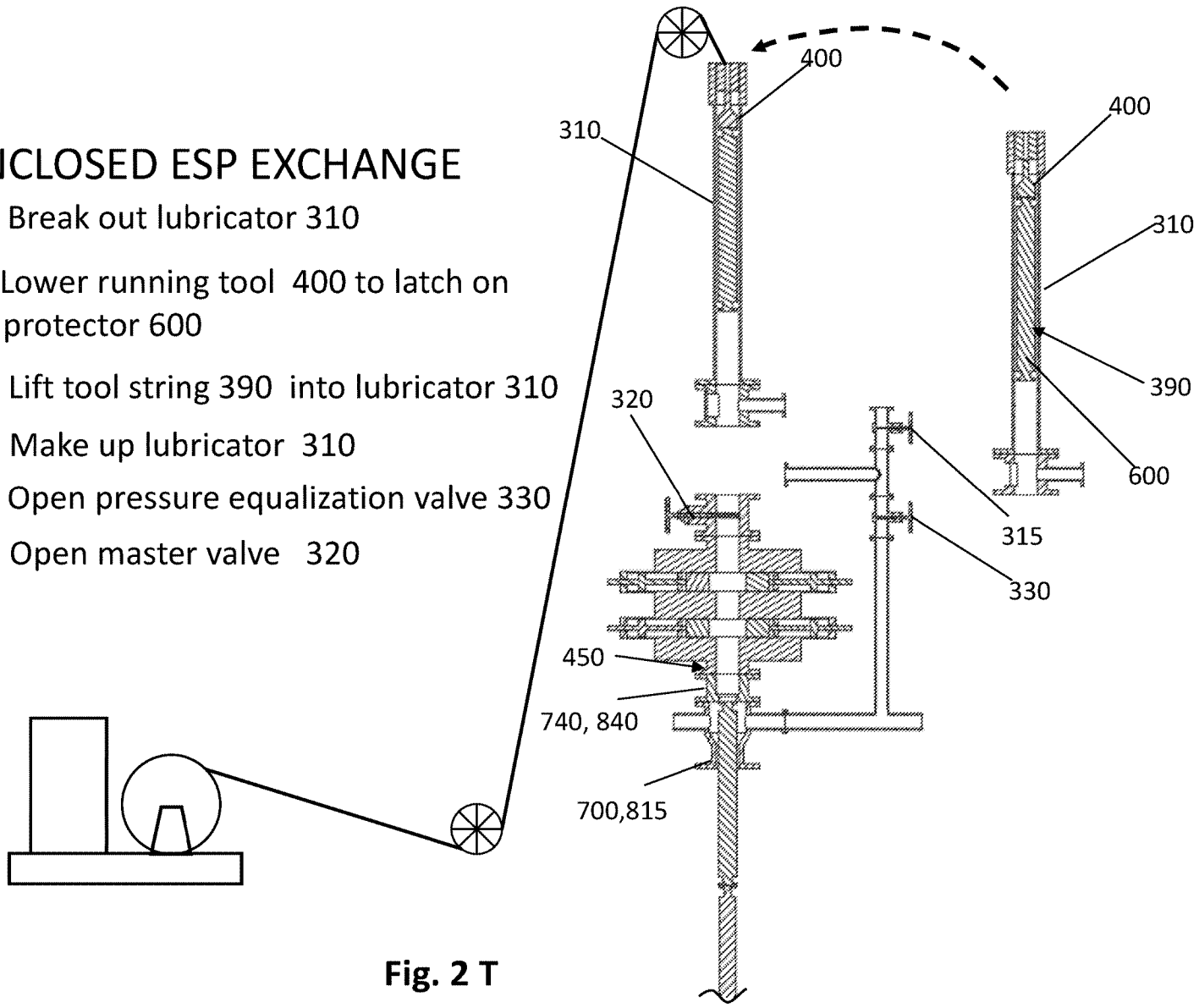
Figure 2U:
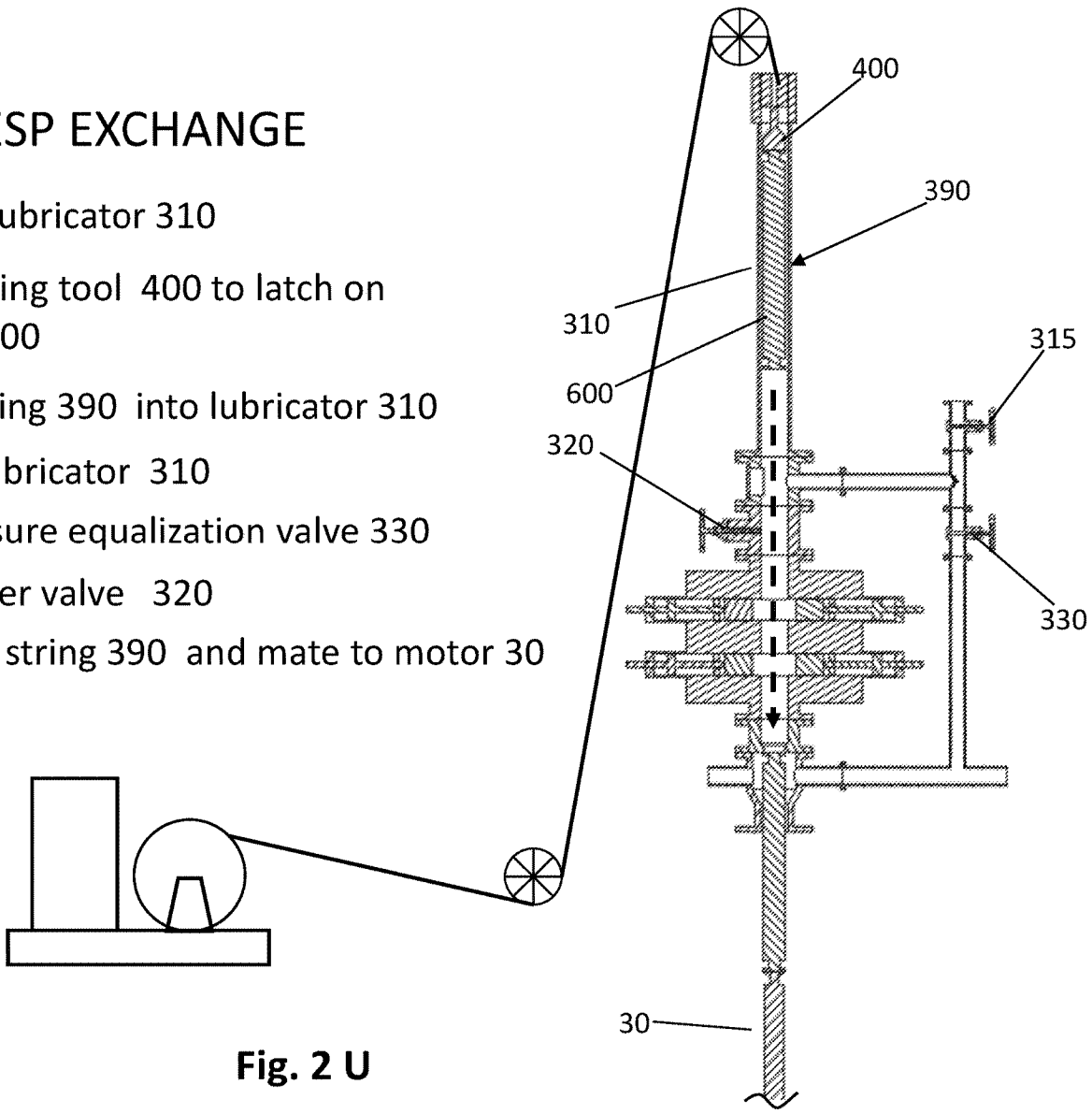
Figure 2V:
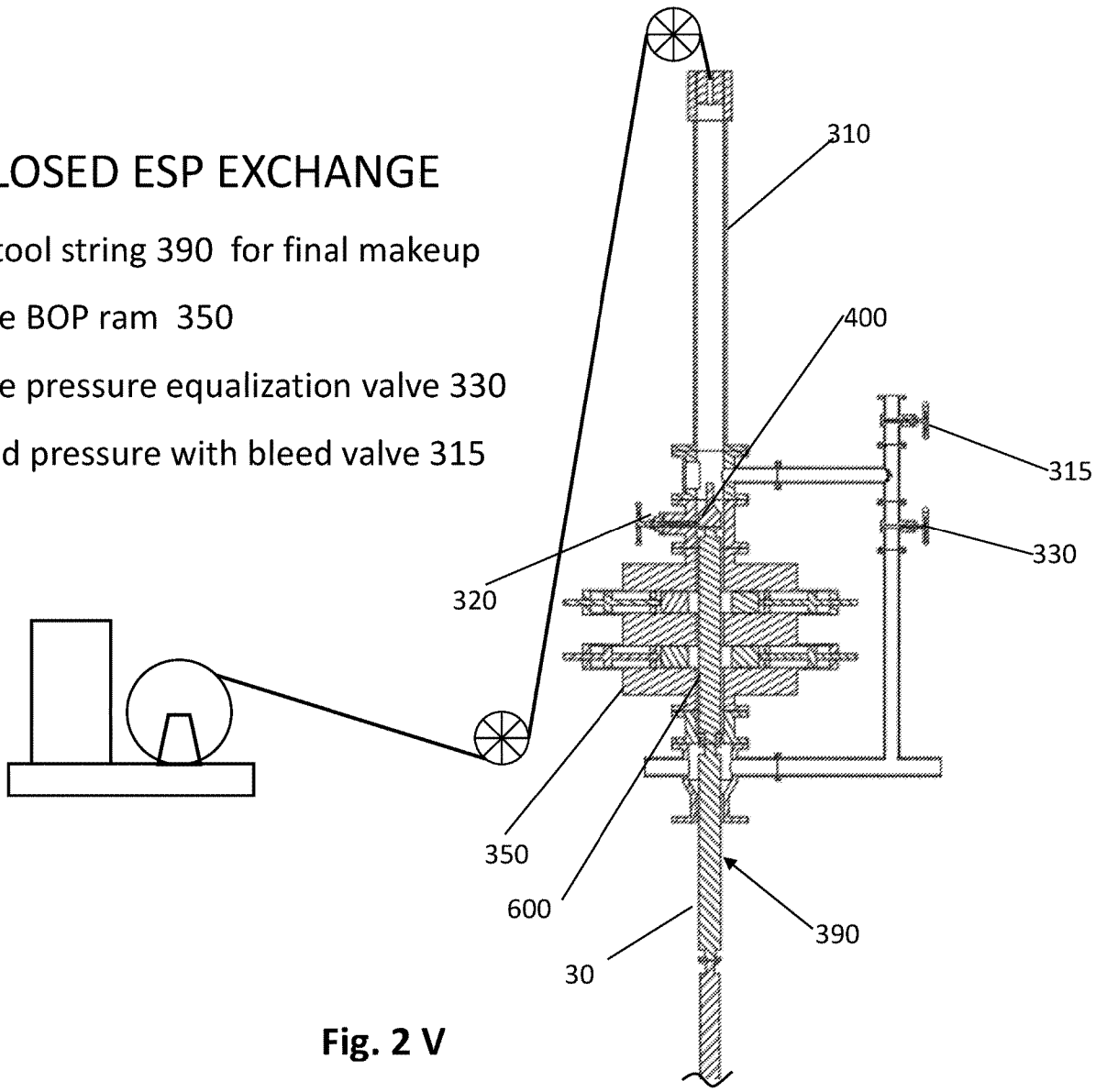
Figure 2W:
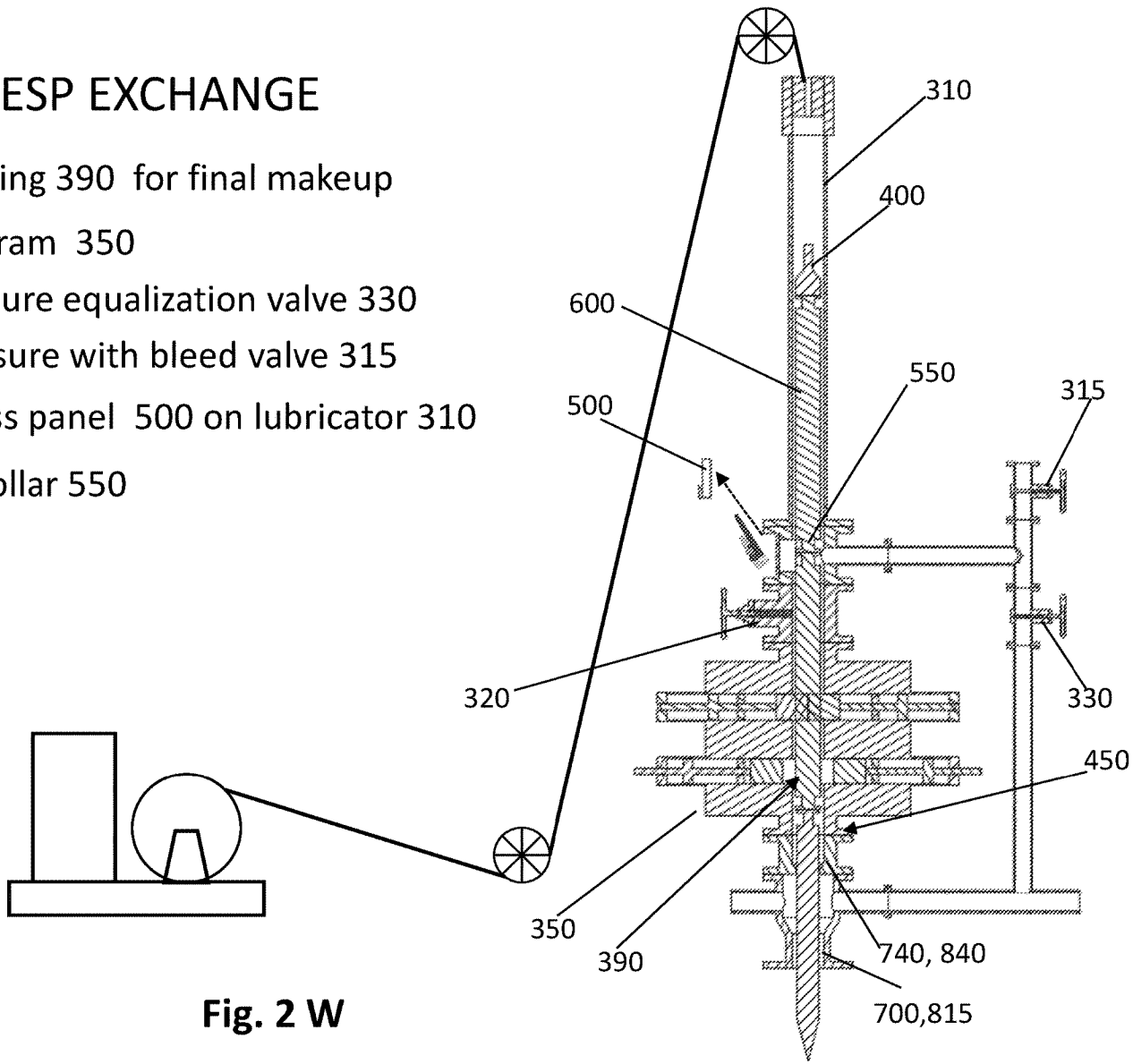
Figure 2X:
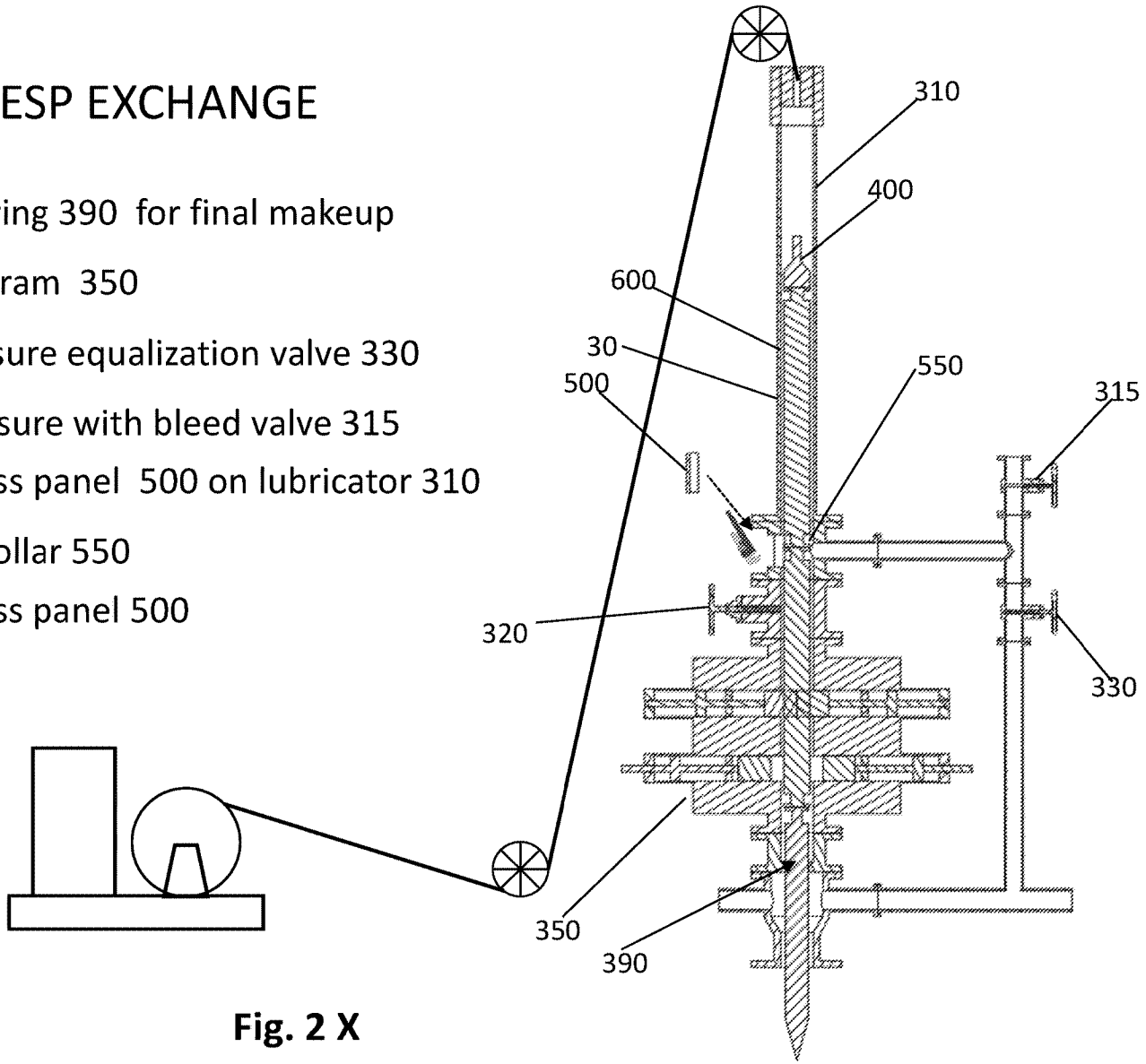
Figure 2Y:
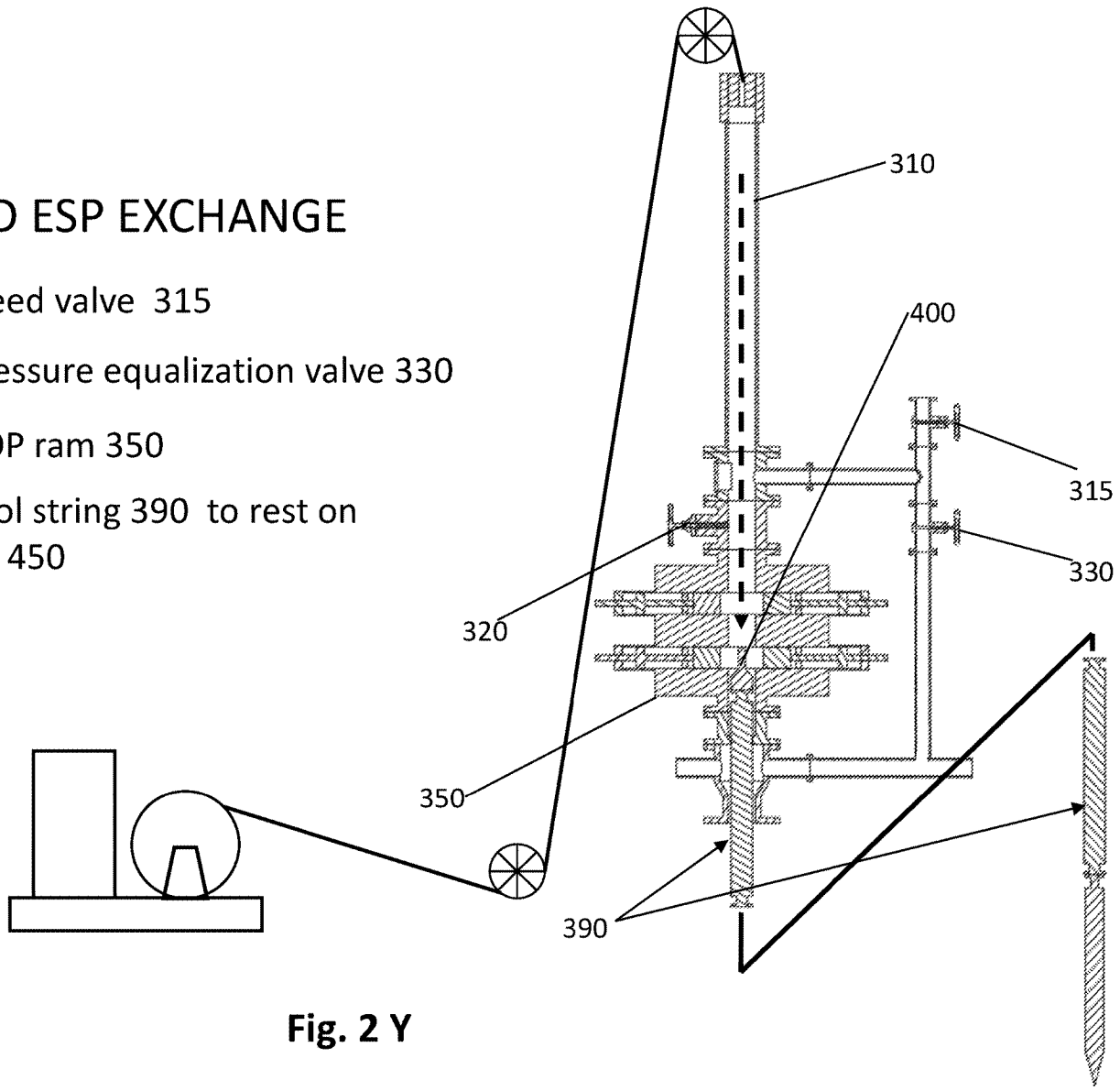
Figure 2Z:
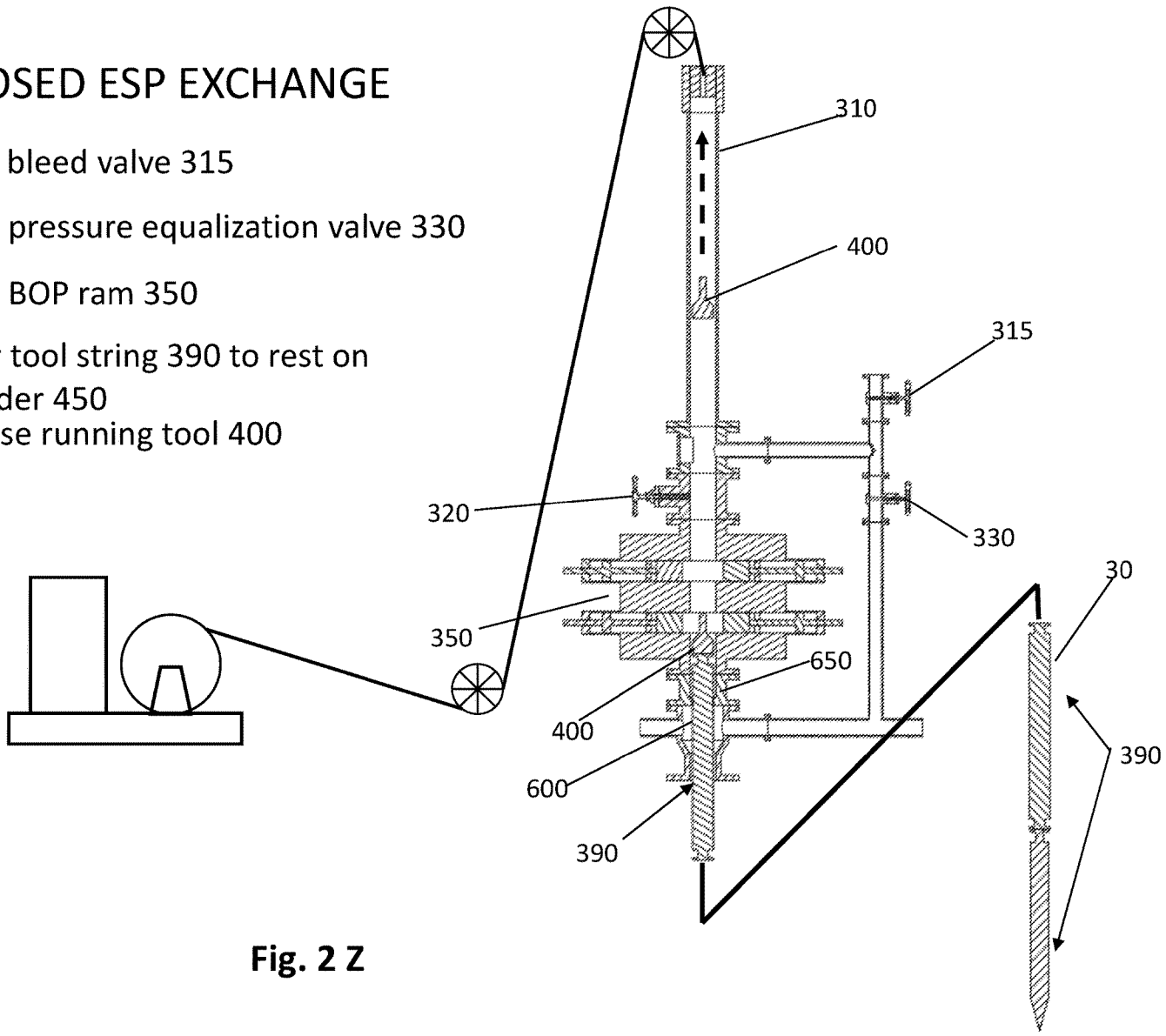

FIGS. 2A through 2Z are sketches describing the method and the operation of how to use an oil lubricator and showing the special deployment tools to accomplish an ESP/motor exchange. This is described below in the operations section.

Figure 3:
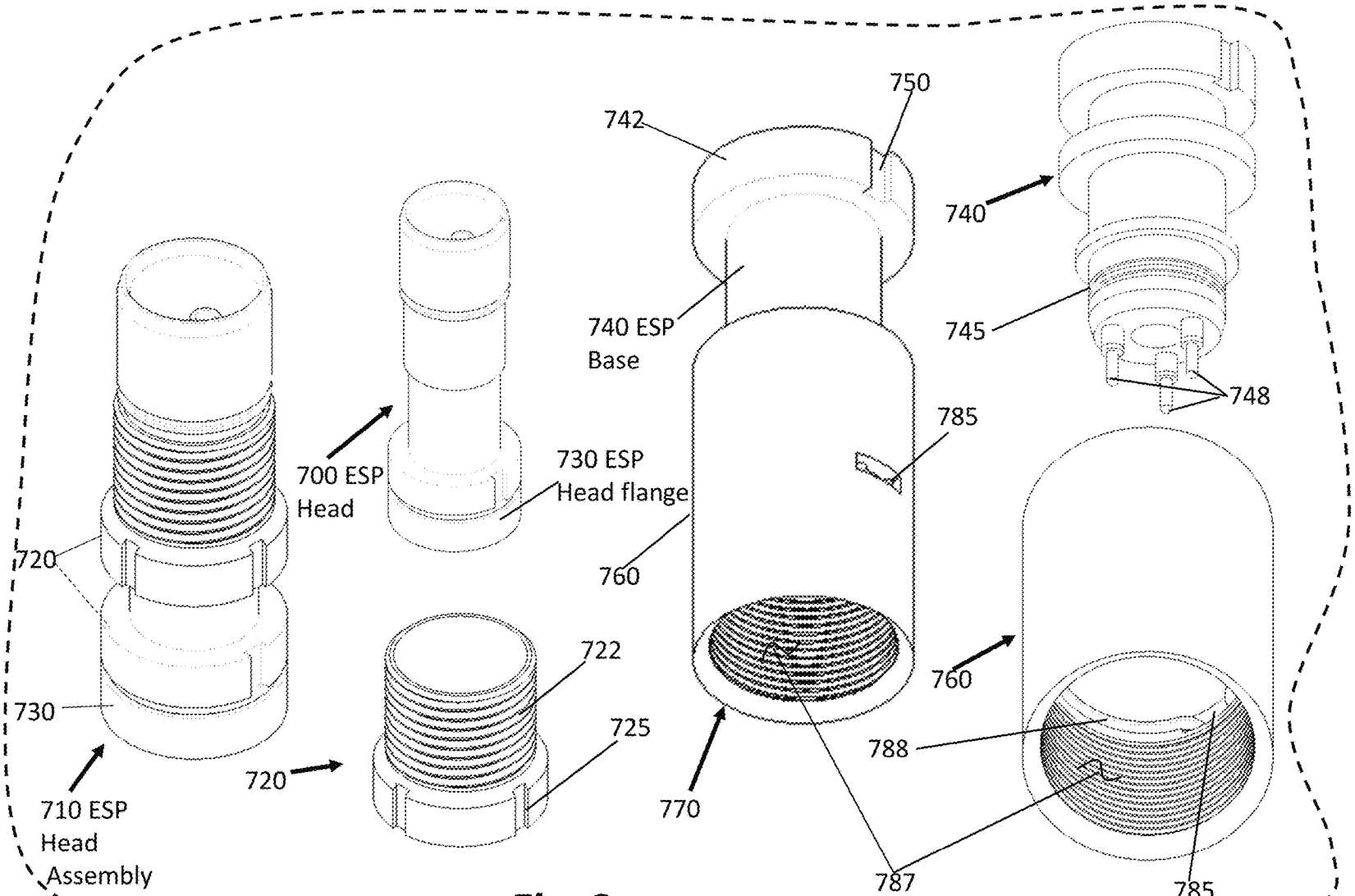
FIG. 3 is a sketch of a set of lubricator installation components with the features and components described and FIGS. 3A through 3L are sketches showing the temporary makeup of the head and base joint.

FIG. 3 is a sketch of a set of lubricator installation components with the features and components described and FIGS. 3A through 3L are sketches showing the temporary makeup of the modified head and modified base joint. The snap ring 788 that is installed in the coupling of the modified base assembly snaps into the groove 789 of the modified head assembly as the upper component is lowered into the pressure containment system. Provided here are: an Modified Electric Submersible head 700; an Electric Submersible Head Assembly 710; a locking nut 720 on the Electric Submersible Head Assembly 710; a set of threads 722 (external) on locking nut 720; a set of tool slots 725 on locking nut 720; an Electric Submersible Head flange 730; an Electric Submersible Base 740; an Electric Submersible Base flange 742; a set of O-ring grooves 745; a set of base terminals 748; a set of head terminals 749; an alignment notch 750; a collar 760; a release window 785; an ESP base assembly 770; a thread area 787 (internal) on collar 780; a snap ring 788; a groove 789 for snap ring 788; a lower shaft 790; an alignment profile 791 lower shaft 790; a lead-in chamfer 792 (not shown) lower shaft 790; an alignment profile 794; a coupling 795; an alignment profile 796 upper shaft 799; a lead-in chamfer 797 upper shaft 799; and an upper shaft 799.

Figure 4:
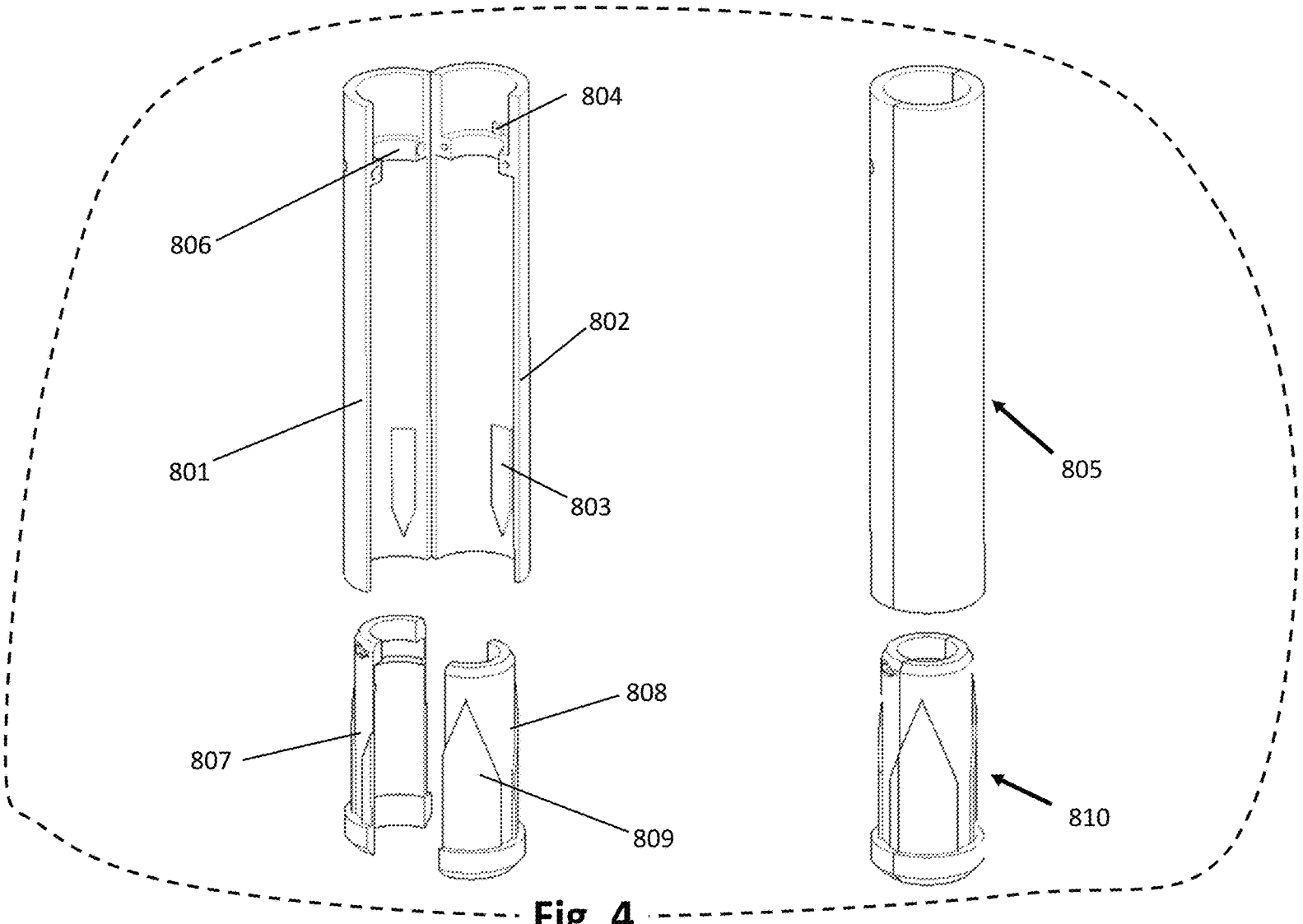
Figures 4A, 4B, 4C, 4D:
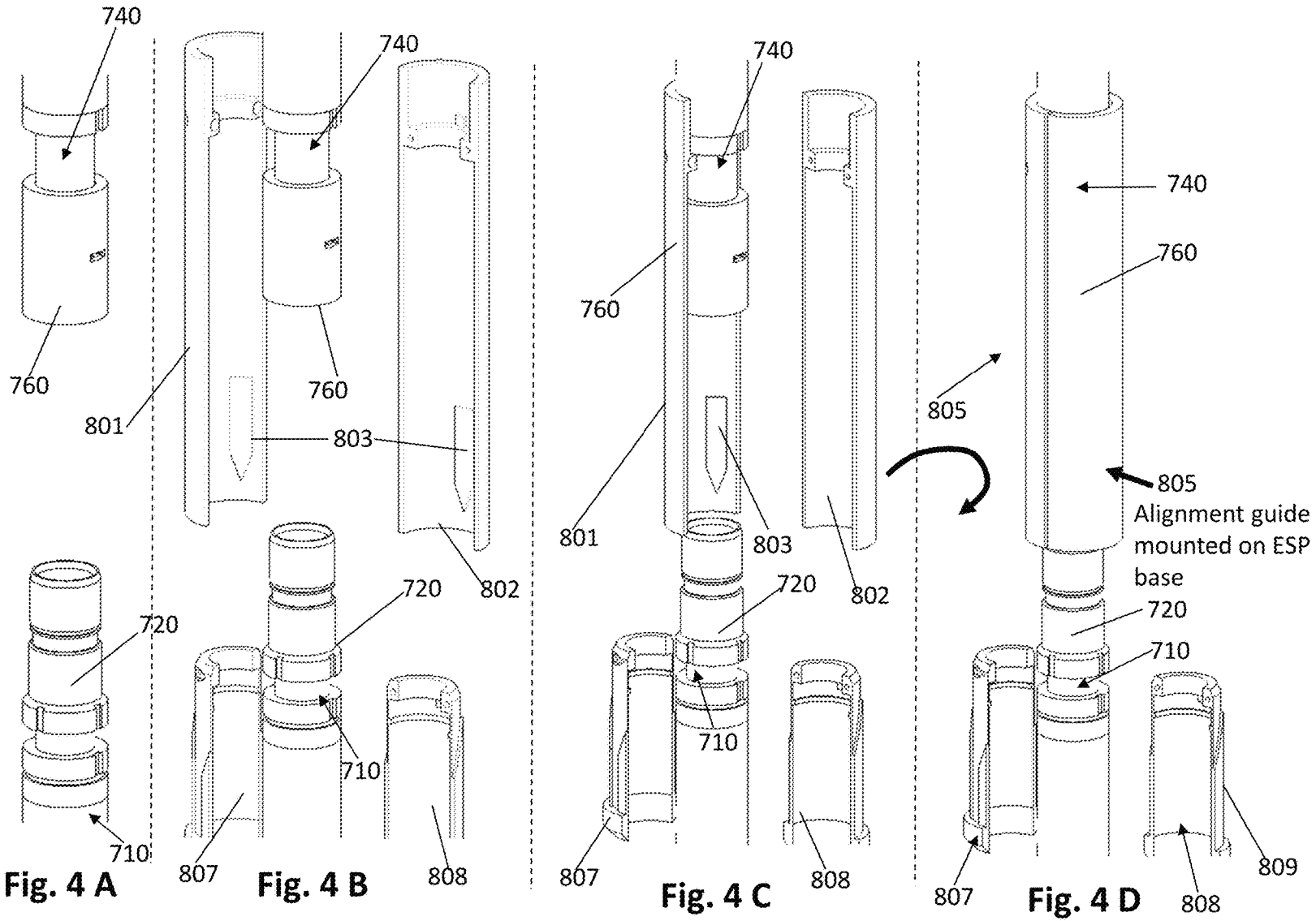

FIG. 4 is a sketch of the installation guides and clasping components and FIGS. 4A through 4J show additional features and components and demonstrate how the guides are used for deployment. Portrayed and shown in the sketches include: a Modified Electric Submersible head 700; an Electric Submersible Head Assembly 710; a locking nut 720 on the Electric Submersible Head Assembly 710; an Electric Submersible Base 740; a collar 760; a release window 785; a set of guides and clasping tools 800 for install of lubricator tools; an alignment guide body left 801; an alignment guide body right 802; an aligning tab 803 for alignment guide 805; an alignment key 804; an alignment guide 805; a mounting flange 806; an alignment tool body left 807; an alignment tool body right 808; an alignment tab 809 for alignment tool 810; and an alignment tool 810.

Figure 5C:
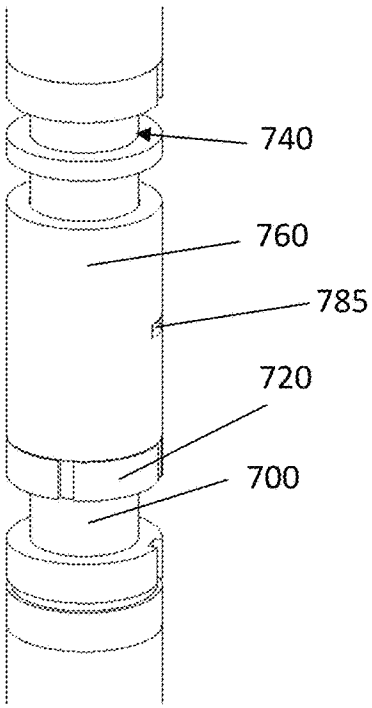
FIGS. 5A through 5C are sketches of the operation to raise the tools to the access hatch, remove guides and deploy.
Figure 5B:
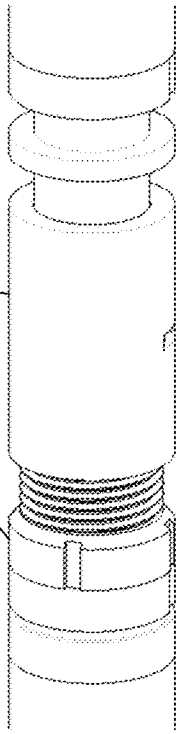
Figure 5A:
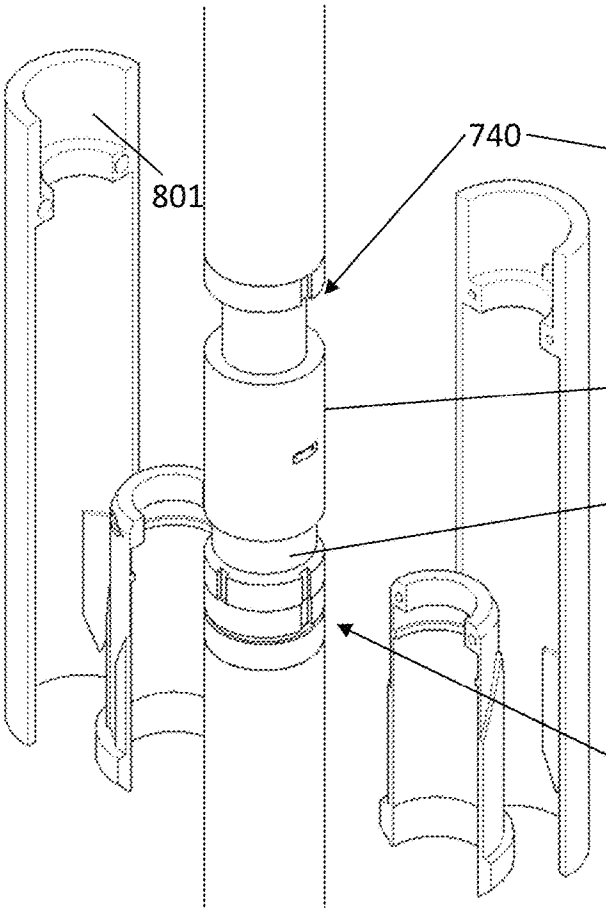

FIGS. 5A through 5 C are sketches of the operation to raise the tools to the access hatch, remove guides and deploy. This is described below in the operations section.

Figure 6:
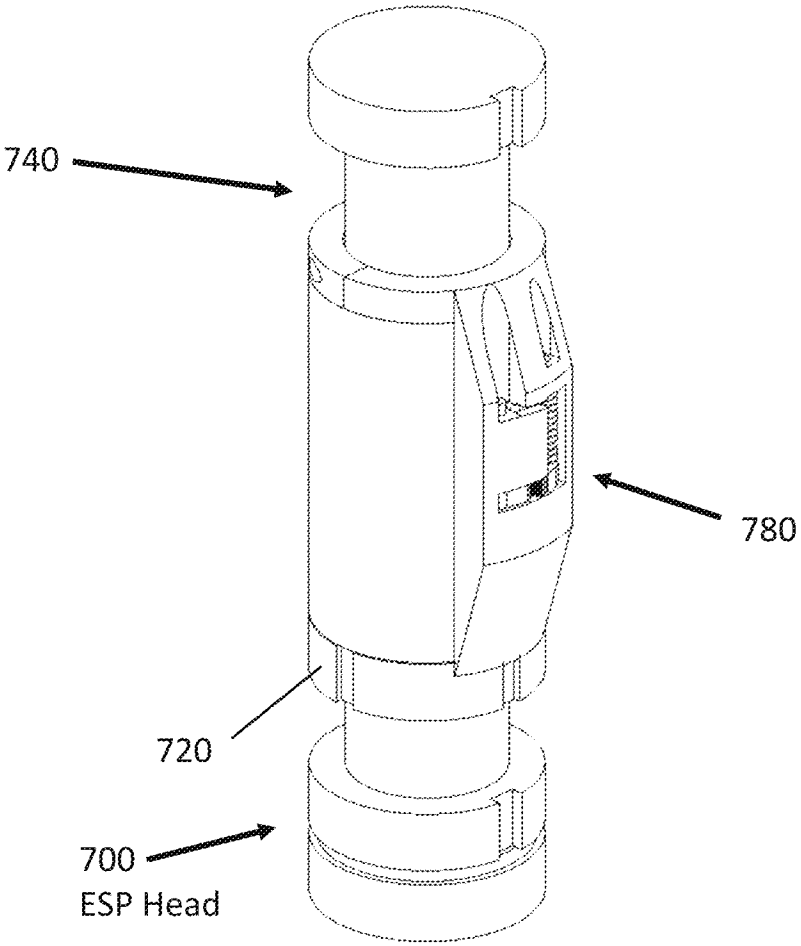
FIG. 6 is a sketch of the release mechanism for the snap rings and FIGS. 6A through 6E portray additional sketches of the release mechanism on the ESP head and base assembly.
Figures 6A, 6B, 6C, 6D, 6E:
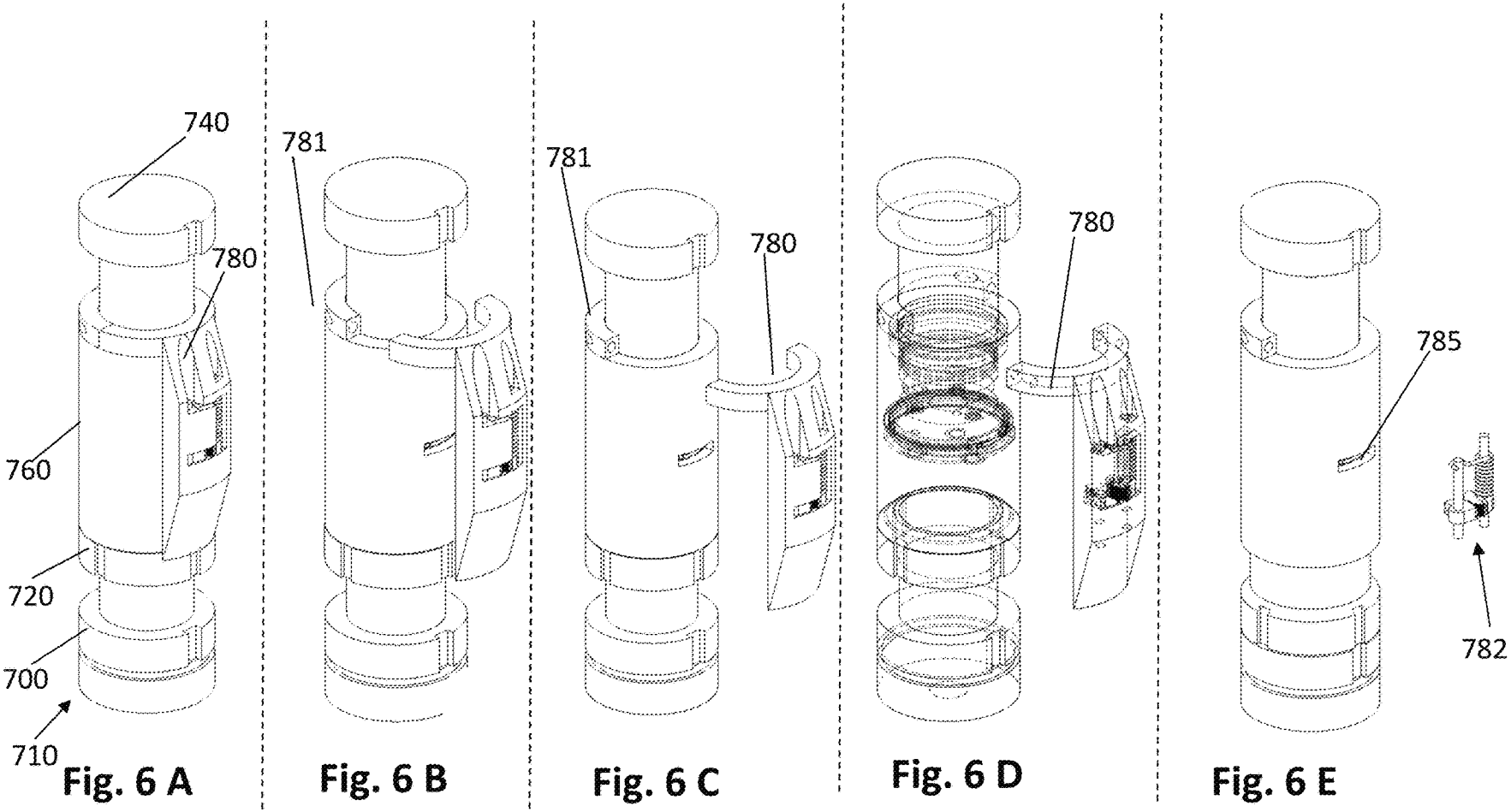
Figures 7A, 7B, 7C, 7D:
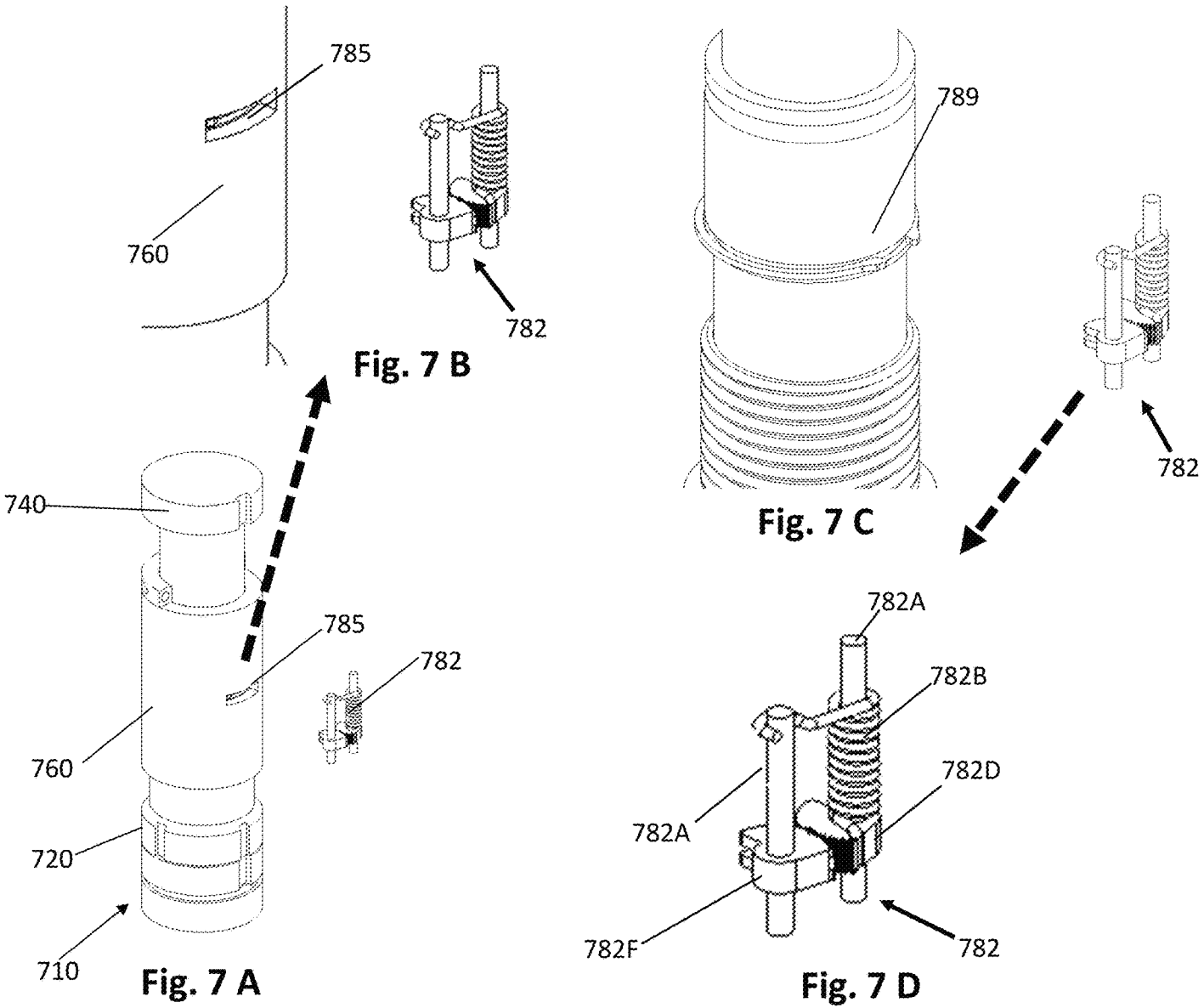
Figure 8F:
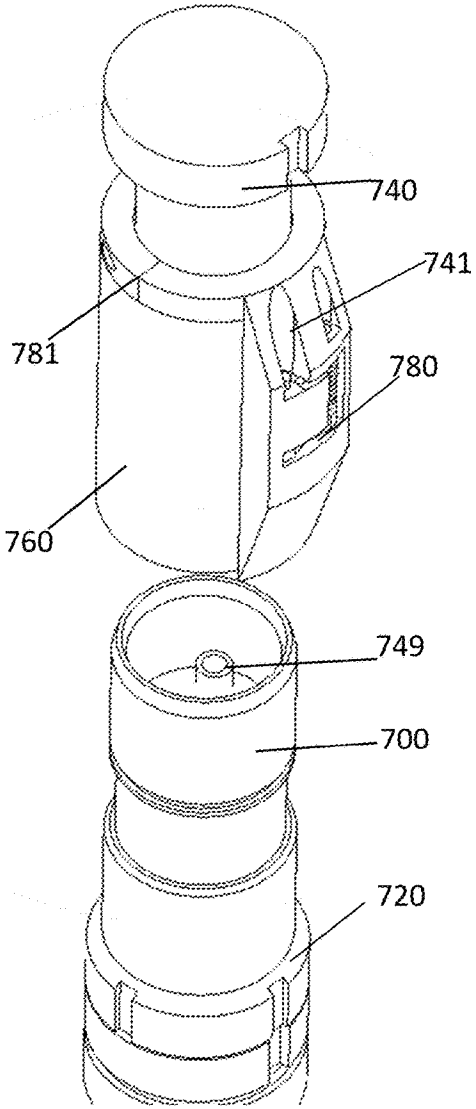
Figure 8D:
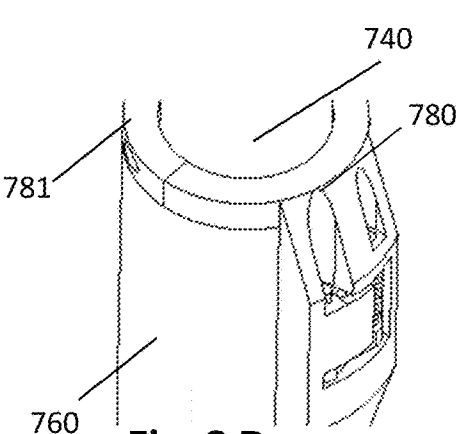
Figure 8E:
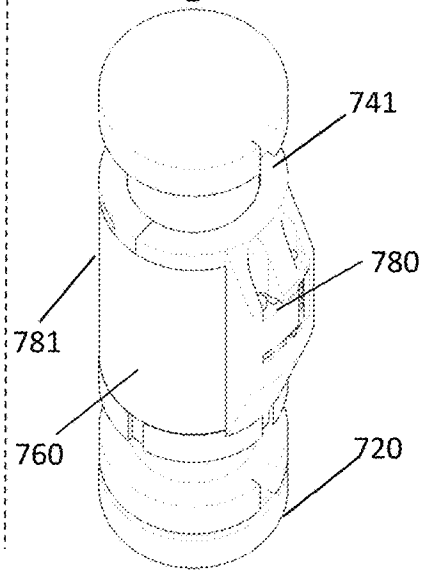
Figure 8A:
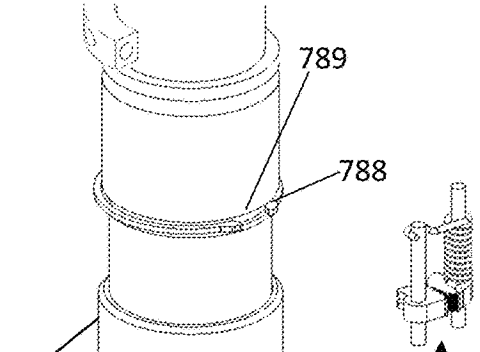
Figure 8B:
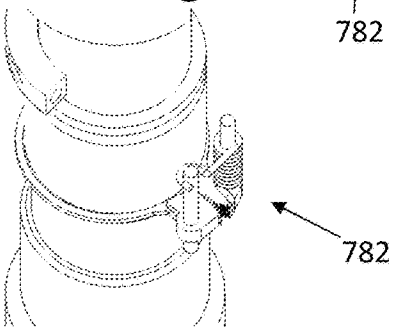
Figure 8C:
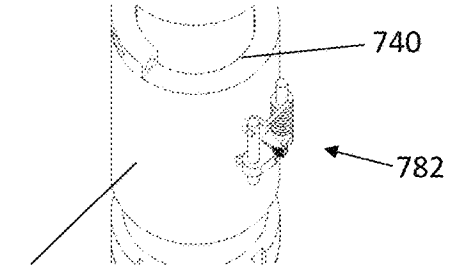

FIG. 6 is a sketch of the release mechanism for the snap rings and FIGS. 6A through 6E portray additional sketches of the release mechanism on the ESP head and base assembly. Components and features are the following: a Modified Electric Submersible head 700; an Electric Submersible Head Assembly 710; a locking nut 720 on the Modified Electric Submersible Head Assembly 710; a Modified Electric Submersible Base 740; a collar 760; a release window 785; an aperture 765 in collar 760 for base 740; a snap ring release mechanism 780; a mounting clamp 781 for snap ring mechanism 780; and a release cam mechanism 782.

FIGS. 7A through D are close-up sketches showing the components for the release cam mechanism. These components provided in the sketches include: a Modified Electric Submersible Head Assembly 710; a locking nut 720 on the Modified Electric Submersible Head Assembly 710; a collar 760; a release window 785; a mounting clamp 781 for snap ring mechanism 780; a release cam mechanism 782; a pin 782A; a torsion spring 782B; a release cam driven 782D; a release cam follower 782F; a snap ring 788; and a groove 789 for snap ring 788.

FIGS. 8A through 8F show the operation of the release cam mechanism. This is described below in the operations section.

FIG. 9 is a sketch of a running tool with integral sealing plug and FIGS. 9A through 9J are additional sketches of the components in the running tool assembly. The components and features demonstrated by these sketches are: a running tool 400; a sealing plug 405 with release pin slots 405A; a dog spring 406; an external thread 407 on plug 405; an internal aperture 408 with threads 408A on plug 405; a seal groove 409 and seal 409A (not shown); a dog 410; a set of slots 411 in dog 410 for release pin 405A travel; a pin 412 to slidingly secure and align plug 405; a set of spaces 413 between dogs 410 to allow contraction; a chamfer 414 on bottom circumference of dog 410; a release pin(s) 415; a nut 416 on release pin 415; a lift spring 420 under slide 425; a slide 425; a set of aperture(s) 426 in slide 425 for release pins 415; an aperture 427 in slide 425 for shear pins 445; an aperture 428 for lift screw 430; an aperture and shoulder 429 for lift spring 420; a lift screw 430; an adapter 435; a housing 440 for components of running tool 400 with integral sealing plug 405; a chamfer 444 on inner circumference of housing 440 to grip and release dog 410 at chamfer 414; and a shear pin 445.

Figures 10A, 10B, 10C, 10D, 10E:
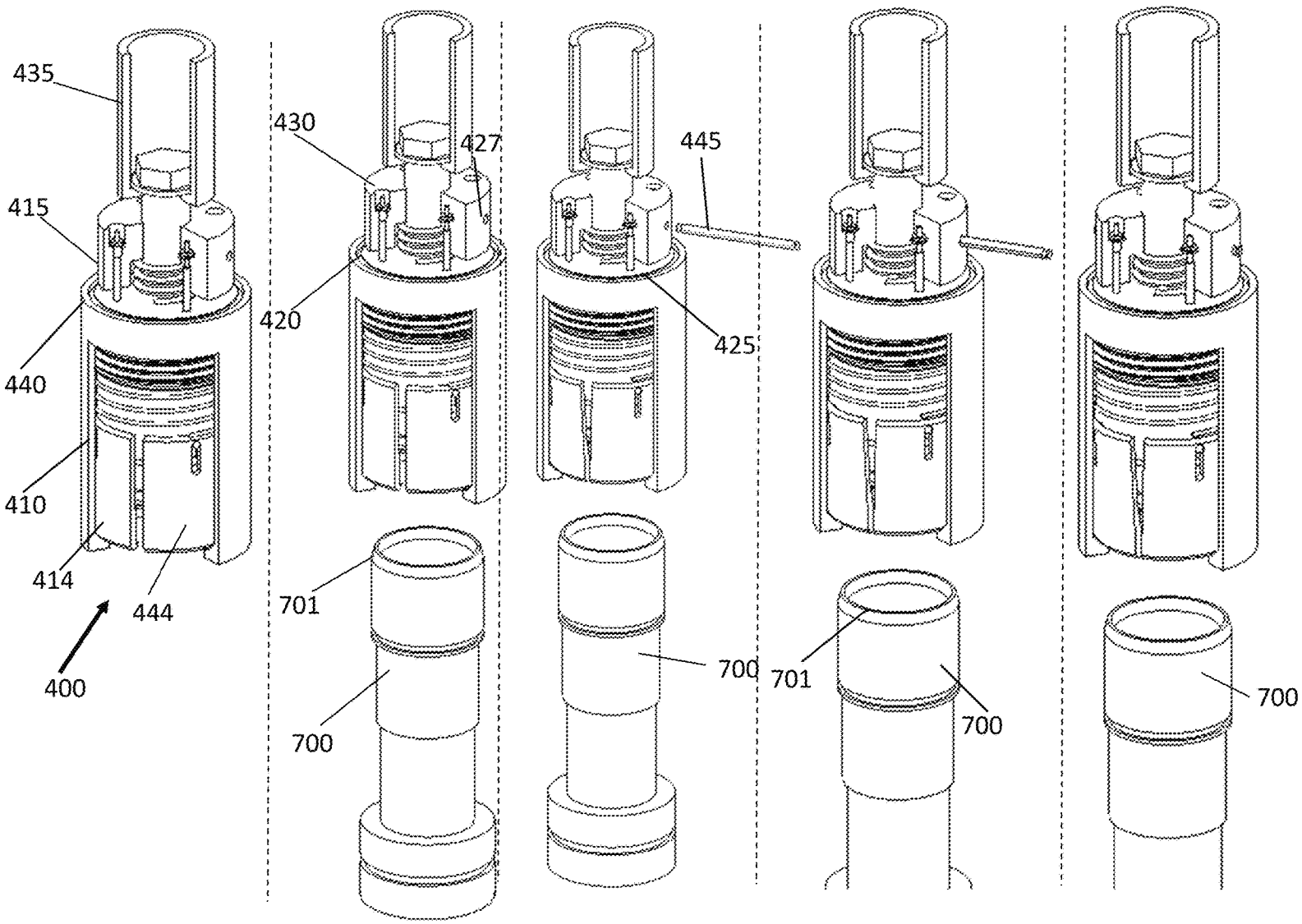
Figures 10F, 10G, 10H, 10I, 10J, 10K:
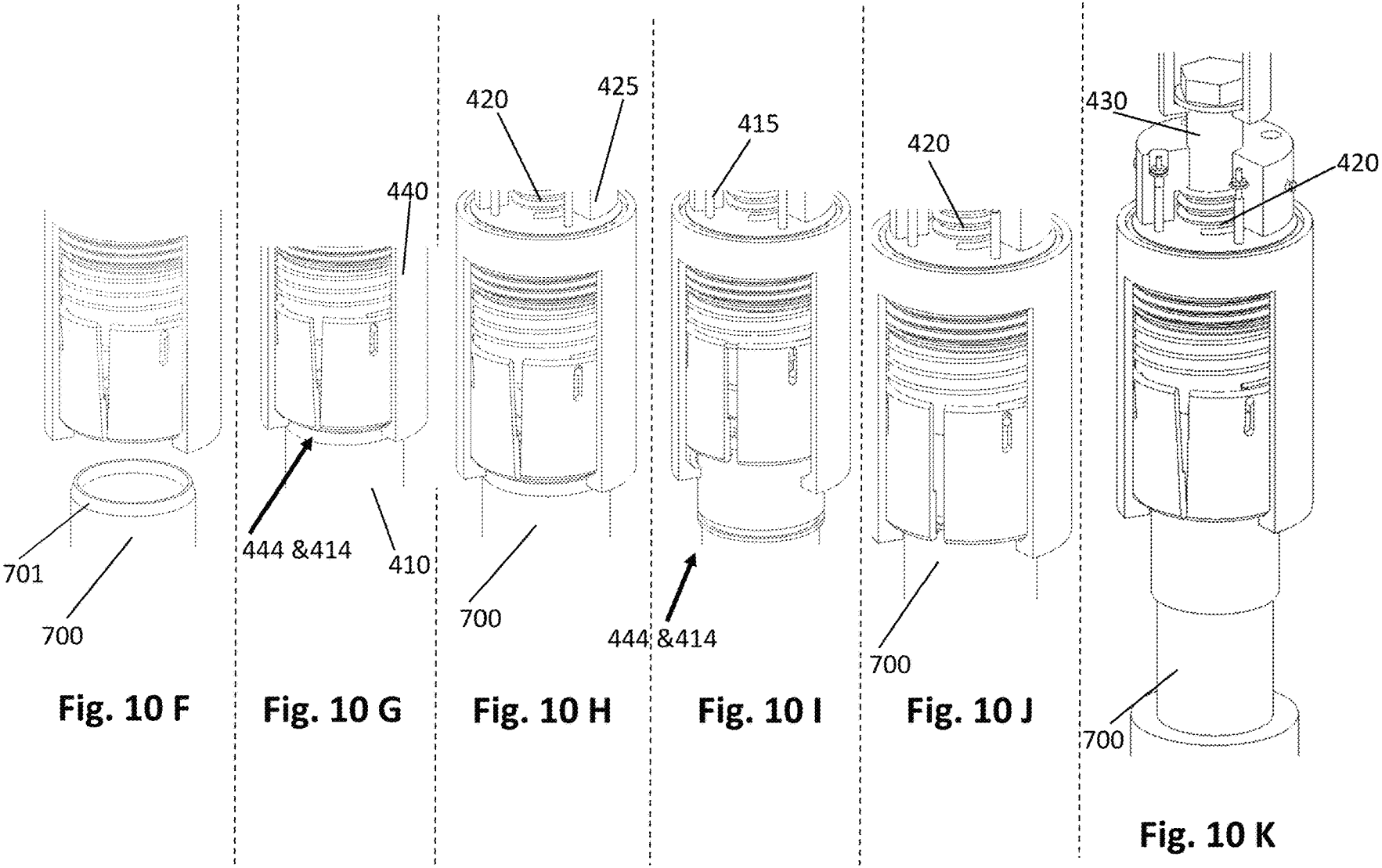
Figures 10L, 10M, 10N, 10O, 10P:
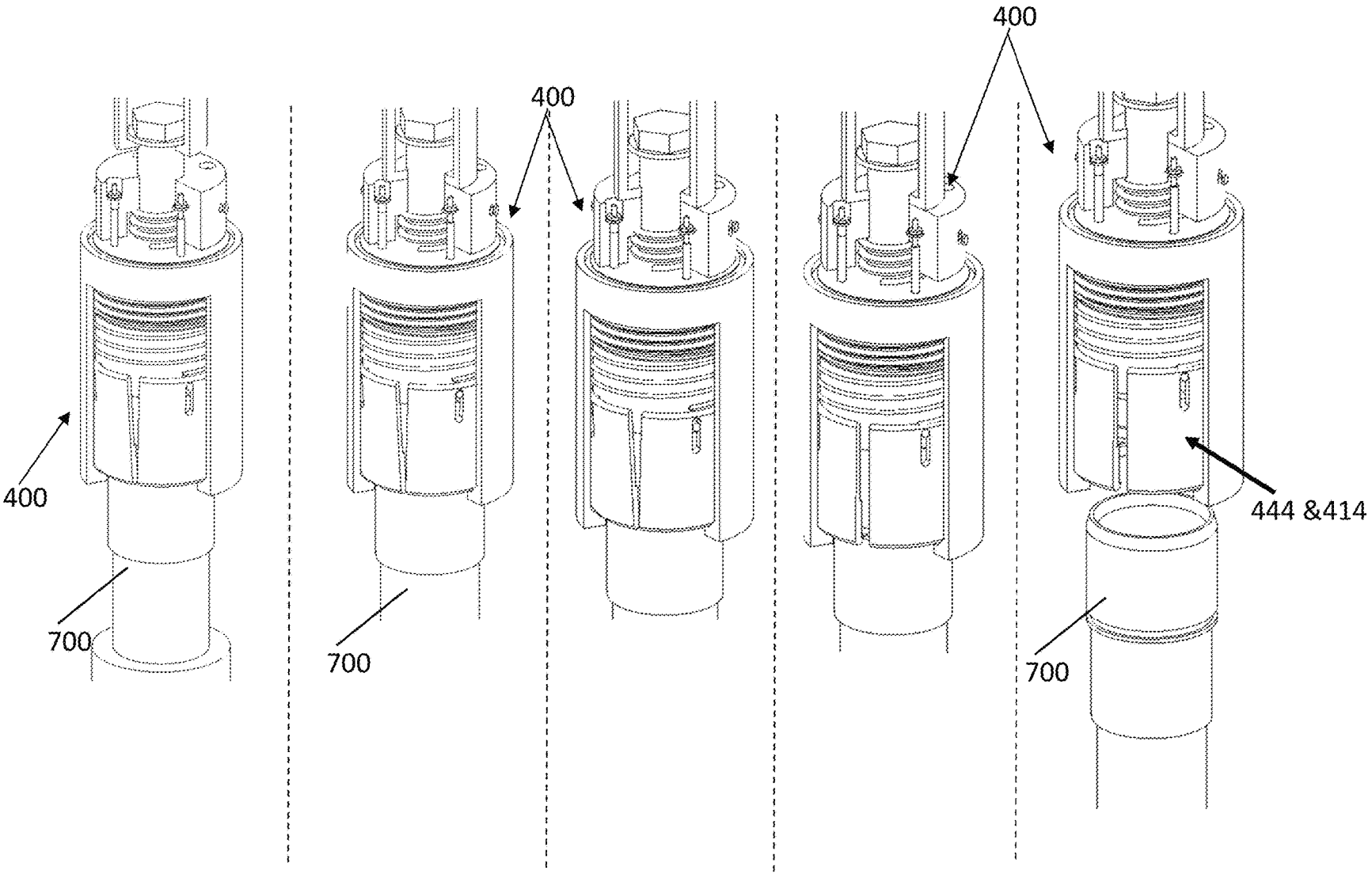

FIGS. 10A through 10K are the running tool with integral sealing plug in a pick-up operation and then FIGS. 10L through 10 P show the operation of releasing the running tool from the head assembly. This is described below in the operations section.

FIG. 11 is a sketch of the tools used for the temporary mating of the ESP components used with standard ESP bases and heads. Depicted here are the components and tools including a standard head 815; a standard base 840; a ratchet bolt 910 six (six) replacing standard assembly bolts 900 on standard head 815; a ratchet half 920 six (6) pairs; a spring clip 930; a ring clamp 940; a guide pin 950; and a ratchet guide 960. The standard ESP head 815 and ESP base 840 shown in the sketch are components of the ESP. The head is at the top of the ESP component (i.e., motor, gauge, seal, pump). The base is at the bottom of the mating ESP component. The tool set comprises a set of ratchet bolts 910 that are screwed into the head 700 and a set of ratchet halves 920, a set of spring clips 930, a set of guide pins 950 a ratchet guide 960 and a ring clamp 940 that are made up to the standard base 840. The number of ratchet bolts and associated ratchet halves are determined by the required holding force for the specific application. The ratchet bolts 910 are inserted into the standard head 815 of the ESP component before the component is placed in the lubricator and subsequently lowered into the pressure containment system. The remaining tools are made up to the base of the ESP component prior to placing the component into the lubricator.

Figure 12E:
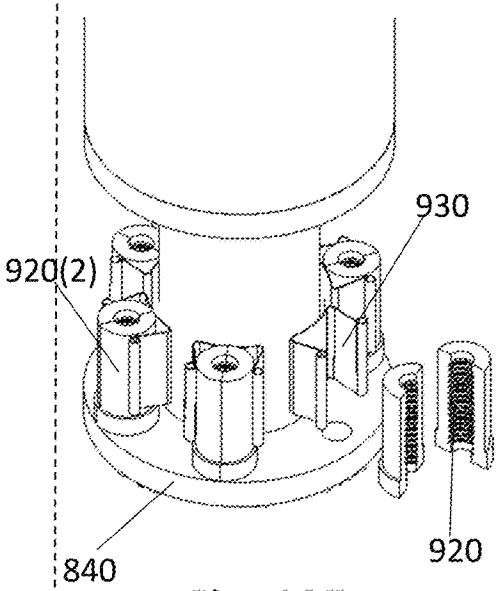
Figure 12C:
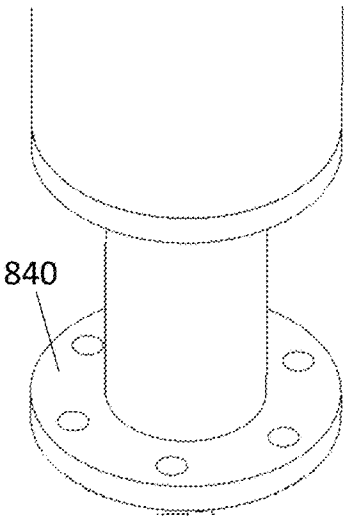
Figure 12D:
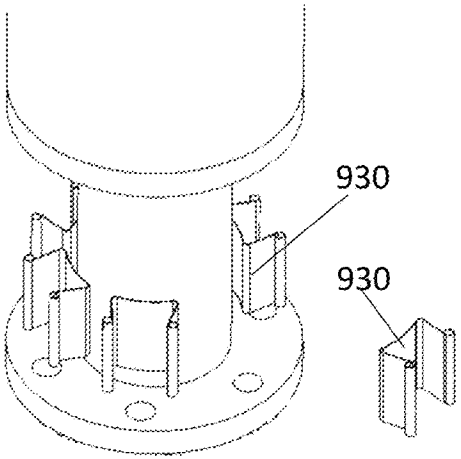
Figure 12B:
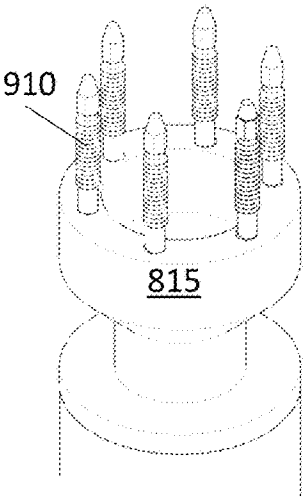
Figure 12A:
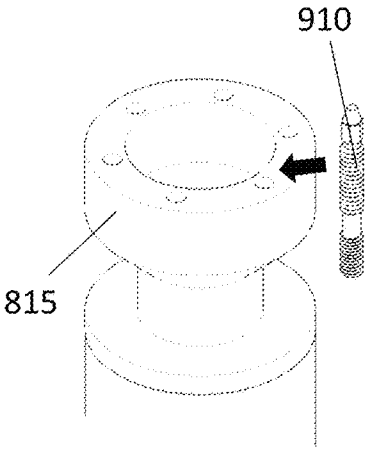
Figures 12F, 12G, 12H, 12I:
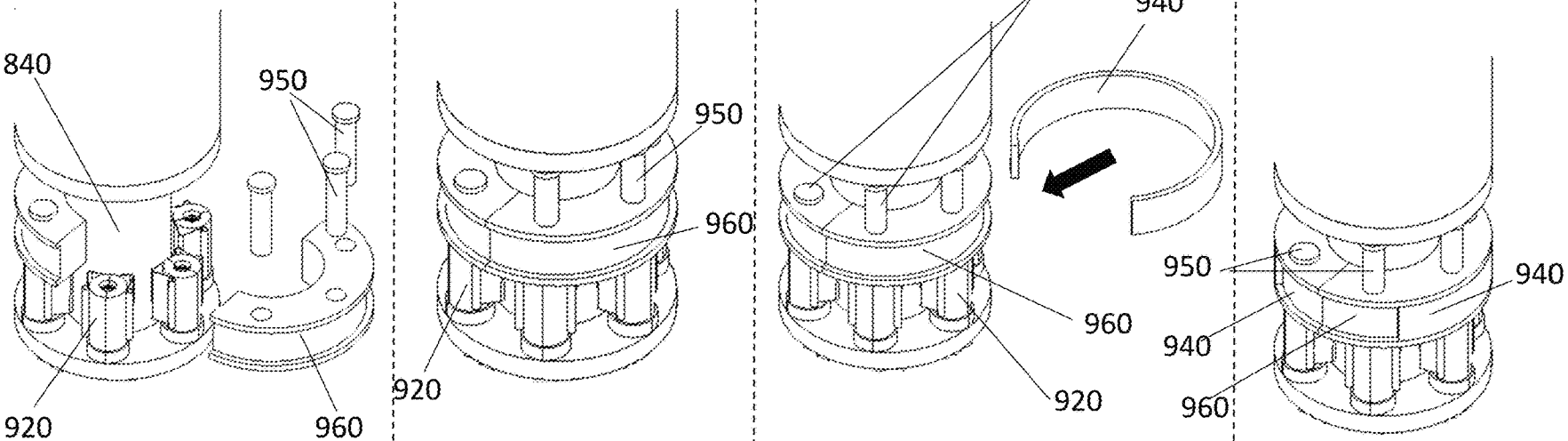
Figures 12J, 12K, 12L, 12M:
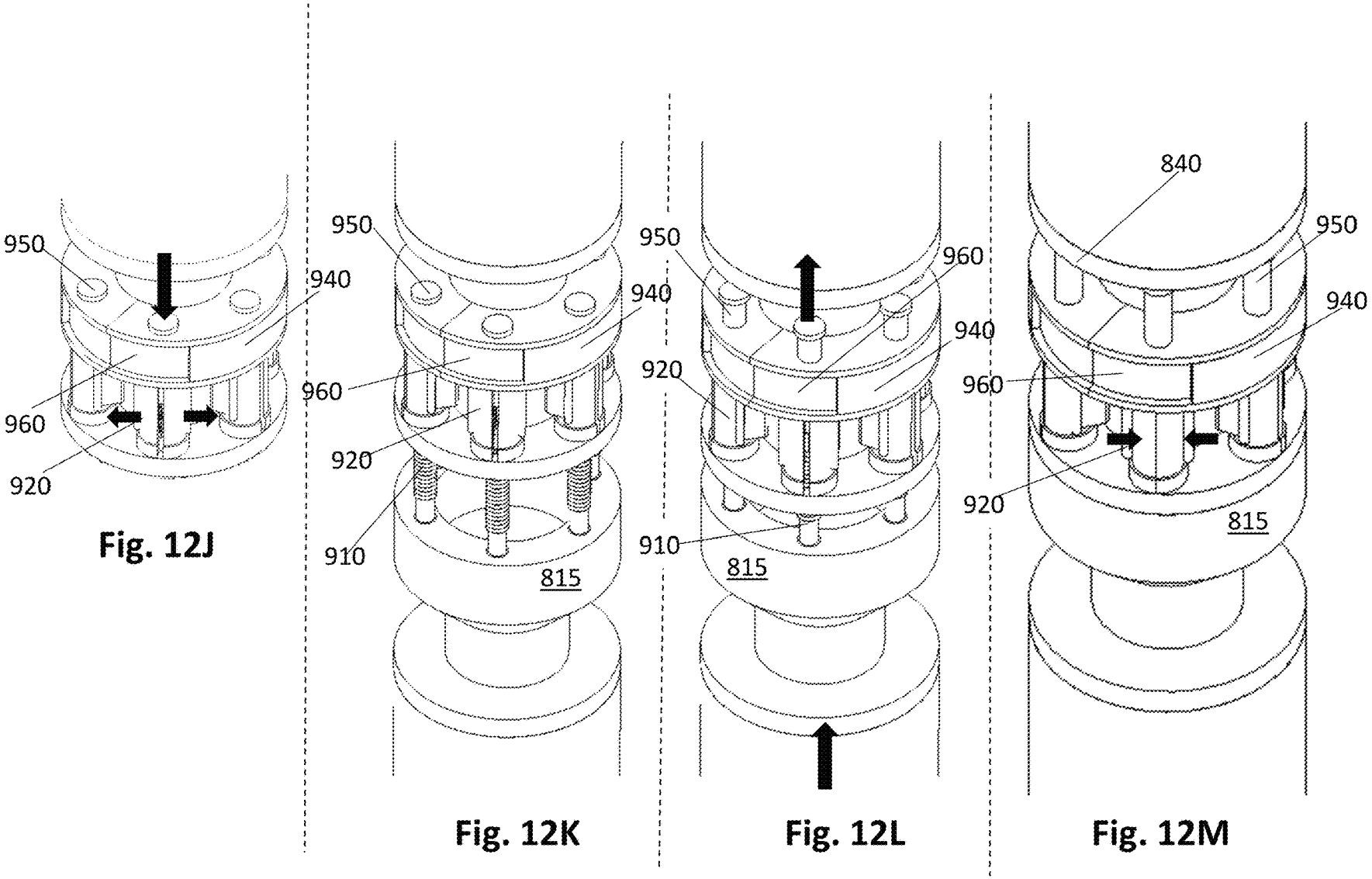

FIGS. 12A through 12M are the makeup of the upper and lower ESP components with the mating tools and then the mating operation of the upper and lower ESP components inside the pressure containment system. The components shown include a standard head 815; a standard base 840; an assembly bolt 900 securing standard head 815 to standard base 840; a ratchet bolt 910 six (six) replacing standard assembly bolts 900 on standard head 815; a ratchet profile 915 of ratchet bolt 910 undercut for fit into thread profile of ratchet halves 920; a ratchet half 920 six (6) pairs; a spring clip 930; a ring clamp 940; a guide pin 950; and ratchet guide 960. FIG. 12A is a sketch of the ratchet bolt and the ESP component and head assembly prior to making up the bolts to the head. FIG. 12B is a sketch of the head with the ratchet bolts attached. This ESP component is then placed in the lubricator and lowered into the pressure containment assembly. FIG. 12C is a sketch showing the mating ESP component and base assembly prior to makeup of the tools. FIG. 12D is a sketch of the spring clips being made up to the base. FIG. 12E is a sketch of the ratchet halves being placed inside the spring clips. FIG. 12F is a sketch of the ratchet guide pins and the ratchet guide being made up to the base. The ratchet guide positions the ratchet halves and the guide pins in line with the bolt holes of the base. FIG. 12G is a sketch of the ESP base with the ratchet guide, ratchet pins, and ratchet halves attached. FIG. 12H is a sketch of the ring clamp being made up to the ratchet guide. The ring clamp will hold the ratchet guide and associated tools in position during the mating operation. FIG. 12I is a sketch of the ring clamp made up to the ESP base. FIG. 12J is a sketch of the guide pin being pressed down into the ratchet halves to hold them open for the mating operation. This ESP component is now placed into the lubricator and subsequently lowered into the pressure containment system for mating. FIG. 12L is a sketch of the start of the mating operation inside the pressure containment system. As the mating ESP component is lowered into the pressure containment system the alignment tools orient the head and base to align the ratchet bolts with the holes in the ESP base and associated ratchet halves. (alignment tools shown described in the sketches provided in FIGS. 4 and 5). As the mating ESP component continues to be lowered the ratchet bolt of the lower ESP component is inserted in the hole of the ESP base and inside the ratchet halves ultimately contacting the guide pin and pushing it upward. FIG. 12M is a sketch of the ratchet halves closing around the ratchet bolt after the guide pin has been pushed out of the ratchet halves. The ratchet halves are forced closed by the action of the spring clips.

FIGS. 13A through 13C are cross section views of one ratchet bolt mounted to the standard head of the lower ESP component, the guide pin being pushed out of the ratchet guide and the ratchet halves closing around the ratchet bolt, and the undercut profile of the ratchet bolt creating forces and the inter play of the tools. Note here the standard head 815; a standard base 840; a ratchet bolt 910 six (six) replacing standard assembly bolts 900 on standard head 700; a ratchet profile 915 of ratchet bolt 910 undercut for fit into thread profile of ratchet halves 920; a ratchet half 920 pair; a ring clamp 940; a guide pin 950; a dimple/recess 955 on insert end of guide pin 950 to help center tapered end of ratchet bolt 910; and a ratchet guide 960. FIG. 13A is a cross section view of one ratchet bolt mounted to the head of the lower ESP component, two ratchet halves, a guide pin, and a ratchet guide attached to the base of the mating ESP component. FIG. 13B is a cross section view of the mating operation depicting the guide pin being pushed out of the ratchet guide and the ratchet halves closing around the ratchet bolt. FIG. 13C is a cross section view of the mated ratchet bolt and ratchet halves. The undercut profile of the ratchet bolt creates a force compressing the ratchet halves inward towards the ratchet bolt when tensile force is applied to the mating components. The temporary assembly is raised into the lubricator until the temporary mated connection is above the pressure containment system. The pressure is released, and the access panel of the lubricator is opened. The alignment guide and alignment tool are removed from the mated assembly. The ratchet guide and guide pins are removed from the mated assembly. The ratchet bolts and associated ratchet halves and spring clips are successively replaced by the standard ESP bolt. After all bolts are in place the access panel is closed, the pressure is equalized the BOP is opened and the system is lowered into the well.

FIG. 14 is a sketch of the tools used for the de-mating of the ESP components. Portrayed are the a standard head 815; a standard base 840; a ratchet bolt 910 six (six) replacing standard assembly bolts 900 on standard head 700; a ratchet ring quarter 970; a boss 975 on back side of ratchet quarter 970; a head support 980; a stop pin 983 of head support 980; a lock slide 986; a lift pin 987; an internal pocket 988 of lock slide 986; a landing assembly 990; a landing shoulder 992; a landing spring 995; and a landing top plate 998. The de-mating tools shown here create a temporary joint between the ESP components by removing the standard bolted connection 900 and replacing with the de-mating tool kit. The tools are assembled on the head 815 and base 840 of an assembled ESP. The tools are made up to the ESP while the mated joint to be separated is positioned in the open atmosphere above the pressure containment system. The lower portion of the ESP assembly is positioned inside the pressure containment system and well control is maintained by closing the blow out preventer around the lower section of the ESP assembly. The tool kit to replace the ESP bolted connection include a set of ratchet bolts that replace the bolts in the head, sets of ratchet ring quarters 970, lock slides 986 with lift pins 987 that are made up to the base of the upper ESP component and a head support ring 980 with stop pins 983 that is made up to the head of the lower ESP component. The number of ratchet bolts 910 and associated lock slides 986, and ratchet quarter sets 970 are determined by the maximum tensile holding force required for the application. Additionally, a spring activated landing system 990 is installed inside the pressure containment system to activate the release mechanism. The spring-loaded landing system includes a top landing plate 998, a landing spring 995, and a landing shoulder 992.

FIGS. 15A through 15T are sketches of the de-mating tools attached to the mated standard ESP assembly and then the de-mating operation performed inside the pressure containment system to de-couple the standard ESP components, particularly the head from the base. The spring is removed for clarity. Here are again shown the a standard head 815; a standard base 840; an assembly bolt 900 securing standard head 815 to standard base 840; a ratchet bolt 910 six (six) replacing standard assembly bolts 900 on standard head 700; a ratchet ring quarter 970; a head support 980; a stop pin 983 of head support 980; a lock slide 986; a lift pin 987; a landing assembly 990; a landing shoulder 992; a landing spring 995; and a landing top plate 998. In several views the spring 995 is removed for clarity. FIG. 15A is a sketch of the mated ESP assembly and the ratchet bolt. FIG. 15B is a sketch of the ratchet bolt replacing the ESP bolt in the mated ESP assembly. FIG. 15C is a sketch of two of the ratchet quarters prior to mating with the ratchet bolt of the ESP mated assembly. FIG. 15D is a sketch of the four (4) ratchet quarters made up to one of the ratchet bolts of the mated ESP assembly. FIG. 15E is a sketch of lock slide prior to sliding over the ratchet quarters of the mated ESP assembly. FIG. 15F is a sketch of the lock slide sliding over the ratchet quarters of the mated ESP assembly. FIG. 15G is a sketch of the lock slide positioned over one of the ratchet quarter sets of the mated ESP assembly. FIG. 15H is a sketch of the mated ESP assembly with all bolts replaced by the ratchet bolts and associated ratchet quarter sets and lock sleeves. FIG. 15I is a sketch of the head support being made up to the head of the lower component of the ESP mated assembly. FIG. 15J is a sketch of the lift pin prior to insertion through the head support and into the lock slide that is made up to the mated ESP assembly. FIG. 15K is a sketch of the motion of the lift pin as it is made up to the lock slide of the mated ESP assembly. Note the arrow showing how the lift pin passes through the head support. FIG. 15L is a sketch of the lift pin assembled to one of the lock slides of the mated standard ESP assembly. FIG. 15M is a sketch of the assembled tool kit for the de-mating operation. The assembled joint may now be enclosed in the lubricator and lowered into the pressure containment system for de-mating. FIG. 15N is a sketch of the mated ESP assembly being lowered into the pressure containment system and approaching contact with top plate of the spring-loaded landing system that is positioned inside the pressure containment system. FIG. 15O is a sketch of the head support in contact with the top plate of the spring-loaded landing system and the lift pin contacting the landing shoulder of the spring-loaded landing system. The spring has been removed from the sketch for clarity. The spring applies an upward force on the ESP assembly through the head support reducing the tensile force at the joint of the ESP assembly. FIG. 15P is a sketch of the ESP assembly continuing to be lowered into the pressure containment system until the stop pin contacts the landing shoulder. During this operation the lift pin is pushed upward pushing the lock slide upward. FIG. 15Q is a close view of the lock slide showing the position of the lock slide relative to the ESP assembly and the ratchet quarter set. FIG. 15R is a sketch of the ratchet set quarters moving away from the ratchet bolts into the internal pockets of the lock slide. As the ratchet quarters slide away from the ratchet bolt the retaining force between the ratchet quarters and the ratchet bolt are released. FIG. 15S is a sketch of the ESP assembly as the mated joint separates. FIG. 15T is a sketch of the ESP mated connection fully separated.

Figures 16A, 16B, 16C:
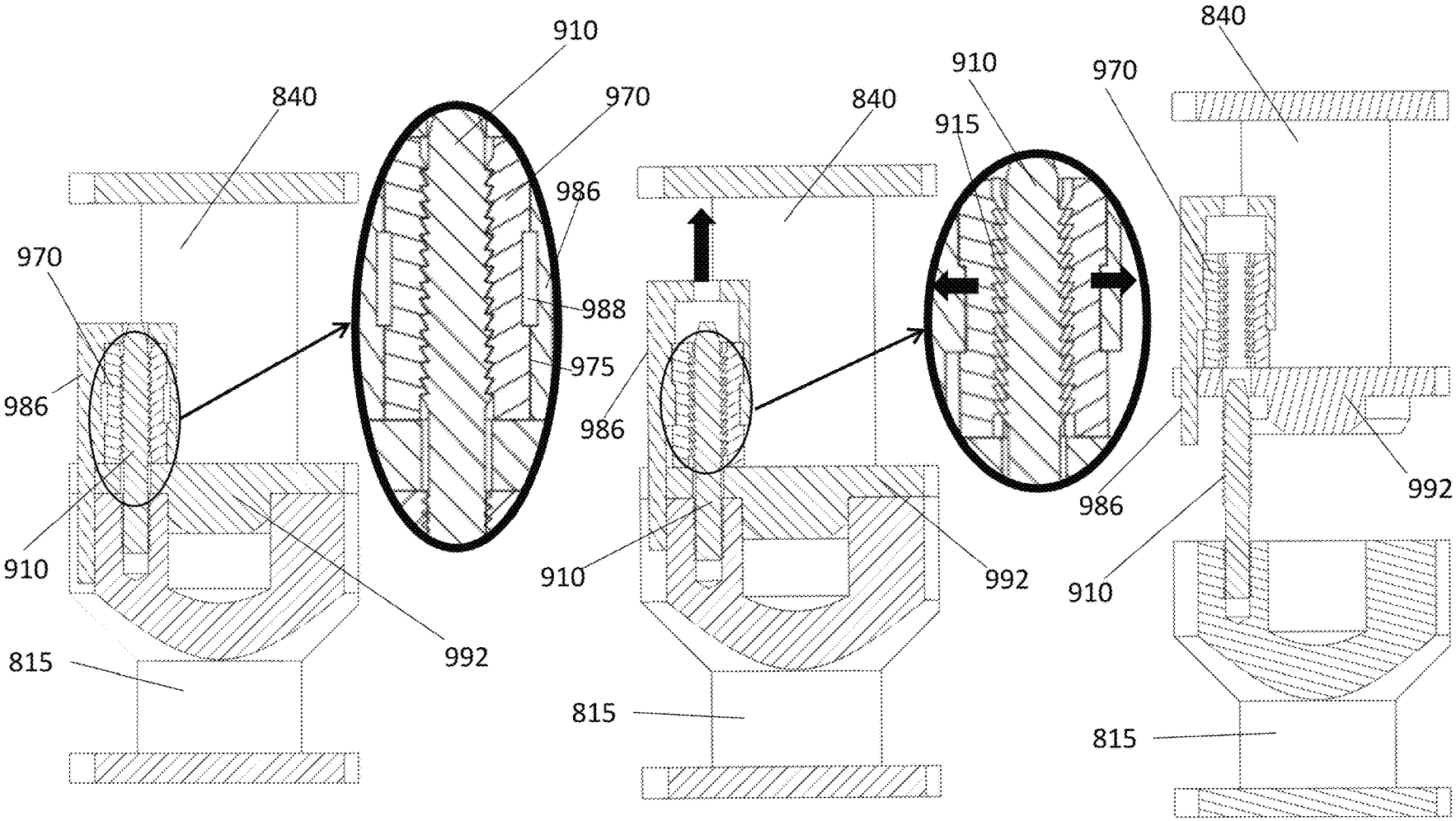
Figure 16F:
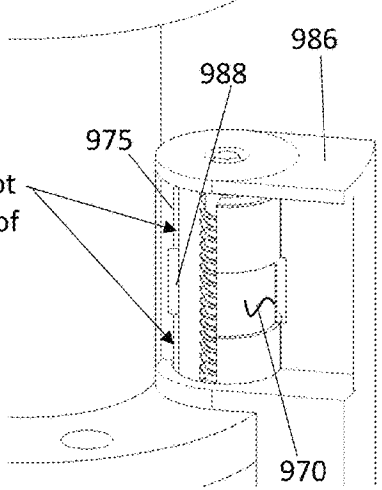
Figure 16E:
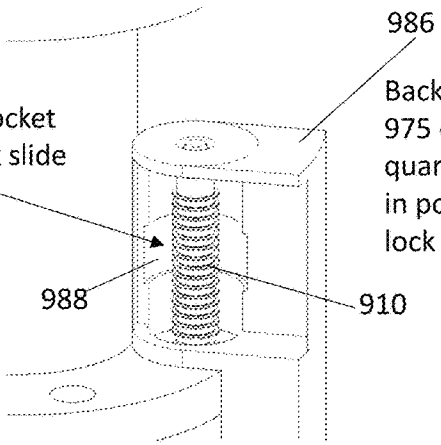
Figure 16D:
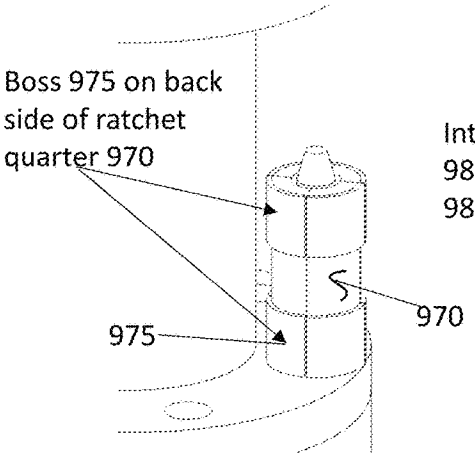
Figure 16H:
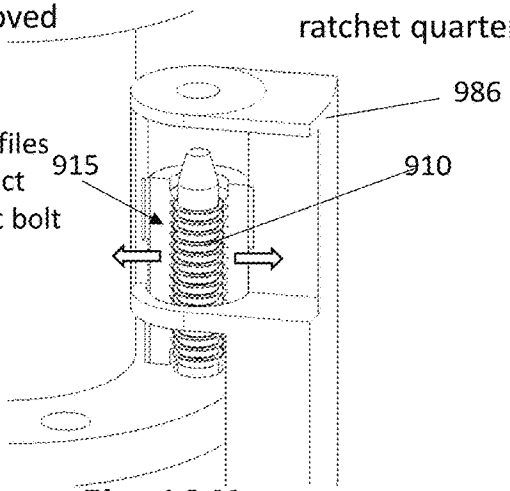
Figure 16G:
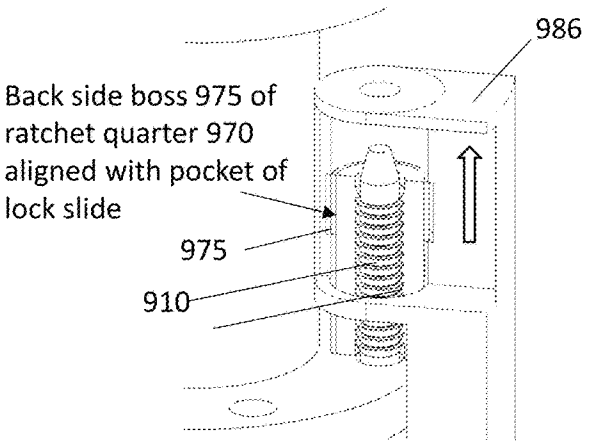

FIGS. 16A through 16 H are sketches of cross sections of the mated ESP assembly and one of the lock slides with the ratchet bolts and ratchet quarter, movement as the lock slide is pushed upward from its original position, and then as the ratchet bolt, lock slide, and ratchet quarters decouple and free and separate the ESP components particularly the head and the base. Exploded views of the bosses and pockets are provided for clarity. Noted are: a standard head 815; a standard base 840; a ratchet bolt 910 six (six) replacing standard assembly bolts 900 on standard head 700; a ratchet profile 915 of ratchet bolt 910 for fit into thread profile of ratchet ring quarters 970; a ratchet ring quarter 970; a boss 975 on back side of ratchet quarter 970; a lock slide 986; a lift pin 987; an internal pocket 988 of lock slide 986; and a landing shoulder 992. FIG. 16A is a sketch of a cross section of the mated ESP assembly and one of the lock slides with the ratchet bolts and ratchet quarters. The inset view shows the connection of the ratchet bolt to the ratchet quarter. FIG. 16B is a sketch of the cross section of the mated ESP assembly and one of the lock slides with the ratchet bolts and ratchet quarters. The lock slide has moved upward from its original position and the ratchet quarter may now slide into the internal pockets of the lock slide. The inset view shows the ratchet profile pushes the ratchet quarters away from the ratchet bolt as tension is applied to the mated connection. FIG. 16C is a sketch of the cross section of the separated ESP components and the ratchet bolt, lock slide, and ratchet quarters. FIG. 16D is a sketch of the boss 975 on back side of ratchet quarter 970. FIG. 16E is a sketch of the Internal pocket 988 in lock slide 986. FIG. 16F is a sketch of the back side boss 975 of ratchet quarter 970 not yet in pocket 988 of lock slide 986. FIG. 16G is a sketch of the back side boss 975 of ratchet quarter 970 aligned with pocket 988 of lock slide 986. FIG. 16H is a sketch of the ratchet quarter 970 profiles 915 no longer in contact with ratchet bolt 910.

The details mentioned here are exemplary and not limiting. Other specific components and manners specific to describing an Electric Submersible Pump (ESP) Deployment Method 33 and Tools to Accomplish Method for Oil Wells may be added as a person having ordinary skill in the field of oil well systems, methods, pumps, and accessories in the oil well and oil production industry and their uses well appreciates.

OPERATION OF THE PREFERRED EMBODIMENT

The Electric Submersible Pump (ESP) Deployment Method 33 and Tools to Accomplish Method for Oil Wells has been described in the above embodiment. The manner of how the device operates is described below. One notes well that the description above and the operation described here must be taken together to fully illustrate the concept of the method and system. The preferred embodiment of an Electric Submersible Pump (ESP) Deployment Method 33 and Tools to Accomplish Method for Oil Wells is described here. The Electric Submersible Pump (ESP) Deployment Method and Tools to exchange the ESP and strings utilizing a lubricator and standard pressure control equipment (valves, Blow Out Preventers) for Oil Wells comprising:

First, place the standard pressure containment system—a wireline system in place at a well for the workover and do the following steps:

Step 1: Close valves 320, 330 and Bleed pressure with bleed valve 315;

Step 2: Break out lubricator 310;

Step 3: Lower running tool 400 to latch on ESP component or another unit;

Step 4: Lift tool string 390 into lubricator 310;

Step 5: Make up lubricator 310;

Step 6: Open pressure equalization valve 330 and Open master valve 320;

Step 7: Lower tool string 390 and mate to motor 30;

Step 8: Lift tool string 390 for final makeup

Step 9: Close BOP ram 350, Close pressure equalization valve 330, and Bleed pressure with bleed valve 315;

Step 10: Open access panel 500 on lubricator 310, Make up collar 550, and Close access panel 500;

Step 11: Close bleed valve 315, Open pressure equalization valve 330, and Open BOP ram 350;

Step 12: Lower the tool string (390) to rest on a shoulder (450) and release the running tool (400);

Step 13: Repeat Steps 1 through 12 to complete assembly of the remaining components of the ESP string;

Step 14: After complete assembly of ESP string, lower the ESP string to the pump setting depth and mate the ESP motor connector to the docking station in the borehole.

Step 15: Release running tool string from ESP and pull to surface.

Step 16: Remove the wireline equipment from the well, remove the standard pressure containment system, and re-start the operation Step 17: Removal of the ESP from the well is the reverse of the installation.

wherein the manner to exchange the ESP and strings utilizing a lubricator and standard pressure control equipment (valves, Blow Out Preventers) are enabled using improved tools including a running tool with integral sealing plug, alignment guides, and a simple snap ring release mechanism. Alternative makeup and decouple tools are shown.

FIGS. 2A through 2Z are sketches describing the full example of the method and the operation of how to use an oil lubricator and showing the special deployment tools to accomplish an ESP/motor exchange. Described in the method are the following components and features: an electric submersible pump (ESP) 30; a grease injection head 301; a lubricator 310; a bleed valve 315; a master valve 320; a pressure equalization valve 330; a blow out preventer (BOP) 350 is a mechanical device connected to the wellhead to control and prevent blowouts; one or more valves installed at the wellhead to prevent the escape of pressure either in the annular space between the casing and the drill pipe or in open hole; a well head 360, the equipment installed at the surface of the wellbore. A wellhead includes such equipment as the casing head and tubing head; a string 390 of pumps, etc.; a running tool 400 with integral sealing plug 405; a shoulder 450 of casing; an access panel 500; an assembly collar 550; and a secondary motor/protector 600.

An example of an Electric Submersible Pump (ESP) Deployment Method 33 and Tools to Accomplish Method for Oil Wells are shown in the following table:

| Process of Deployment |
|---|
| 1. Close equalization 330 and master valves 320 |
| 2. Open bleed valve 315 |
| 3. Break out lubricator 310 |
| 4. Lower running tools 400 to latch onto ESP Power Plug 30 |
| 5. Pull string 390 into lubricator 31 |
| 6. Make up lubricator 310 |
| 7. Open pressure equalization valve 330 |
| 8. Open master valve 320 |
| 9. Lower string 390 to rest on shoulder 450 |
| 10. Release running tool string 390 |
| 11. Close valves 320, 330 |
| 12. Bleed pressure with bleed valve 315 |
| 13. Break out lubricator 310 |
| 14. Lower running tool 400 to latch on ESP motor 30 |
| 15. Lift string 390 into lubricator 310 |
| 16. Make up lubricator 310 |
| 17. Open pressure equalization valve 330 |
| 18. Open master valve 320 |
| 19. Lower string 390 into well 360 and mate to Power Plug 30 |
| 20. Lift tool string 390 for final makeup |
| 21. Close BOP ram 350 |
| 22. Close pressure equalization valve 330 |
| 23. Bleed pressure with bleed valve 315 |
| 24. Open access panel 500 on lubricator 310 |
| 25. Make up collar 550 |
| 26. Close access panel 500 |
| 27. Close bleed valve 315 |
| 28. Open pressure equalization valve 330 |
| 29. Open BOP ram 350 |
| 30. Lower tool string 390 to rest on shoulder 450 |
| 31. Release running tool 400 |
| 32. Close valves 320, 330 |
| 33. Bleed pressure with bleed valve 315 |
| 34. Break out lubricator 310 |
| 35. Lower running tool 400 to latch on protector 600 |
| 36. Lift tool string 390 into lubricator 310 |
| 37. Make up lubricator 310 |
| 38. Open pressure equalization valve 330 |
| 39. Open master valve 320 |
| 40. Lower tool string 390 and mate to motor 30 |
| 41. Lift tool string 390 for final makeup |
| 42. Close BOP ram 350 |
| 43. Close pressure equalization valve 330 |
| 44. Bleed pressure with bleed valve 315 |
| 45. Open access panel 500 on lubricator 310 |
| 46. Make up collar 550 |
| 47. Close access panel 500 |
| 48. Close bleed valve 315 |
| 49. Open pressure equalization valve 330 |
| 50. Open BOP ram 350 |
| 51. Lower tool string 390 to rest on shoulder 450 |
| 52. After making up of all ESP components lower ESP string to pump setting depth. |
| 53. Release running tool 400 |
| 54. Pull to surface |
| 55. Retrieval process is the reverse of deployment |

Figures 3A, 3B, 3C, 3D, 3E:
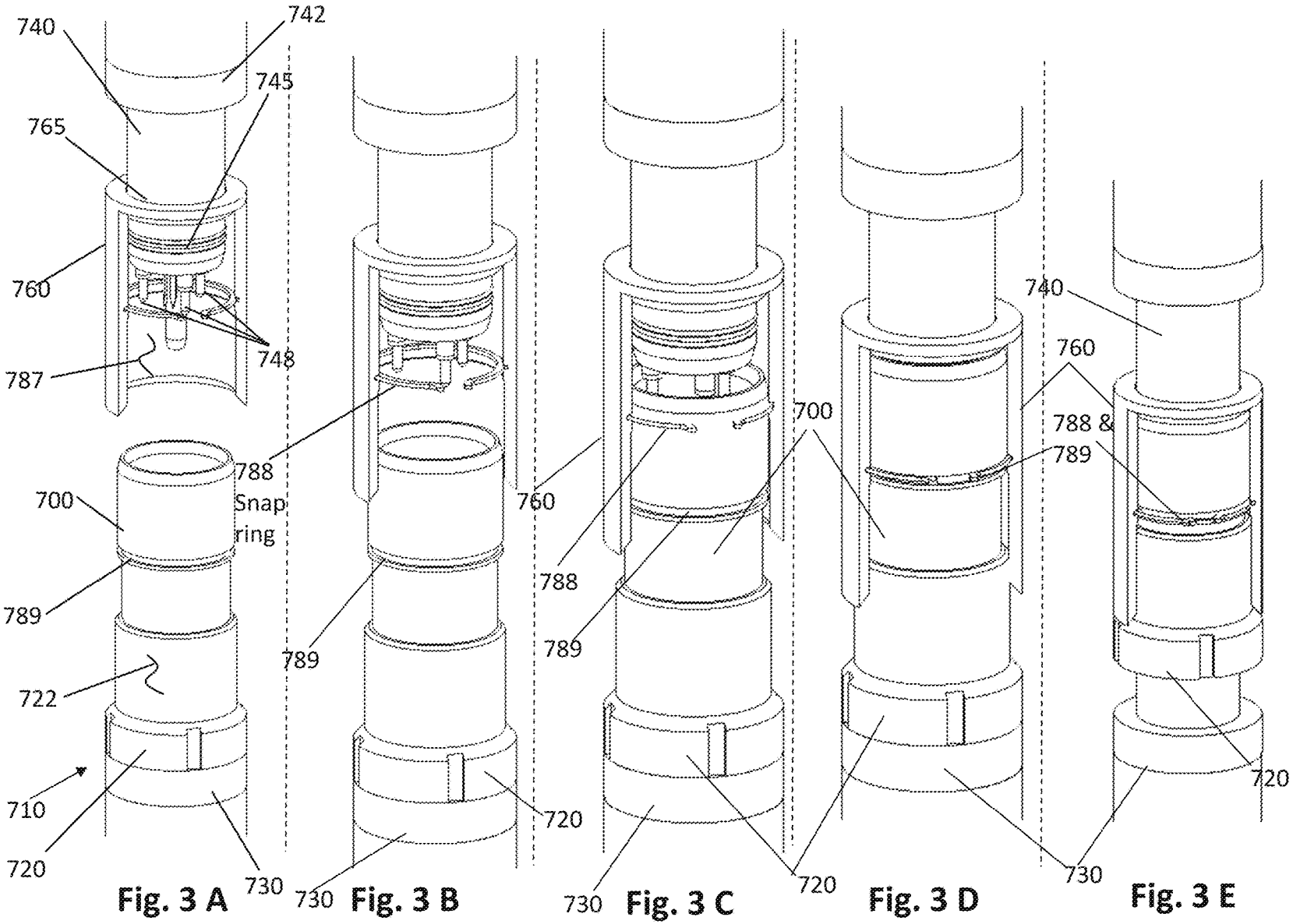
Figure 3H:
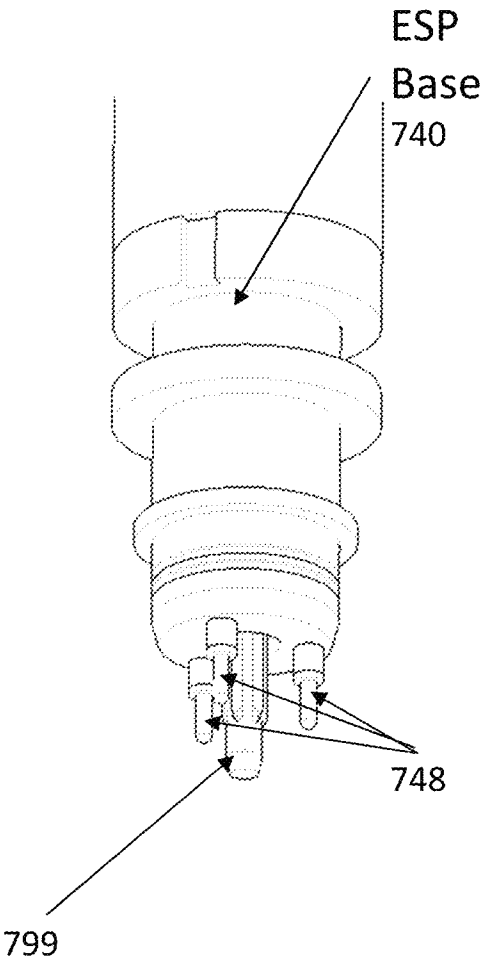
Figure 3G:
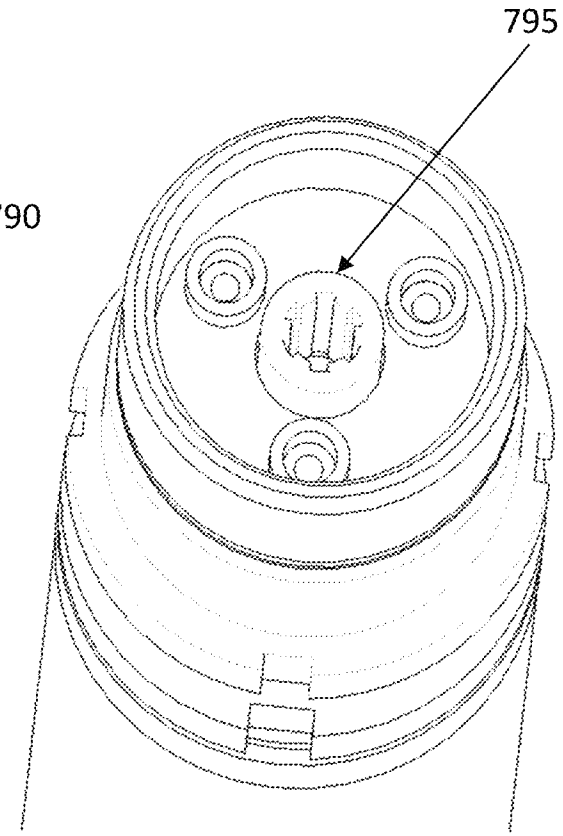
Figure 3F:
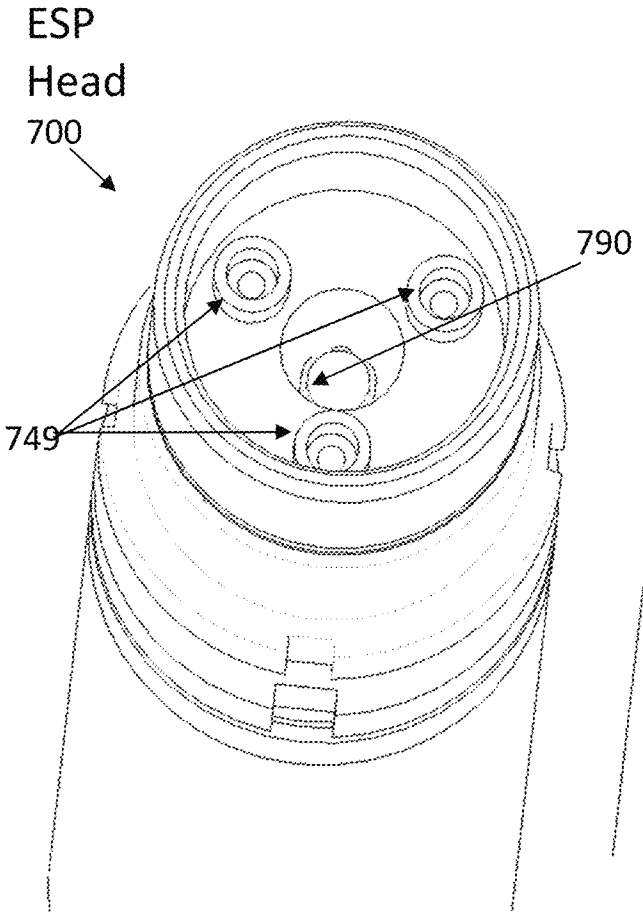
Figure 3L:
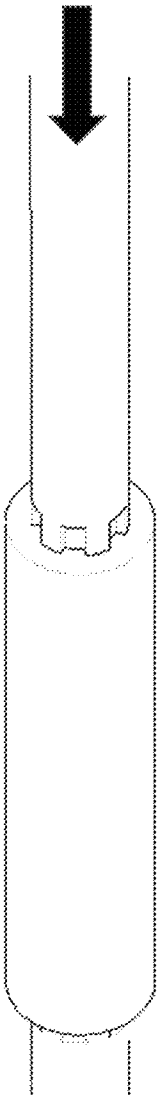
Figure 3K:
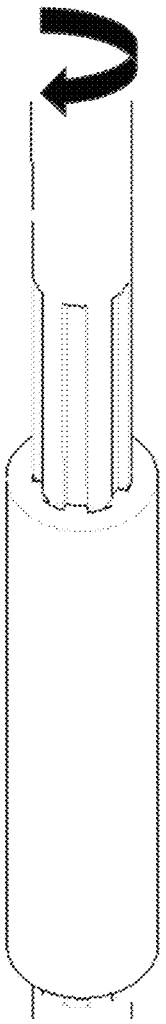
Figure 3J:
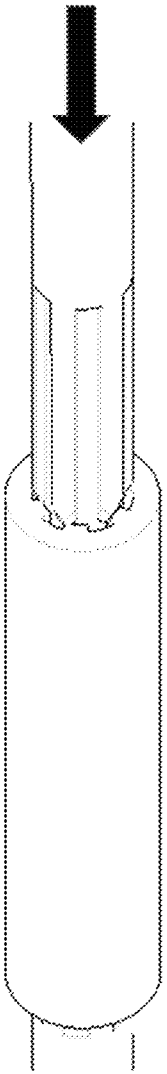
Figure 3I:
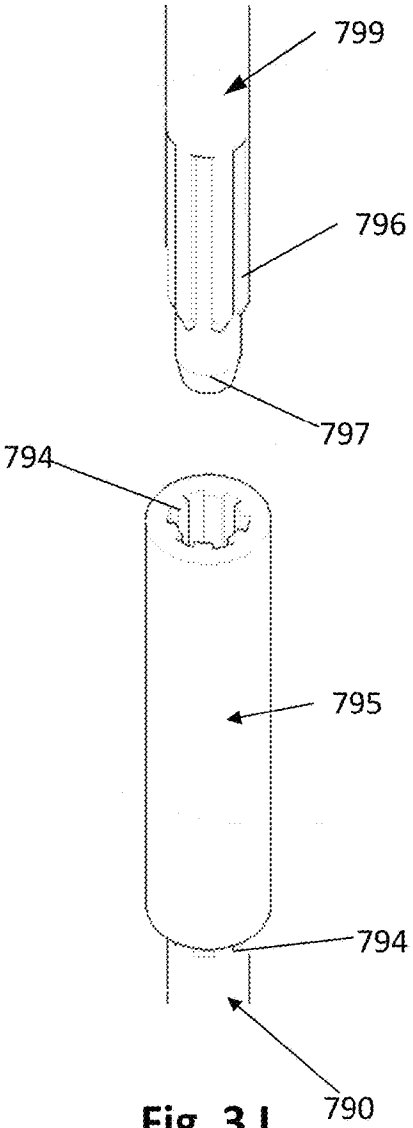

FIG. 3A through FIG. 3L show the temporary mating process that is performed inside the pressure containment system. The following figures detail the temporary mating process that occurs after the orientation and alignment process that is detailed below. FIG. 3A shows the snap ring that is assembled into the coupling of the modified base assembly. FIG. 3B shows the beginning of the mating process as the upper ESP component is lowered into the pressure containment system. FIG. 3C shows the snap ring expanding as it contacts the lead chamfer of the modified head assembly. FIG. 3D shows the snap ring engaging the groove in the modified base assembly to create the temporary joint between the upper and lower ESP components. The ESP string with the temporary mated joint is raised into the lubricator, the BOP is closed and the pressure is bled from the lubricator. Then FIG. 3E shows the operation of creating a permanent joint by making up the lock nut to the coupling of the modified base assembly. FIG. 3F through FIG. 3K show the mating operation of the shafts of the upper and lower ESP components. The coupling is mated to the lower shaft prior to mating. The top of the coupling has lead in chamfers that engage the lead in chamfer of the upper shaft to automatically orient and align the shafts during the mating process.

FIGS. 5A through 5C are sketches of the operation to raise the tools to the access hatch, remove guides, tighten lock nut, and deploy. The steps are described in the process in FIG. 2. Shown in these operational sketches are: a Modified Electric Submersible Head Assembly 710; a locking nut 720 on the Modified Electric Submersible Head Assembly 710; a Modified Electric Submersible Base 740; a collar 760; and an alignment guide body left 801.

FIGS. 8A through 8F show the operation of the release cam mechanism. The sketches show the following components: a Modified Electric Submersible head 700; an Electric Submersible Head Assembly 710; a locking nut 720 on the Electric Submersible Head Assembly 710; a Modified Electric Submersible Base 740; an alignment notch 741; an Electric Submersible Base flange 742; a set of head terminals 749; a collar 760; an aperture 765 in collar 760 for base 740; a snap ring release mechanism 780; a mounting clamp 781 for snap ring mechanism 780; a release cam mechanism 782; a snap ring 788; and a groove 789 for snap ring 788.

FIGS. 10A through 10K are the running tool 400 with integral sealing plug 405 in a pick-up operation and then FIGS. 10L through 10P show the operation of releasing the running tool from the head assembly. The components and features shown are: a dog 410; a chamfer 414 on bottom circumference of dog 410; a release pin(s) 415; a lift spring 420 under slide 425; a slide 425; an aperture 427 in slide 425 for shear pins 445; a lift screw 430; an adapter 435; a housing 440 for components of running tool 400; a chamfer 444 on inner circumference of housing 440 to grip and release dog 410 at chamfer 414; a shear pin 445; a Modified Electric Submersible head 700; and a lead in chamfer 701 on head 700.

The alternative mating and de-mating tools operate in a similar manner. These steps shown in FIGS. 11 through 16 are using this alternative group of tools and components employing a ratchet bolt and clamp compatible with standard bolt coupling of the head and base. These were described in detail above. This method allows for the installation and removal of an ESP while utilizing the standard head and base of the ESP. This deployment method allows for the ESP supplier to utilize standard off the shelf equipment for initial installation and repair and replacement of ESP components. The method still incorporates the running tool 400 shown in FIG. 9 and the described in the first system operation immediately preceding this description of the alternative operation. The installation method also employs the installation guides 805, 810 as shown in FIG. 4 above and described in the system operation. This alternative method still pertains to the employment of tools to provide a temporary connection of the ESP components which will replace the standard bolted connection (with bolts 900) of the ESP assembly. The basic steps in the process are the same as the preferred embodiment of the invention. The mate and de-mate of the ESP components are performed within the pressure control system. The tools that perform the temporary mate and de-mate of the ESP components for this method replace the tools were identified in FIG. 11. These tools are used for the installation of the ESP. The standard ESP head and base identified are part of the ESP assembly. The tool kit comprises a set of ratchet bolts 910 that are installed in the standard head 815 of the lower ESP component and a set of ratchet halves 920, a set of spring clips 930, a set of guide pins 950, a ratchet guide 960 and a ring clamp 940 that are made up to the standard base 840 of the upper ESP component. The numbers of ratchet bolts and corresponding ratchet halves, spring clips and guide pins are dependent on the tensile force required by the application.

In operation the ratchet bolts, shown in FIGS. 12A and 12B, are made up to the bolt holes of the head standard 815 of the lower ESP component. The alignment tool 810 is made up to the lower ESP component, the running tool 400 is made up to the lower ESP component and the lower ESP component is pulled into the lubricator. The lubricator 310 is made up to the well head 360 and after pressure equalization (with valve 330) the lower ESP component is lowered into the pressure containment system and rests on a landing shoulder 450 in the pressure containment system. The running tool 400 is released, and the well is closed. FIG. 12C describes the upper ESP component prior to makeup of the tool kit. FIG. 12D describes the spring clips positioned on the base of the upper ESP component. FIG. 12E describes the ratchet halves making up to the base of the upper ESP component. The ratchet halves are positioned inside the previously placed spring clips. FIGS. 12F and 12G describe the makeup of the ratchet guide and guide pins to the base of the upper ESP assembly. FIGS. 12H and 12I describe the makeup of the ring clamp to the ratchet guide. The ratchet guide and ring clamp hold the ratchet halves in position in line with the holes in the base of the upper ESP assembly. FIG. 12J describes the positioning of the guide pin that push the ratchet halves apart against the spring clip to allow for insertion of the ratchet bolt during the mating operation. The alignment guide 805 is made up to the upper ESP component, the running tool 400 is made up to the top of the upper ESP component and the upper ESP component is pulled into the lubricator. The lubricator 310 is made up to the well head 360 and after pressure equalization the upper ESP component is lowered into the pressure containment system. FIGS. 12K through 12M describe the mating operation that occurs inside the pressure containment system. FIG. 12K describes the ratchet bolt entering the ratchet halves as the upper ESP component is lowered. FIG. 12L describes the ratchet bolt pushing the guide pin out of the ratchet halves. FIG. 12M describes spring clips forcing the ratchet halves to close around the ratchet bolt creating the temporary mate of the upper and lower ESP components.

FIGS. 13A through 13C are a cross section view of the mating operation inside the pressure containment system. FIG. 13C describes the cross section of the mating profile of the ratchet bolt to the ratchet halves. The undercut profile of the ratchet bolt creates an inward force on the ratchet halves when tension is applied to the mated connection. The temporary assembly is raised into the lubricator until the temporary mated connection is above the pressure containment system. The pressure is released, and the access panel of the lubricator is opened. The alignment guide and alignment tool are removed from the mated assembly. The ratchet guide and guide pins are removed from the mated assembly. The ratchet bolts and associated ratchet halves and spring clips are successively replaced by the standard ESP bolt. After all bolts are in place the access panel is closed, the pressure is equalized the BOP is opened and the system is lowered into the well.

FIG. 14 describes the tool set for the de-mate of the assembled ESP. The figure describes the standard ESP head and base that are components of the ESP assembly and not part of the tool kit. The tool kit comprises a set of ratchet bolts that are positioned in the head of the lower ESP component replacing the standard bolt of the assembly, sets of ratchet quarters, lock slides and lift pins that are made up to the base of the upper ESP component and the head support with stop pins that is made up to the head of the lower ESP component. The spring-loaded landing system is positioned inside the pressure containment system and comprises a landing top plate, landing spring and a landing shoulder. The de-mating operation begins with the running/pulling tool lowering into the well and pulling the ESP assembly to the surface. The top mated connection of the ESP assembly is pulled into the lubricator. The blow out preventer of the pressure control system is closed around the lower portion of the ESP assembly and the pressure in the lubricator is released. The access door of the lubricator is opened to allow for the makeup of the de-mate tool kit.

The de-mate operation is described in FIGS. 15 and 16. FIG. 15A describes the ratchet bolt prior to replacing the bolt of the mated ESP assembly. FIG. 15B describes the replacement of the bolt in the ESP assembly with the ratchet bolt. FIG. 15C describes two of the ratchet quarters prior to placement around the ratchet bolt. FIG. 15D describes the 4 ratchet quarters placed around the ratchet bolt. FIG. 15E describes the lock slide prior to placement over the ratchet quarters. FIGS. 15F and 15G describe the lock slide sliding over the ratchet quarters holding them in position around the ratchet bolt. FIG. 15H describes the lock slides positioned over all the ratchet bolt and ratchet quarter assemblies. FIG. 15I describes the head support with stop pins making up to the head of the lower ESP component. FIGS. 15J and 15K describe the installation of the lift pin through the head support and into the lock slide. FIGS. 15 L and 15M describe the final position of the lift pins in the lock slides.

With the tool kit made up the ESP is ready for the de-mating process that is performed inside the pressure containment system. The access door to the lubricator is closed and the pressure is equalized. The BOP is opened, and the ESP assembly is lowered into the pressure containment system. FIGS. 15N through 15T describe the operation that is performed inside the pressure containment system. FIG. 15N describes the ESP lowering into the pressure containment system and approaching the spring-loaded landing system that is located within the pressure containment system. FIG. 15O describes the ESP assembly continuing to be lowered in the pressure containment system until the head support contacts the top landing plate of the spring-loaded landing system. The spring of the spring-loaded landing system is removed for clarity. FIG. 15P describes the continued lowering of ESP assembly into the pressure containment system with the lift pins contacting the landing shoulder of the spring-loaded landing system. As the ESP assembly is lowered the lift pins push up on the lock slide. The spring of the spring-loaded landing system applies an upward load on the ESP assembly reducing the tensile load at the mated connection. FIGS. 15Q and 15R are a close view describing the outward movement of the ratchet quarters as the lock slide moves upward. As the ratchet quarters move away from the ratchet bolt the ratchet bolts are free to slide out of the ratchet quarters. FIGS. 15S and 15T describe the motion of the ESP as the upper ESP component is separated from the lower ESP component. The upper ESP component is pulled into the lubricator, the well is closed, pressure is released, and the upper ESP component is removed from the lubricator and laid down.

Finally, FIG. 16 are cross section views of the de-mating operation. FIG. 16A describes the mated ratchet bolt and ratchet quarters with the lock slide holding the ratchet quarters against the ratchet bolt. FIG. 16B describes the motion of the ratchet quarters as the lock slide is moved upward. The ratchet quarters are pushed into the pockets of the lock slide. The close view inset describes the profile of the ratchet bolt and the ratchet quarters. The profile of the ratchet bolt creates an outward force on the ratchet quarters as a tensile load is applied to the mated connection. FIG. 16C describes the motion of the base and head of the upper and lower ESP components as the de-mate operation completes. FIG. 16D is a sketch of the boss 975 on back side of ratchet quarter 970. FIG. 16E is a sketch of the Internal pocket 988 in lock slide 986. FIG. 16F is a sketch of the back side boss 975 of ratchet quarter 970 not yet in pocket 988 of lock slide 986. FIG. 16G is a sketch of the back side boss 975 of ratchet quarter 970 aligned with pocket 988 of lock slide 986. FIG. 16H is a sketch of the ratchet quarter 970 profiles 915 no longer in contact with ratchet bolt 910.

With this description it is to be understood that the Electric Submersible Pump (ESP) Deployment Method 33 and Tools to Accomplish Method for Oil Wells is not to be limited to only the disclosed embodiment of product. The features of the method 33 and associated are intended to cover various modifications and equivalent arrangements included within the spirit and scope of the description.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. Various features and aspects of the disclosed embodiments can be combined with or substituted for one another to form varying modes of the disclosed inventions. Thus, it is intended that the scope of at least some of the present inventions herein disclosed should not be limited by the disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any embodiment, feature, or combination of features shown herein. This is true even if only a single embodiment of the feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed considering the number of recited significant digits and by applying ordinary rounding techniques.

The present invention contemplates modifications as would occur to those skilled in the art. While the disclosure has been illustrated and described in detail in the figures and the foregoing description, the same is to be considered as illustrative and not restrictive in character, it being understood that only selected embodiments have been shown and described and that all changes, modifications, and equivalents that come within the spirit of the disclosures described heretofore and or/defined by the following claims are desired to be protected.

What is claimed is:

1. A deployment method for an electric submersible pump (ESP) using an ESP head assembly and an ESP base assembly with a specific set of tools for exchanging the ESP and a string of components of the ESP in a lubricator (310) and a low-profile docking station in a standard pressure containment system at a well head (360) of an oil well; the deployment method comprising:

first, placing the standard pressure containment system and a set of wireline equipment in place at a well for a workover and next performing a set of the following steps:

Step 1: Close a master valve (320) and a pressure equalization valve (330) and bleed pressure by opening a bleed valve (315) to achieve atmospheric pressure;

Step 2: Break out the lubricator (310) and attach a set of alignment guide tools (805,810) to ESP component;

Step 3: Lower a running tool (400) from lubricator to latch on an ESP component or another assembled ESP string component;

Step 4: Lift a tool string (390) into the lubricator (310);

Step 5: Make up the lubricator (310) using a set of tools;

Step 6: Open the pressure equalization valve (330) and open the master valve (320);

Step 7: Lower the tool string (390) and mate to a motor (30) or another ESP component;

Step 8: Lift the tool string (390) for final makeup;

Step 9: Close a blow out preventer (BOP) ram (350), close the pressure equalization valve (330), and bleed pressure by opening the bleed valve (315);

Step 10: Open an access panel (500) on the lubricator (310), makeup connection, remove the set of alignment guide tools (805,810), and close the access panel (500);

Step 11: Close the bleed the valve (315), open the pressure equalization valve (330), and open the BOP ram (350);

Step 12: Lower the tool string (390) to rest on a shoulder (450) and release the running tool (400);

Step 13: Repeat Steps 1 through 12 to complete assembly of the remaining components of the ESP string;

Step 14: After completing assembly of all components of an ESP string, lower the ESP string to the pump setting depth and mate an ESP motor connector to the docking station in the borehole;

Step 15: Release the running tool string from the ESP and pull into lubricator at a ground surface;

Step 16: Remove the standard pressure containment system and the set of wireline equipment from the well and re-start the ESP pump;

Step 17: Remove the ESP from the well by reversing the steps 1-16 of the described installation using a set of release tools (780) and/or de-mating tools;

wherein the manner to exchange the ESP and at least one string in the lubricator and the low-profile docking station are enabled using the specific set of tools including the running tool (400) with an integral sealing plug, and the set of alignment guide tools (805, 810), and the set of release tools (780) and/or mating/demating tools.

2. The deployment method for the ESP in claim 1 wherein the running tool with an integral sealing plug having an external thread and an internal aperture with threads, and the integral sealing plug having a set of slots for a set of pins, the running tool comprised of a seal groove for a seal ring, a securing and aligning release pin, a release pin nut, a slide with a set of apertures for the pins, a lift spring under the slide, a lift screw, an adapter, and a housing.

3. The deployment method for the ESP in claim 1 wherein the alignment guides have a left body and a right body, each body having a set of tabs, and a set of keys.

4. The deployment method for the ESP in claim 1 wherein the head and the base assembly is selected from the group consisting of a modified head and base assembly and a standard head and base assembly.

5. The deployment method for the ESP in claim 4 wherein the modified head and base assembly comprise a modified ESP head (700) with a groove (789), a snap ring (788), a lock nut (720), a collar (760) with a release window (785), a snap ring release mechanism (780) with a release cam mechanism (782), and a modified ESP base (740).

6. The deployment method for the ESP in claim 5 wherein the snap ring (788) mates into the groove (789) to allow a temporary mating of the modified head and modified base.

7. The deployment method for the ESP in claim 5 wherein the snap ring release mechanism (780) is accessed through the release window (785) in the collar (760) and is fastened with a mounting clamp (781) to allow a temporary mating of the modified head and modified base.

8. The deployment method for the ESP in claim 7 wherein the release cam mechanism (782) comprises a release cam with a driver and a follower, a pin, a torsion spring, and a snap ring that mates with a groove in a base.

9. The deployment method for the ESP in claim 4 wherein the standard head and base assembly comprise a standard ESP head (815) and a standard ESP base (840) with a set of mating and a set of de-mating tools.

10. The deployment method for the ESP in claim 9 wherein the set of mating tools comprises a group of ratchet bolt and clamp components comprising a set of ratchet bolts for replacing standard assembly bolts wherein each ratchet bolt is configured with a ratchet undercut profile, a set of ratchet halves, a set of spring clips, a ring clamp, and a ratchet guide with a set of guide pins.

11. The deployment method for the ESP in claim 9 wherein the set of de-mating tools comprises a group of ratchet bolt and clamp components comprising a set of ratchet bolts for replacing standard assembly bolts wherein each ratchet bolt is configured with a ratchet profile, a set of ratchet ring quarters wherein each quarter has bosses on a back side, a head support with a set of stop pins, a lock slide with an internal pocket that engages with the bosses, a set of lift pins that engage with the lock slide, and a landing assembly comprised of a shoulder, a spring, and a top plate.

12. A deployment method for an electric submersible pump (ESP) using a standard ESP head assembly (815) and a standard ESP base assembly (840) with a specific set of tools for exchanging the ESP and a string of components of the ESP in a lubricator (310) and a low-profile docking station in a standard pressure containment system at the well head (360) of an oil well the deployment method comprising:

first, placing the standard pressure containment system and a wireline equipment in place at a well for the workover and next performing a set of the following steps:

Step 1: Close a pair of valves (320, 330) and bleed pressure by opening a bleed valve (315) to achieve atmospheric pressure;

Step 2: Break out a lubricator (310) and attach a set of alignment guide tools (805,810) and mating tools to ESP component;

Step 3: Lower a running tool (400) from lubricator to latch on an ESP component or another assembled ESP string component;

Step 4: Lift a tool string (390) into the lubricator (310);

Step 5: Make up the lubricator (310) using a set of tools;

Step 6: Open the pressure equalization valve (330) and open the master valve (320);

Step 7: Lower the tool string (390) and mate to a motor (30) or other ESP component;

Step 8: Lift the tool string (390) for final makeup Step 9: Close a blow out preventer (BOP) ram (350), close the pressure equalization valve (330), and bleed pressure by opening the bleed valve (315);

Step 10: Open an access panel (500) on the lubricator (310), decouple mating tools and makeup collar (550) makeup final connection, remove the set of alignment guide tools (805,810), and close the access panel (500);

Step 11: Close the bleed valve (315), open the pressure equalization valve (330), and open the BOP ram (350);

Step 12: Lower the tool string (390) to rest on a shoulder (450) and release the running tool (400);

Step 13: Repeat Steps 1 through 12 to complete assembly of the remaining components of the ESP string;

Step 14: After completing assembly of an ESP string, lower the ESP string to the pump setting depth and mate an ESP motor connector to the docking station in the borehole;

Step 15: Release the running tool string from the ESP and pull to a surface;

Step 16: Remove the wireline equipment from the well, remove the standard pressure containment system, and re-start the ESP pump;

Step 17: Remove the ESP from the well by reversing the steps 1-16 of the described installation using a set of de-mating tools;

wherein the manner to exchange the ESP and at least one string in the lubricator and the low-profile docking station are enabled using the specific set of tools including the running tool (400) with an integral sealing plug, and the set of the set of mating/de-mating tools.

13. The deployment method for the ESP in claim 12 wherein the running tool with an integral sealing plug having an external thread and an internal aperture with threads, and the integral sealing plug having a set of slots for a set of pins, the running tool comprised of a seal groove for a seal ring, a securing and aligning release pin, a release pin nut, a slide with a set of apertures for the pins, a lift spring under the slide, a lift screw, an adapter, and a housing.

14. The deployment method for the ESP in claim 12 wherein the alignment guides have a left body and a right body, each body having a set of tabs, and a set of keys.

15. The deployment method for the ESP in claim 12 wherein the standard head and base assembly comprise a standard ESP head (815) and a standard ESP base (840) with a set of mating and a set of de-mating tools.

16. The deployment method for the ESP in claim 15 wherein the set of mating tools comprises a group of ratchet bolt and clamp components comprise a set of ratchet bolts for replacing standard assembly bolts wherein each ratchet bolt is configured with a ratchet undercut profile, a set of ratchet halves, a set of spring clips, a ring clamp, and a ratchet guide with a set of guide pins.

17. The deployment method for the ESP in claim 15 wherein the set of de-mating tools comprises a group of ratchet bolt and clamp components comprise a set of ratchet bolts for replacing standard assembly bolts wherein each ratchet bolt is configured with a ratchet profile, a set of ratchet ring quarters wherein each quarter has bosses on a back side, a head support with a set of stop pins, a lock slide with an internal pocket that engages with the bosses, a set of lift pins that engage with the lock slide, and a landing assembly comprised of a shoulder, a spring, and a top plate.

18. A deployment method for an electric submersible pump (ESP) using a modified ESP head assembly (710) and a modified ESP base (740) assembly with a specific set of tools for exchanging the ESP and a string of components of the ESP in a lubricator (310) and a low-profile docking station in a standard pressure containment system at the well head (360) of an oil wells comprising:

first, placing the standard pressure containment system and a wireline equipment in place at a well for the workover and next performing a set of the following steps:

Step 1: Close a pair of valves (320, 330) and bleed pressure by opening a bleed valve (315) to achieve atmospheric pressure;

Step 2: Break out a lubricator (310) and attach a set of alignment guide tools (805,810);

Step 3: Lower a running tool (400) from lubricator to latch on an ESP component or another assembled ESP string component;

Step 4: Lift a tool string (390) into the lubricator (310);

Step 5: Make up the lubricator (310) using a set of tools;

Step 6: Open the pressure equalization valve (330) and open the master valve (320);

Step 7: Lower the tool string (390) and mate to a motor (30) or other ESP component;

Step 8: Lift the tool string (390) for final makeup

Step 9: Close a blow out preventer (BOP) ram (350), close the pressure equalization valve (330), and bleed pressure by opening the bleed valve (315);

Step 10: Open an access panel (500) on the lubricator (310), makeup collar (550), remove the set of alignment guide tools (805,810), and close the access panel (500);

Step 11: Close the bleed valve (315), open the pressure equalization valve (330), and open the BOP ram (350);

Step 12: Lower the tool string (390) to rest on a shoulder (450) and release the running tool (400);

Step 13: Repeat Steps 1 through 12 to complete assembly of the remaining components of the ESP string;

Step 14: After completing assembly of an ESP string, lower the ESP string to the pump setting depth and mate an ESP motor connector to the docking station in the borehole;

Step 15: Release the running tool string from the ESP and pull to a surface;

Step 16: Remove the wireline equipment from the well, remove the standard pressure containment system, and re-start the ESP pump;

Step 17: Remove the ESP from the well by reversing the steps 1-16 of the described installation using a set of release tools (780; wherein the manner to exchange the ESP and at least one string in the lubricator and the low-profile docking station are enabled using tools including the running tool (400) with an integral sealing plug, and the set of alignment guide tools (805, 810), and the set of release tools (780).

19. The deployment method for the ESP in claim 18 wherein the running tool with an integral sealing plug having an external thread and an internal aperture with threads, and the integral sealing plug having a set of slots for a set of pins, the running tool comprised of a seal groove for a seal ring, a securing and aligning release pin, a release pin nut, a slide with a set of apertures for the pins, a lift spring under the slide, a lift screw, an adapter, and a housing.

20. The deployment method for the ESP in claim 18 wherein the alignment guides have a left body and a right body, each body having a set of tabs, and a set of keys.

21. The deployment method for the ESP in claim 18 wherein the modified head and base assembly comprise a modified ESP head (700) with a groove (789), a snap ring (788), a lock nut (720), a collar (760) with a release window (785), a snap ring release mechanism (780) with a release cam mechanism (782), and a modified ESP base (740).

22. The deployment method for the ESP in claim 21 wherein the snap ring (788) mates into the groove (789) to allow a temporary mating of the modified head and modified base.

23. The deployment method for the ESP in claim 21 wherein the snap ring release mechanism (780) is accessed through the release window (785) in the collar (760), and is fastened with a mounting clamp (781) to allow a temporary de-mating of the modified head and modified base.

24. The deployment method for the ESP in claim 21 wherein the release cam mechanism (782) comprises a release cam with a driver and a follower, a pin, a torsion spring, and a snap ring that mates with a groove in the modified ESP base (740).

* * * * *